US011459161B2

(12) United States Patent
Seichei

(10) Patent No.: US 11,459,161 B2
(45) Date of Patent: Oct. 4, 2022

(54) BUILDING BLOCK CONTAINER

(71) Applicant: Edward Seichei, Citrus Heights, CA (US)

(72) Inventor: Edward Seichei, Citrus Heights, CA (US)

( * ) Notice: Subject to any disclaimer, the term of this patent is extended or adjusted under 35 U.S.C. 154(b) by 540 days.

(21) Appl. No.: 16/565,751

(22) Filed: Sep. 10, 2019

(65) Prior Publication Data

US 2020/0087050 A1 Mar. 19, 2020

Related U.S. Application Data

(60) Provisional application No. 62/731,628, filed on Sep. 14, 2018.

(51) Int. Cl.
*B65D 81/36* (2006.01)
*B65D 21/02* (2006.01)

(52) U.S. Cl.
CPC ..... *B65D 81/361* (2013.01); *B65D 21/0204* (2013.01)

(58) Field of Classification Search
CPC .. B65D 21/0204; B65D 81/36; B65D 81/361; B65D 21/02; B65D 21/0209; B65D 21/023; B65D 21/0231; E04B 2/02; E04B 2/18

See application file for complete search history.

(56) References Cited

U.S. PATENT DOCUMENTS 4,624,383 A * 11/1986 Moore ..... B65D 81/361 52/DIG. 9
6,276,549 B1 * 8/2001 Fasci ..... B65D 21/0202 220/23.6
7,644,828 B1 * 1/2010 Klein ..... A63H 33/067 220/23.6
9,145,249 B2 * 9/2015 Adams ..... B65D 79/00
10,239,659 B2 * 3/2019 Meroz ..... B65D 21/0231
2006/0254947 A1 * 11/2006 Rogers ..... B65D 81/361 206/509
2006/0261063 A1 * 11/2006 Dyehouse ..... B65D 21/0231 220/23.4
2013/0213846 A1 * 8/2013 Hendrickson ..... B65D 81/361 206/509
2013/0213927 A1 * 8/2013 Hendrickson ..... E04H 1/005 215/383

(Continued)

*Primary Examiner* — Don M Anderson
(74) *Attorney, Agent, or Firm* — Craig A. Simmermon

(57) ABSTRACT

Building block container is a modular hollow building block that may be used to build a wall, shelter, structure, building, greenhouse, water filtration device, emergency shelter, pipeline, flood blockade, floodwall, dock, or raft. Building block container has a special design so that they are reversibly attachable to each other without fasteners. Building block container may also be used as a container to hold any type of liquid or solid contents. A plurality of building block container may be shipped to a disaster area, third world location, or anywhere with people in need, while filled with water or food, where the water or food may be consumed by those in need and then the empty building blocks may be used to build a wall, shelter, structure, building, etc. One or more building block containers may also be used as a water filtration device to filter unclean water into drinkable water.

8 Claims, 52 Drawing Sheets

(56) References Cited

U.S. PATENT DOCUMENTS

| | | | | |
|---|---|---|---|---|
| 2014/0073217 | A1* | 3/2014 | Shao | B65D 81/361<br>446/77 |
| 2014/0335753 | A1* | 11/2014 | Weiss | A63H 33/086<br>446/124 |
| 2014/0360897 | A1* | 12/2014 | Adams | B65D 79/00<br>206/216 |
| 2018/0258640 | A1* | 9/2018 | Herrin | E04B 2/18 |

* cited by examiner

FIG. 1
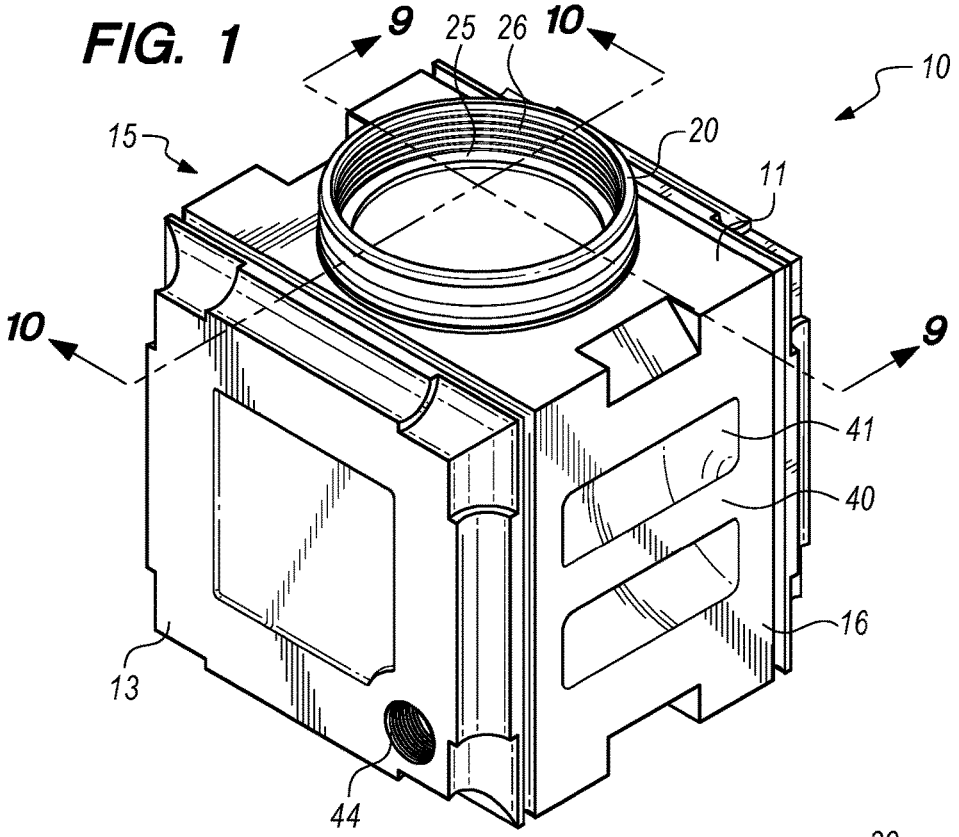
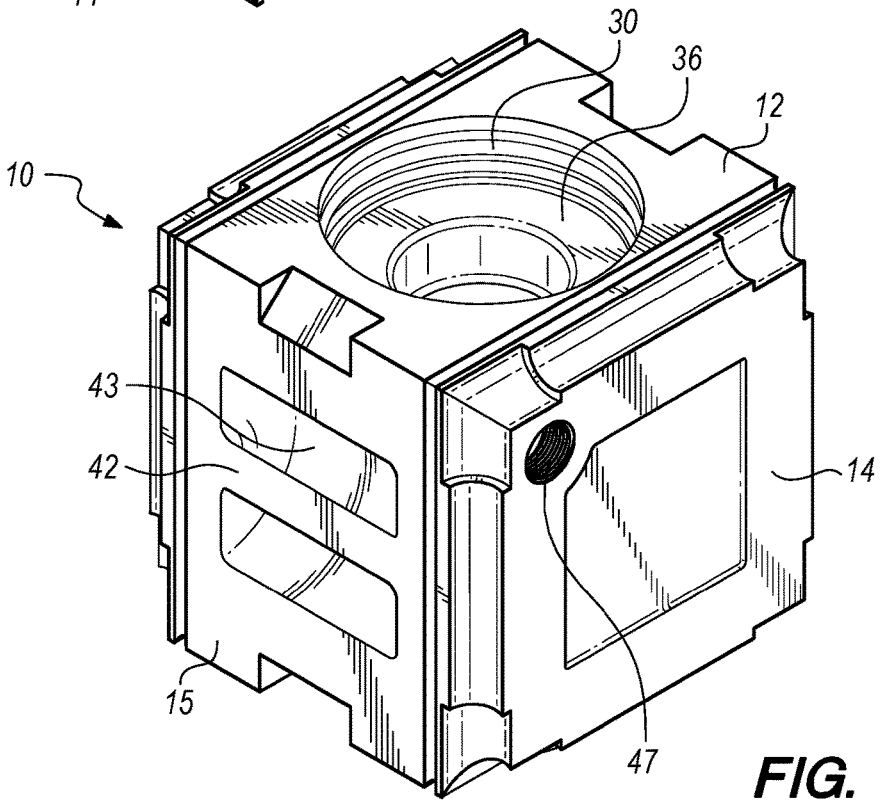
FIG. 2

BUILDING BLOCK CONTAINER

BACKGROUND OF THE INVENTION

1. Field of the Invention

This invention provides humanitarian aid and preemptive recycling. This invention relates to a hollow modular building block that is used to build a wall, shelter, structure, building, greenhouse, water filtration device, emergency shelter, pipeline, flood blockade, flood wall, dock, or raft where the hollow modular building block may also be used as a container to hold liquid or solid contents. Hollow modular building blocks are specially designed and shaped so that they may be ported together. Hollow modular building blocks the blocks are reversibly attachable to each other with or without fasteners. Hollow modular building blocks are specially designed and shaped to receive and hold pipe work and electrical conduit without any fasteners. Hollow modular building blocks are specially designed and shaped to also function as a water filtration device. The hollow modular building block system described below is a complete system for humanitarian aid that may be shipped to a disaster area, third world location, or anywhere with people in need, while filled with water or food, where the water or food may be consumed by those in need and the empty hollow modular building blocks may be used to build a wall, shelter, structure, building, greenhouse, water filtration device, emergency shelter, pipeline, flood blockade, dock, or raft.

2. Description of Related Art

There are many building blocks in the prior art, however, none have the special shape and features of the building block described here below. There are many containers in the prior art, however, none have the special shape and features of the container described here below.

BRIEF SUMMARY OF THE INVENTION

In is an aspect of building block container to be modular.

In is an aspect of building block container to be a watertight hollow container that can hold any type of liquid such as drinking water, milk, baby formula, juice, soup, or any other type of liquid.

In is an aspect of building block container to be a watertight hollow container that can hold any type of solid, granular solid, or powder such as grain, rice, corn, powdered milk, powdered baby formula, dehydrated food, concrete, cement, or any type of solid or powder, etc.

In is an aspect of building block container to be a watertight hollow container that can hold paperwork such as survival instructions, building instructions, evacuation instructions, public service announcements, political message, message to the people, or any other type of paperwork.

In is an aspect of building block container to be a hollow container that can hold just about anything that is desired.

In is an aspect of building block container to function as a building block wherein a plurality of such may be assembled or stacked together to form a wall, shelter, structure, building, greenhouse, water filtration device, emergency shelter, pipeline, flood blockade, dock, or raft.

In is an aspect of building block container to be a rigid block member or a rigid block-shaped member wherein a plurality of such may be used to build or erect a wall, shelter, structure, or building.

In is an aspect of building block container to be removeably attachable to all other building block containers without any fasteners.

In is an aspect of building block container to have at least one male cylindrical protrusion.

In is an aspect of building block container to have at least one female cylindrical cavity.

In is an aspect of male cylindrical protrusion to mate with female cylindrical cavity and vice versa.

In is an aspect of male cylindrical protrusion form a press-fit or snap-fit with female cylindrical cavity and vice versa.

In is an aspect of building block container to include a left handle and a right handle.

In is an aspect of building block container to include at least one pipe fitting port for the attachment of a pipe fitting.

In is an aspect of building block container to include pipe and conduit attachment surfaces or cavities wherein various pipes and conduits may be rigidly attached to building block containers without any fasteners.

In is an aspect of building block container to include a filter disc that may be inserted into building block container and used to filter water or any other liquid.

In is an aspect of building block container to include a series of bracket members that may be attached to one or more building block containers.

In is an aspect of the series of bracket members to support various support members such as a rafter, joist, beam, stud, post, header, truss, window, pre-hung door, siding, wall bond, insulation, or other support members associated with the construction of a wall, shelter, structure, or building.

In is an aspect of building block container to include an RFID electronic chip that may include various information such as: production dates, ship dates, fill dates, contents information, tracking information, building instructions, general instructions, requests, messages, or any other type of electronic information.

BRIEF DESCRIPTION OF THE DRAWINGS

FIG. 1 is a top perspective view of building block container.

FIG. 2 is a bottom perspective view of building block container.

DEFINITION LIST

Figure 3:
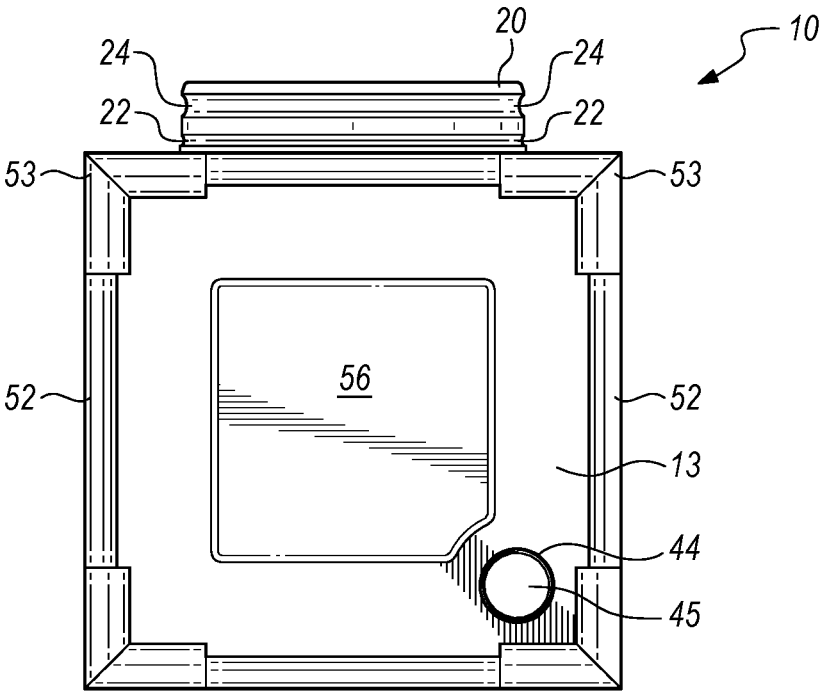
FIG. 3 is a front elevation view of building block container.
Figure 4:
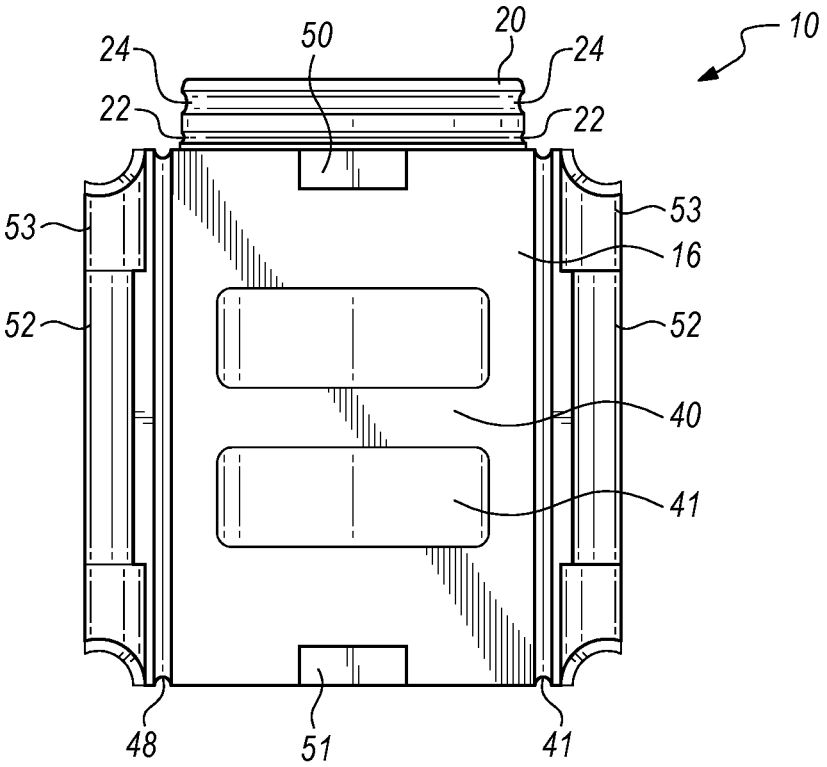
FIG. 4 is a right side elevation view of building block container.
Figure 5:
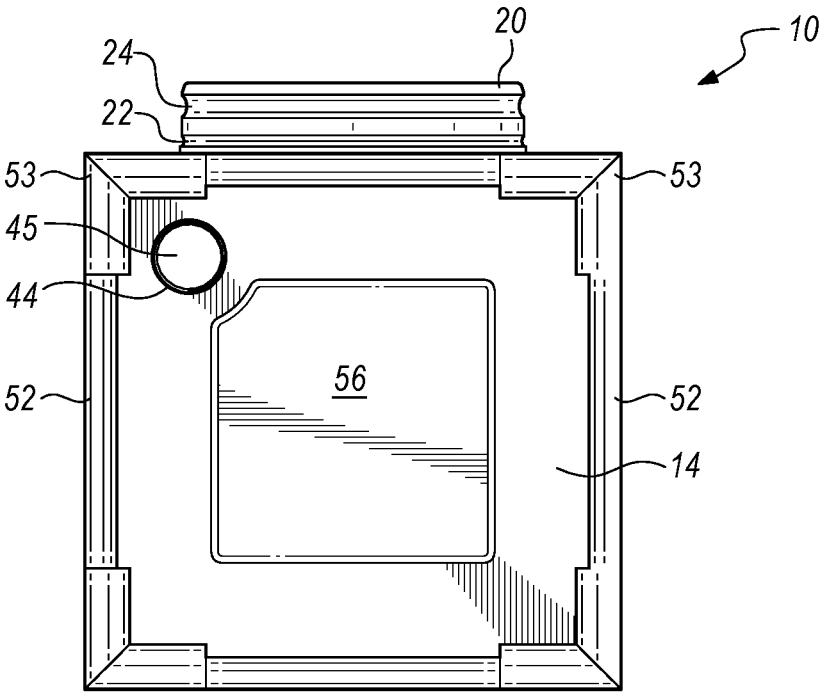
FIG. 5 is a rear elevation view of building block container.
Figure 6:
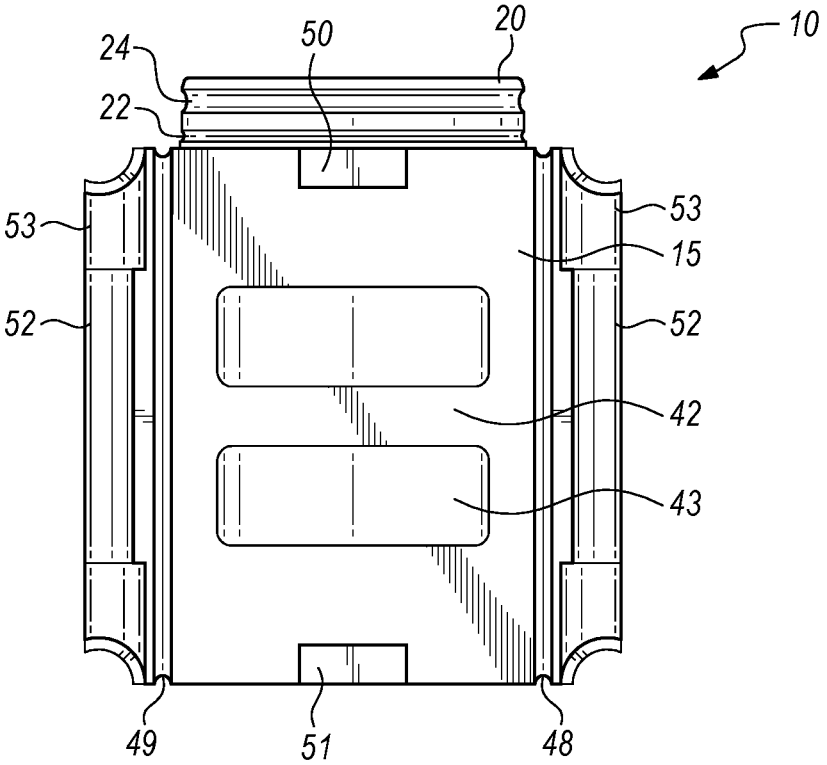
FIG. 6 is a left side elevation view of building block container.
Figure 7:
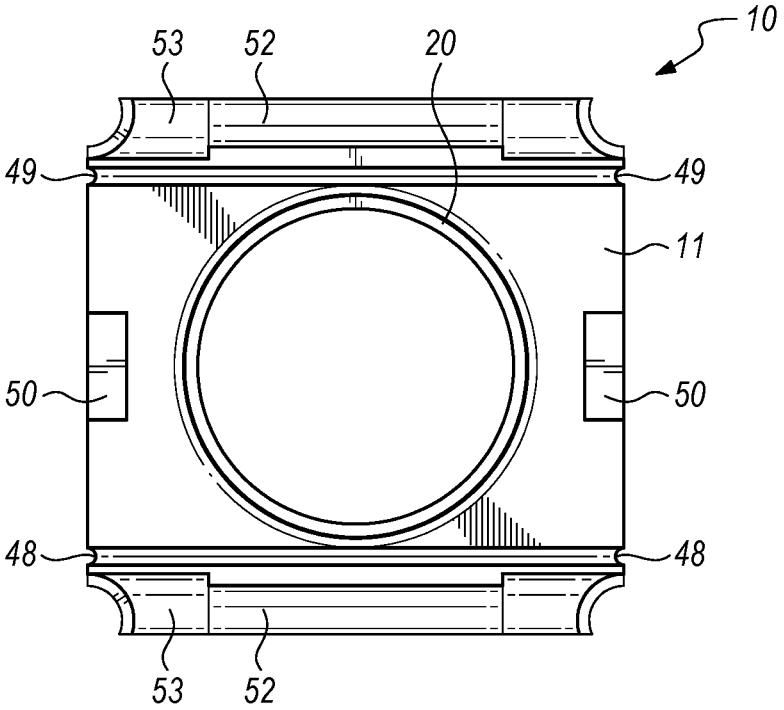
FIG. 7 is a top plan view of building block container.
Figure 8:
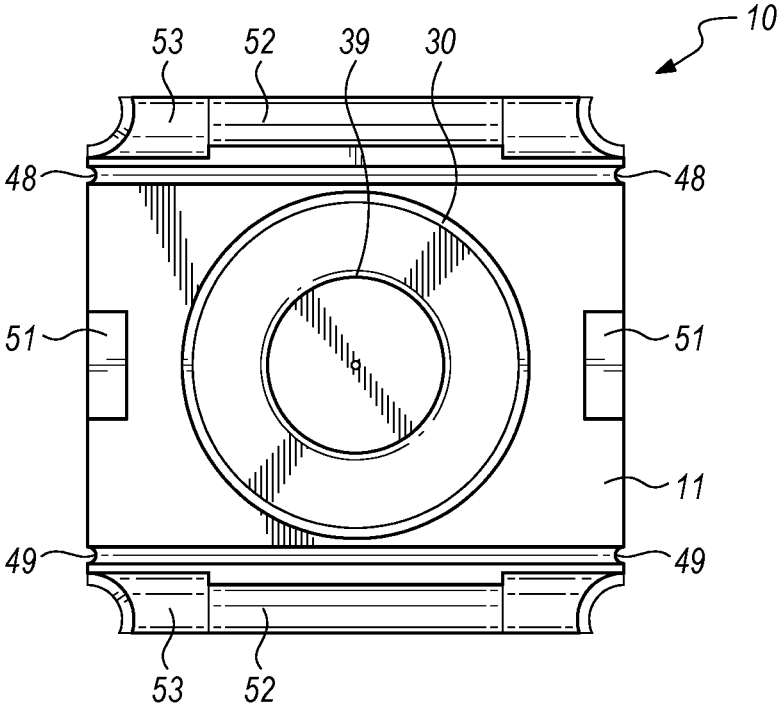
FIG. 8 is a bottom plan view of building block container.
Figure 9:
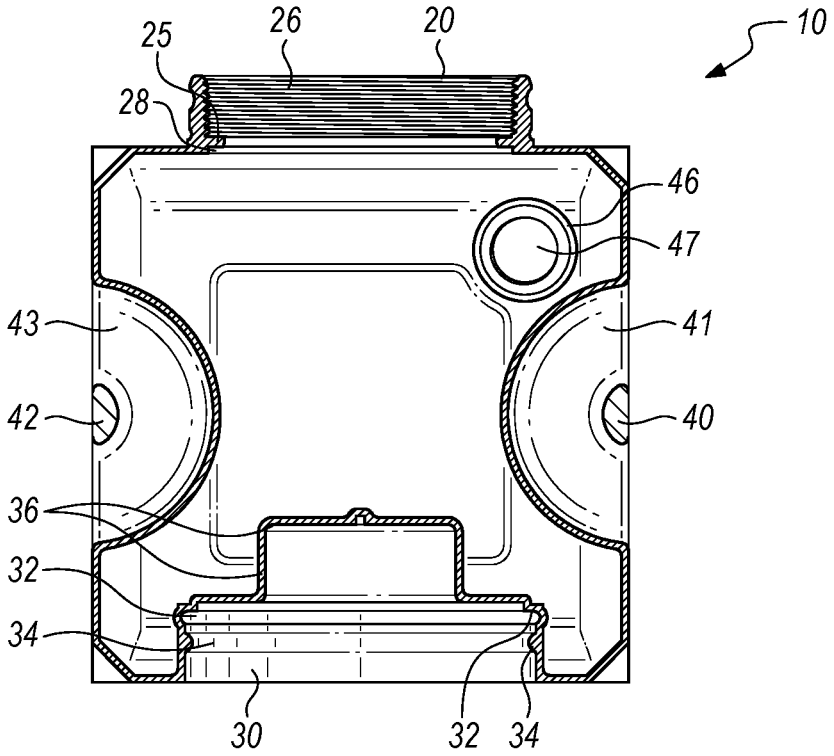
FIG. 9 is a cross sectional view taken from section 9-9 of FIG. 1.
Figure 10:
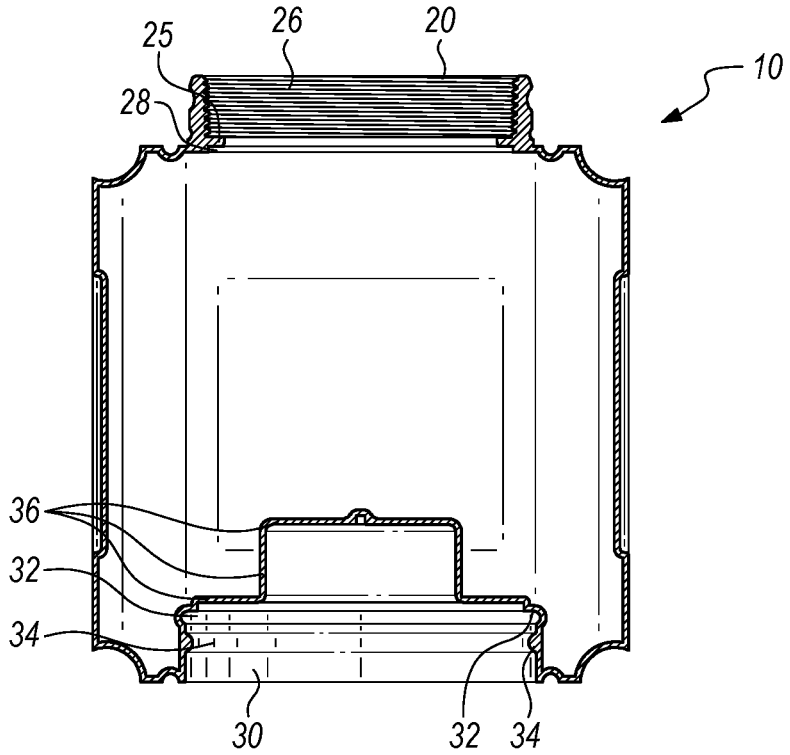
FIG. 10 is a cross sectional view taken from section 10-10 of FIG. 1.
Figure 11:
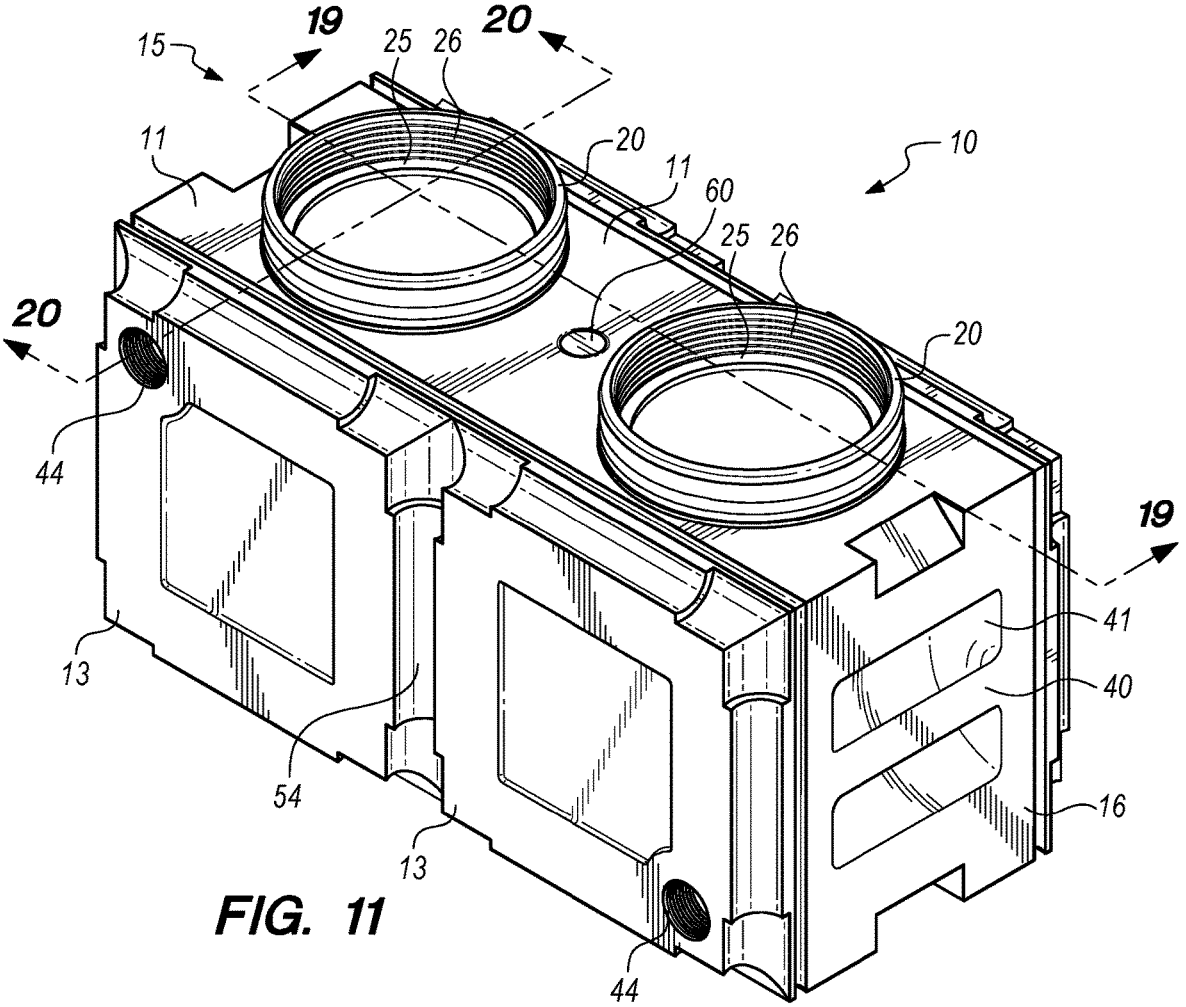
FIG. 11 is a top perspective view of a second embodiment of building block container.
Figure 12:
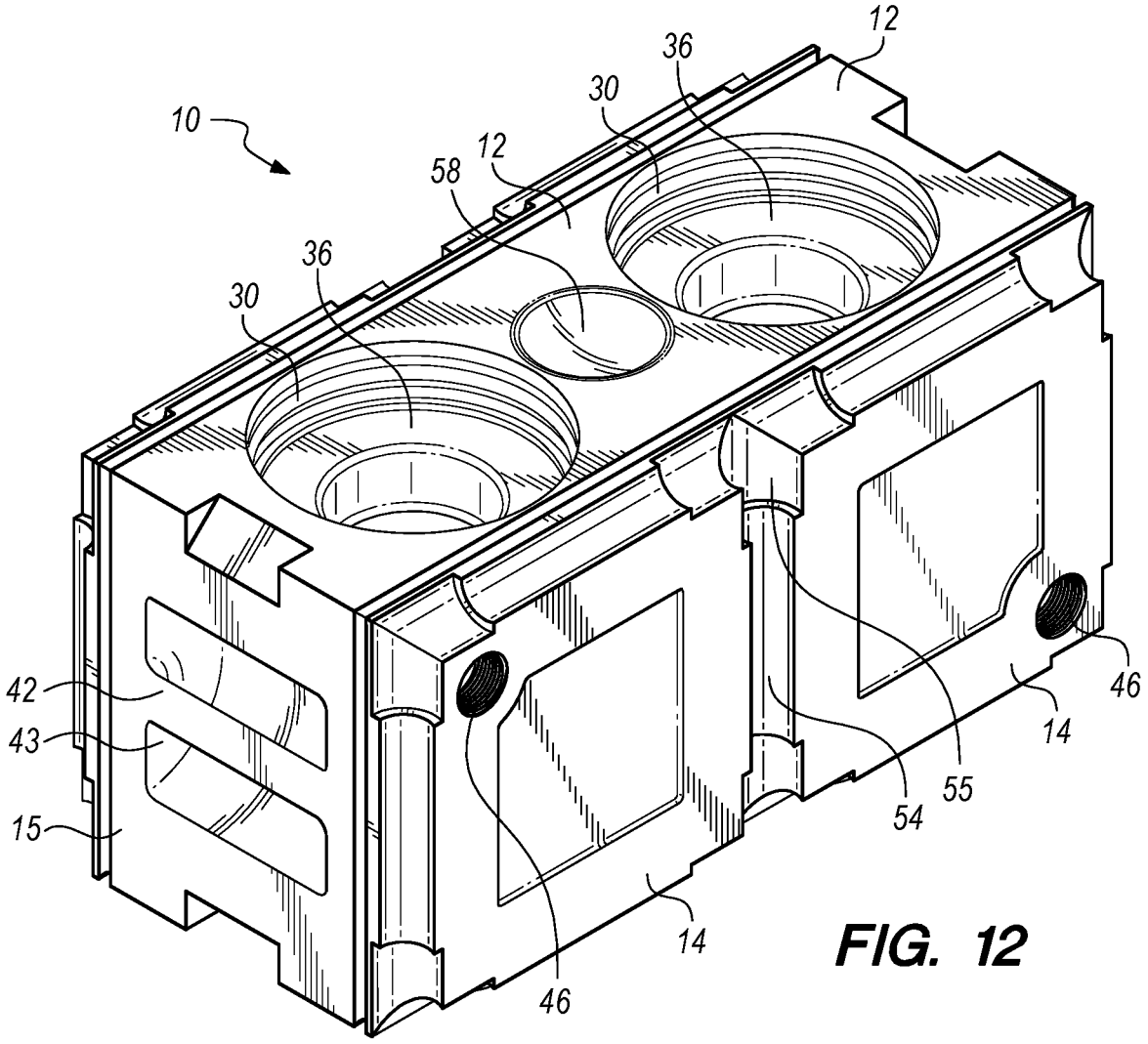
FIG. 12 is a bottom perspective view of a second embodiment of building block container.
Figure 13:
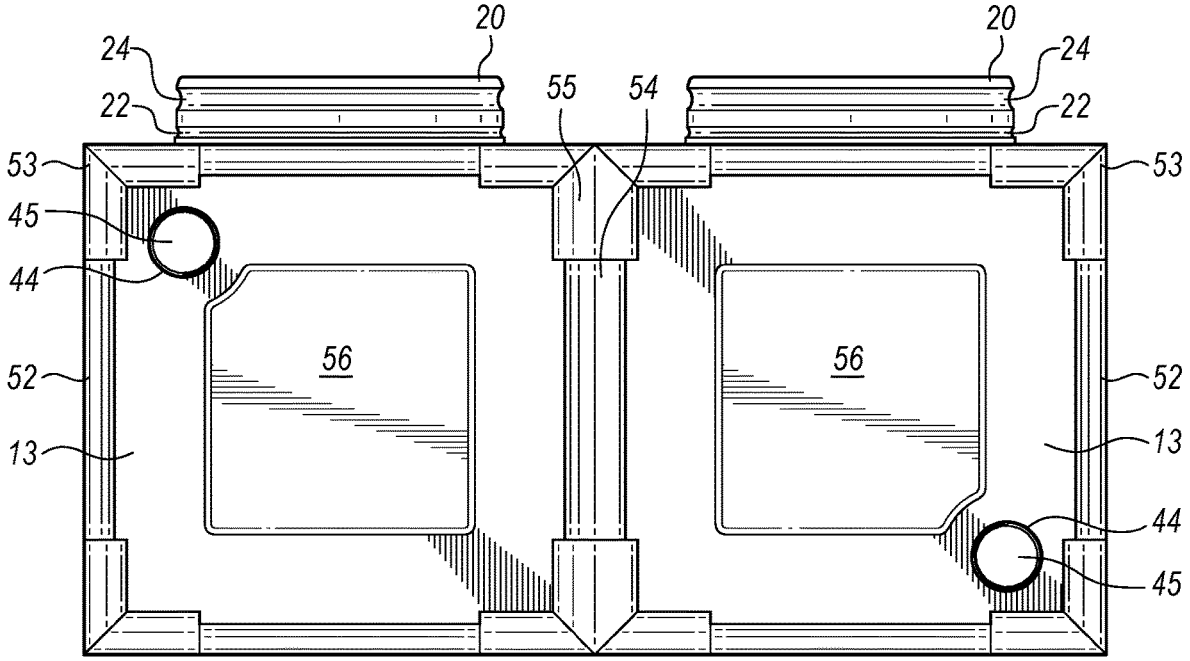
FIG. 13 is a front elevation view of a second embodiment of building block container.
Figure 14:
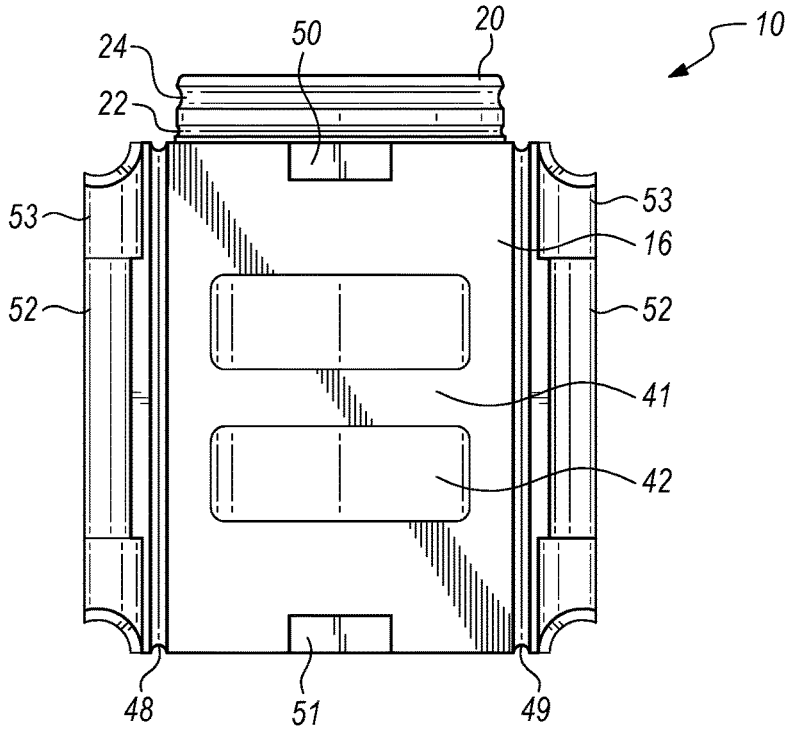
FIG. 14 is a right side elevation view of a second embodiment of building block container.
Figure 15:
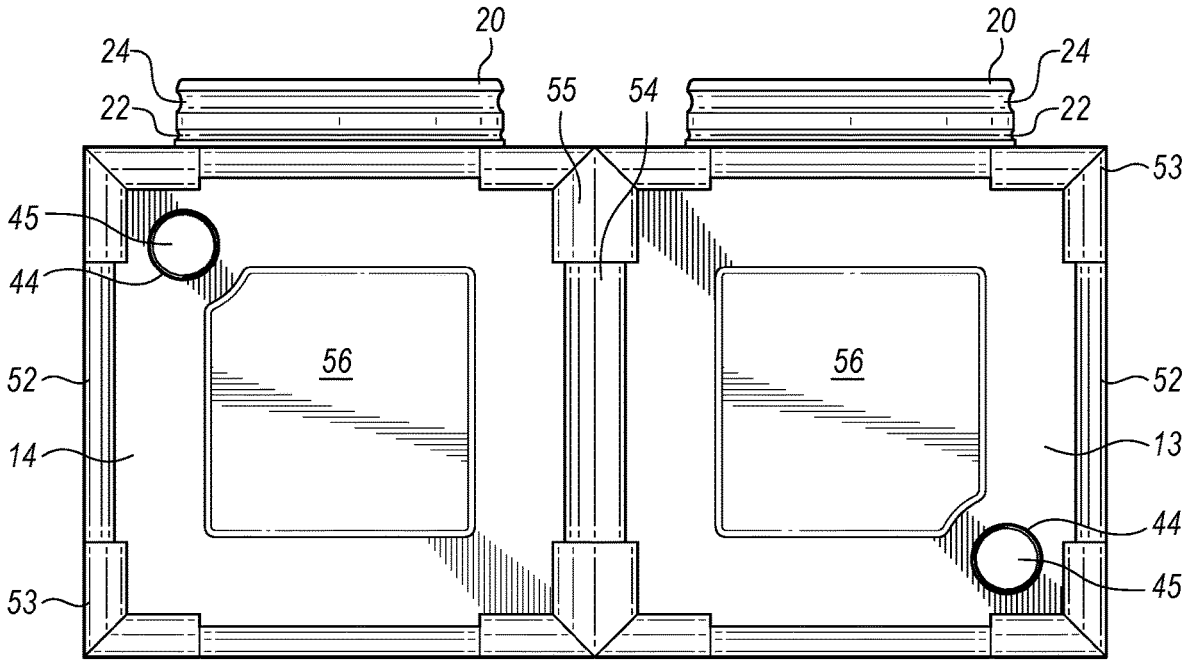
FIG. 15 is a rear elevation view of a second embodiment of building block container.
Figure 16:
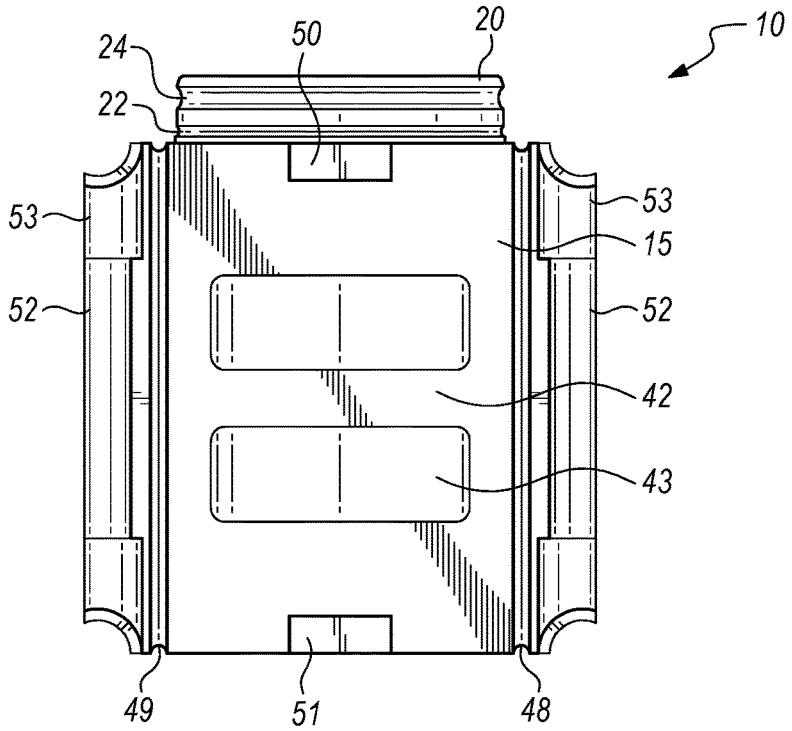
FIG. 16 is a left side elevation view of a second embodiment of building block container.
Figure 17:
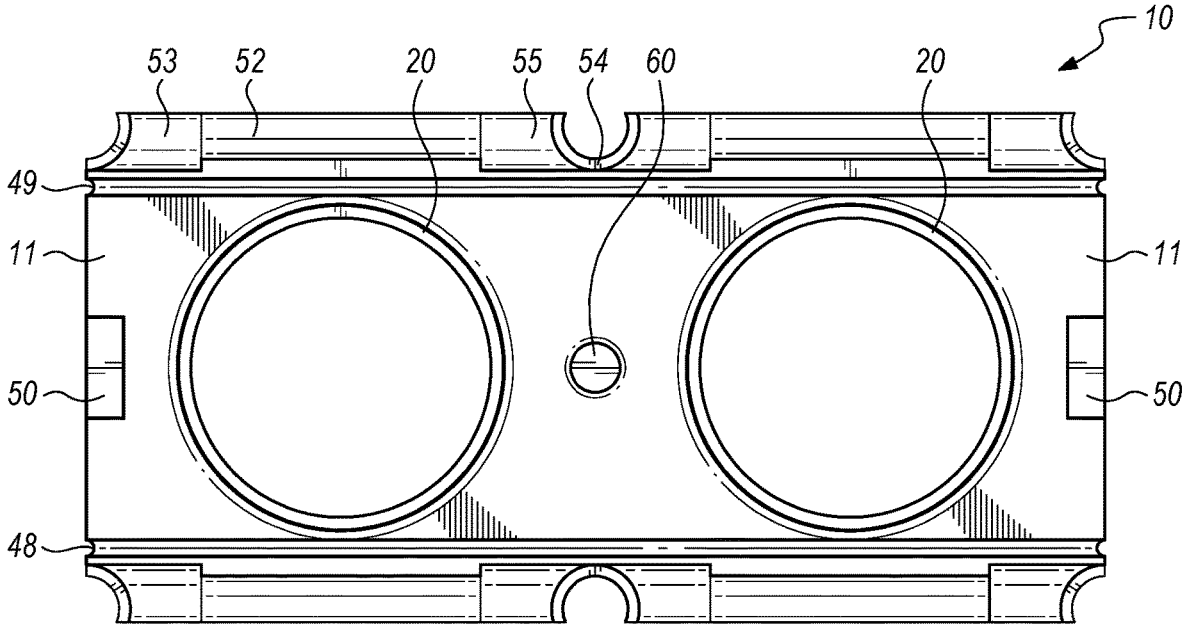
FIG. 17 is a top plan view of a second embodiment of building block container.
Figure 18:
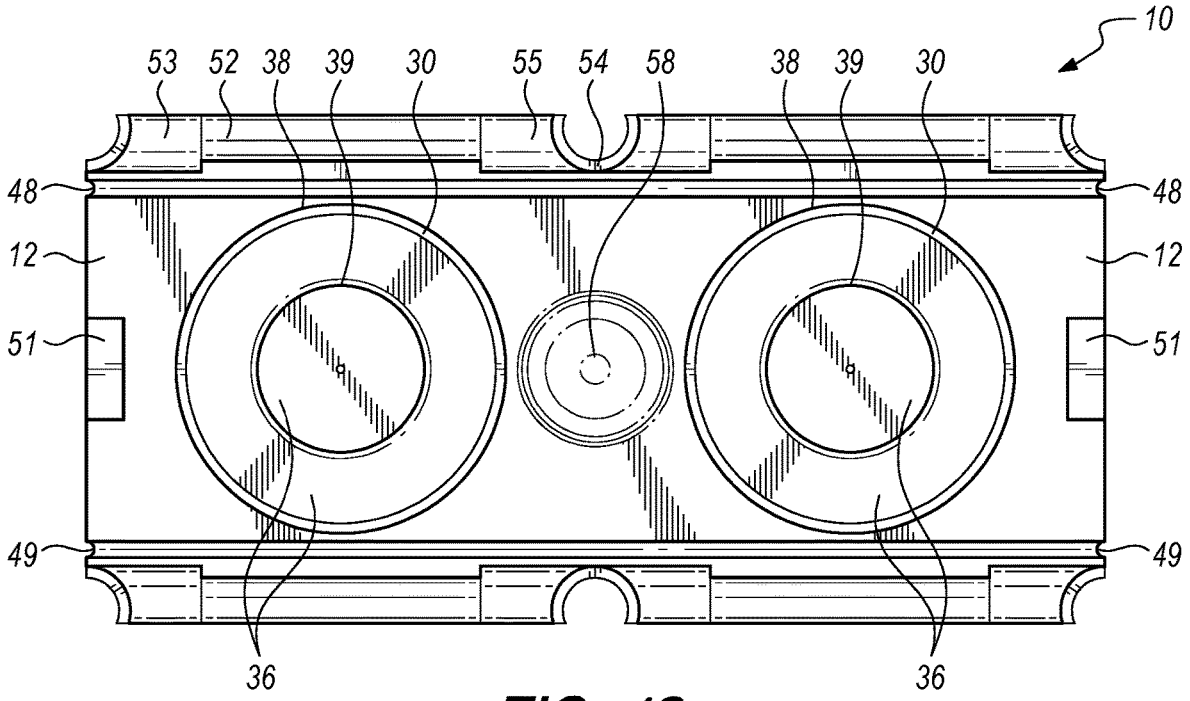
FIG. 18 is a bottom plan view of a second embodiment of building block container.
Figure 19:
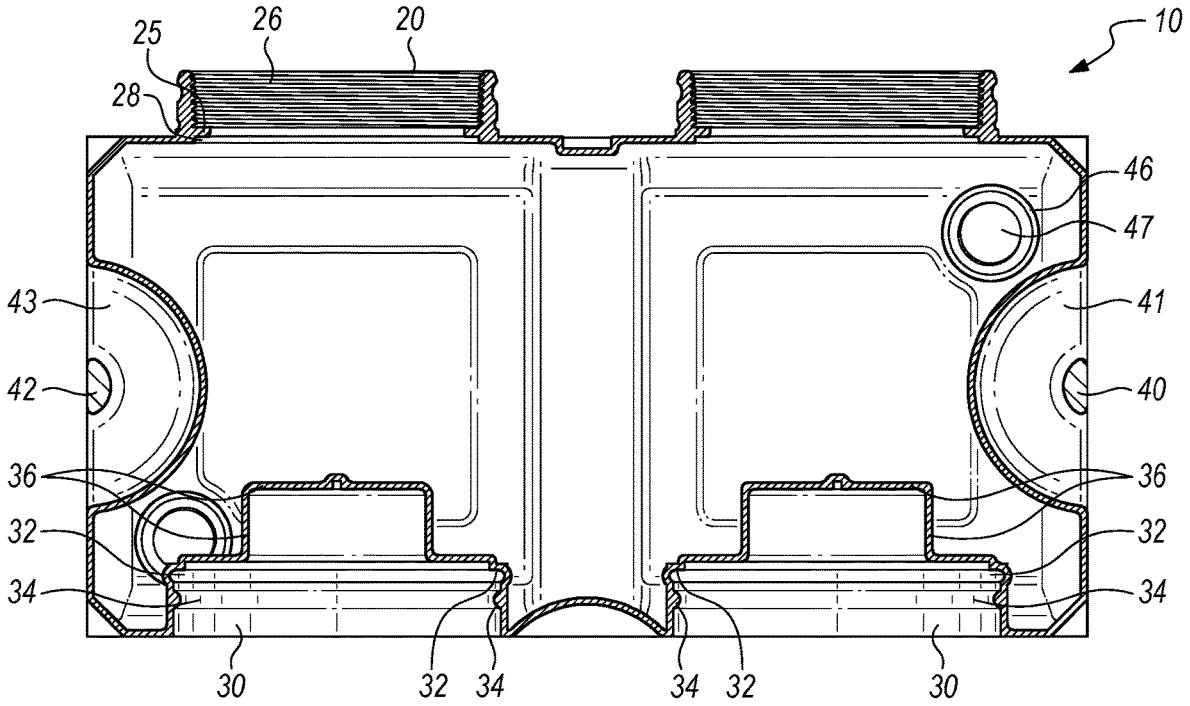
FIG. 19 is a cross sectional view taken from section 19-19 of FIG. 11.
Figure 20:
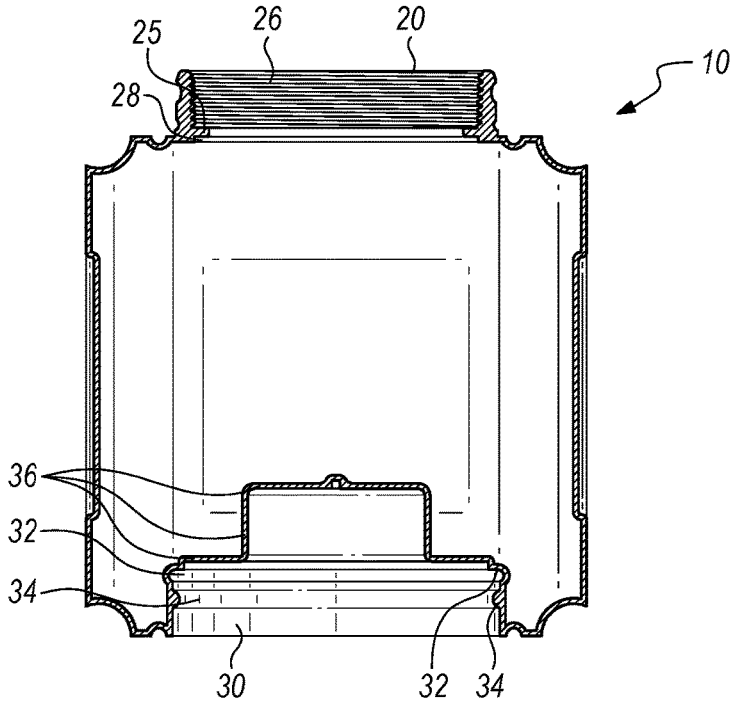
FIG. 20 is a cross sectional view taken from section 20-20 of FIG. 11.
Figure 21:
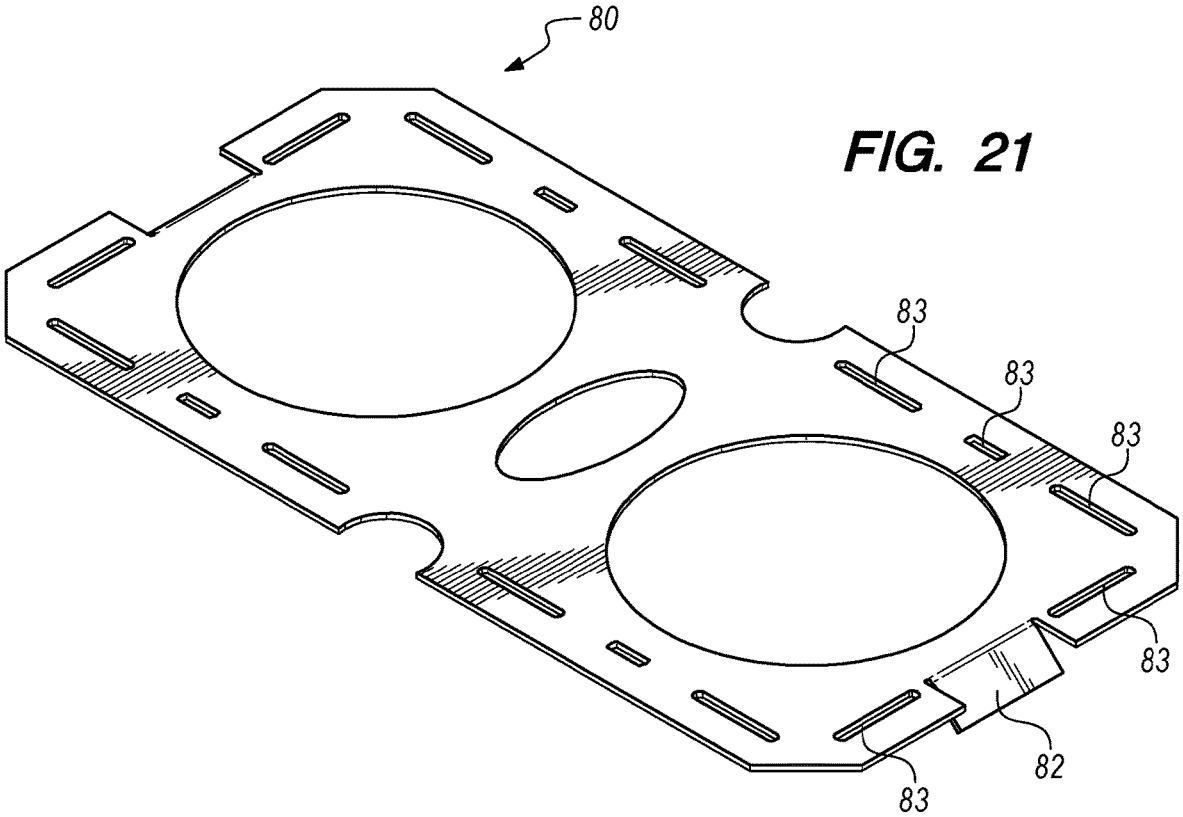
FIG. 21 is a perspective view of hanger bracket.
Figure 22:
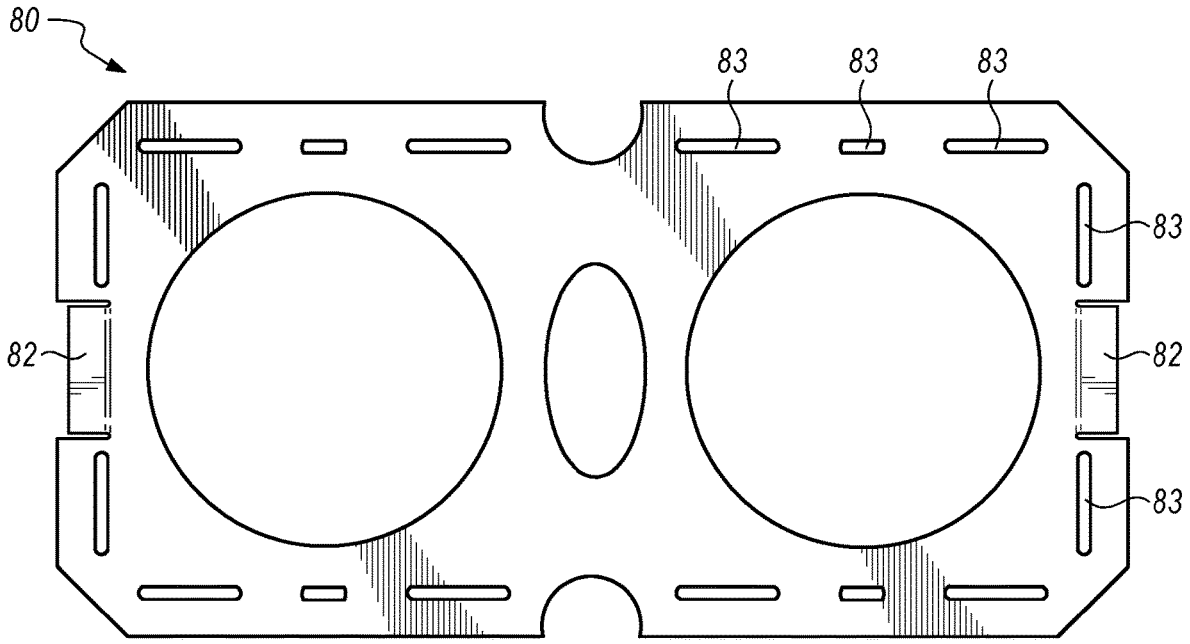
FIG. 22 is a top plan view of hanger bracket, the bottom plan view being a mirror image thereof.
Figure 23:
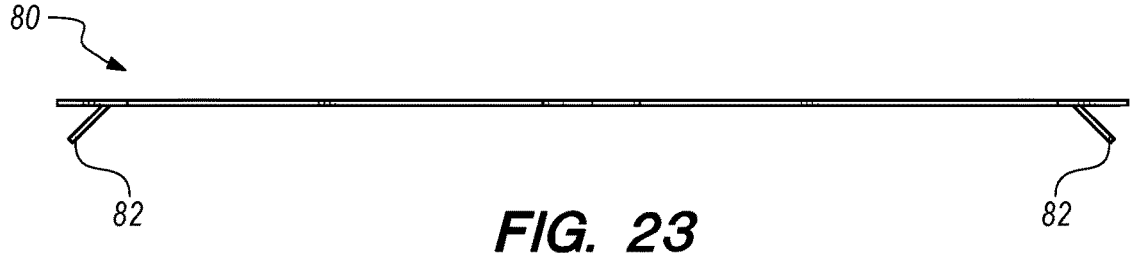
FIG. 23 is a front elevation view of hanger bracket, the rear elevation view being a mirror image thereof.
Figure 24:
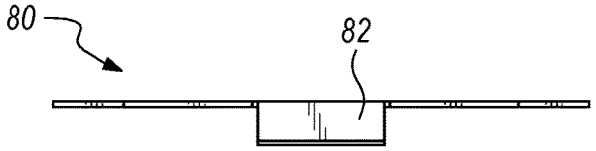
FIG. 24 is a right side elevation view of hanger bracket, the left side elevation view being a mirror image thereof.
Figure 25:
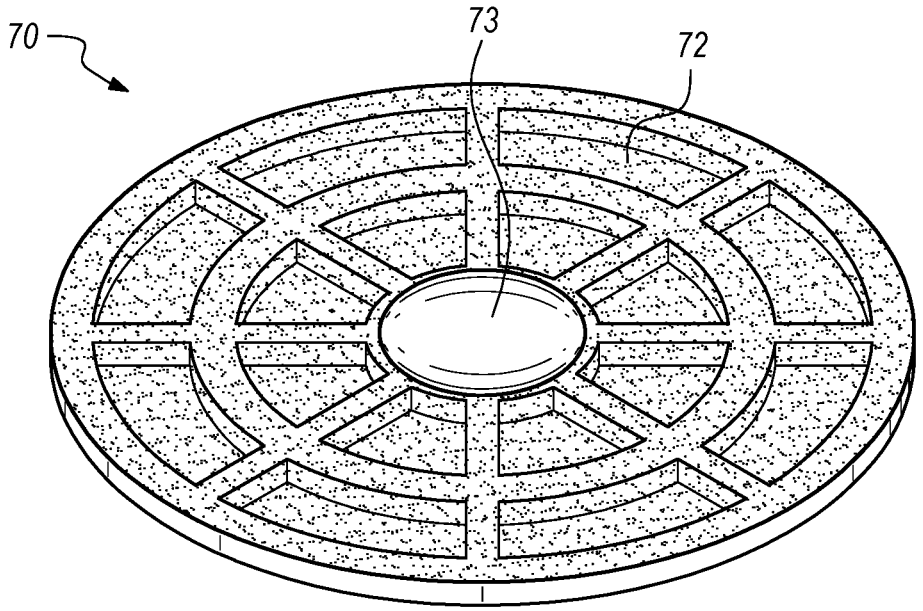
FIG. 25 is a top perspective view of filter disc.
Figure 26:
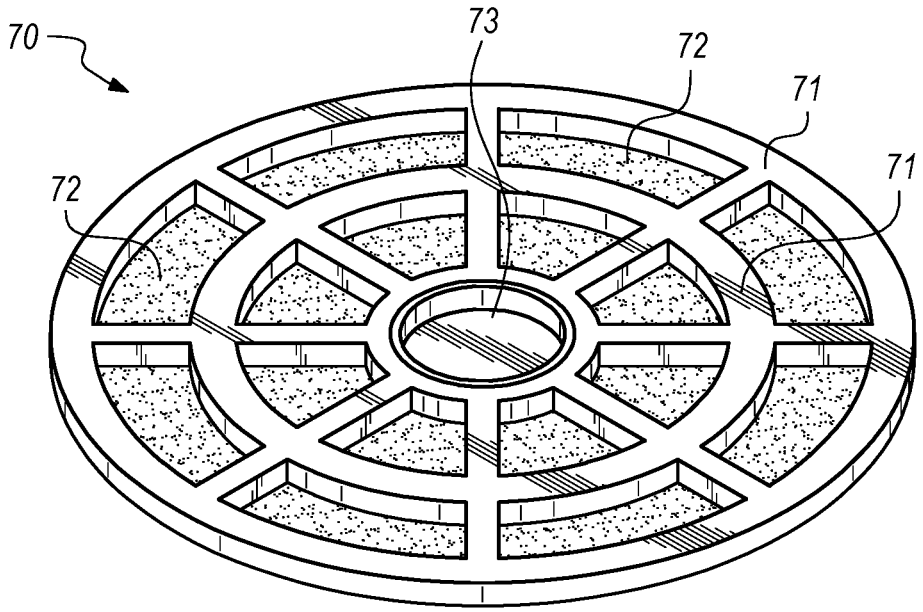
FIG. 26 is a bottom perspective view of filter disc.
Figure 27:
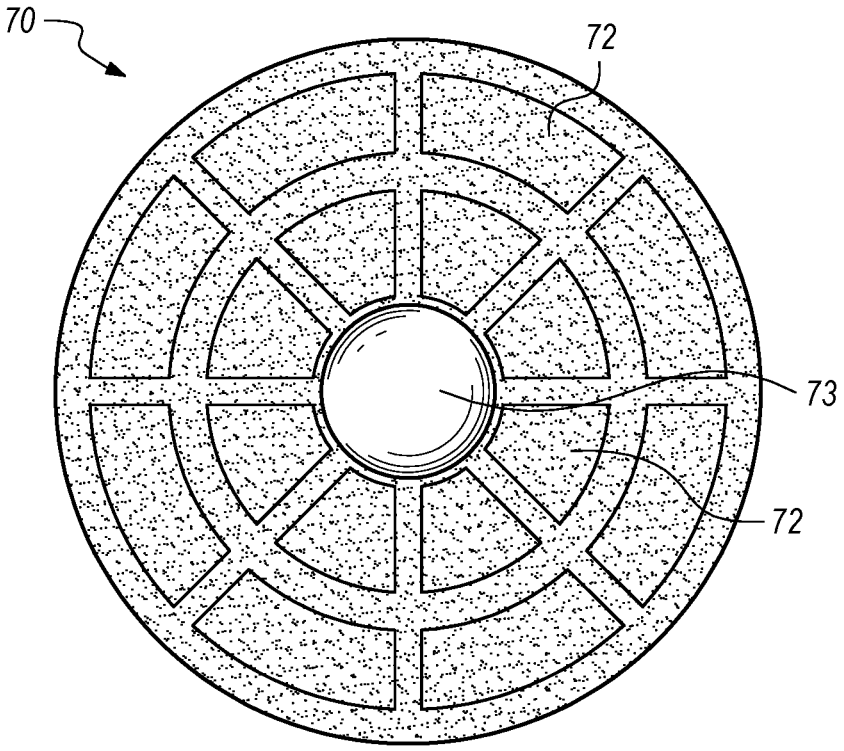
FIG. 27 is a top plan view of filter disc.
Figure 28:
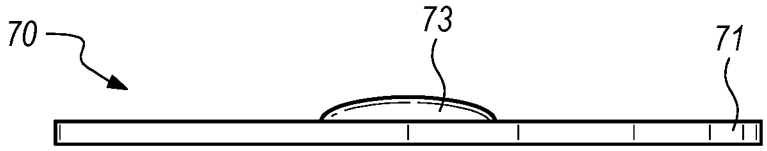
FIG. 28 is a front elevation view of filter disc, the rear elevation view being a mirror image thereof, the right side elevation view being a mirror image thereof, and the left side elevation view being a mirror image thereof.
Figure 29:
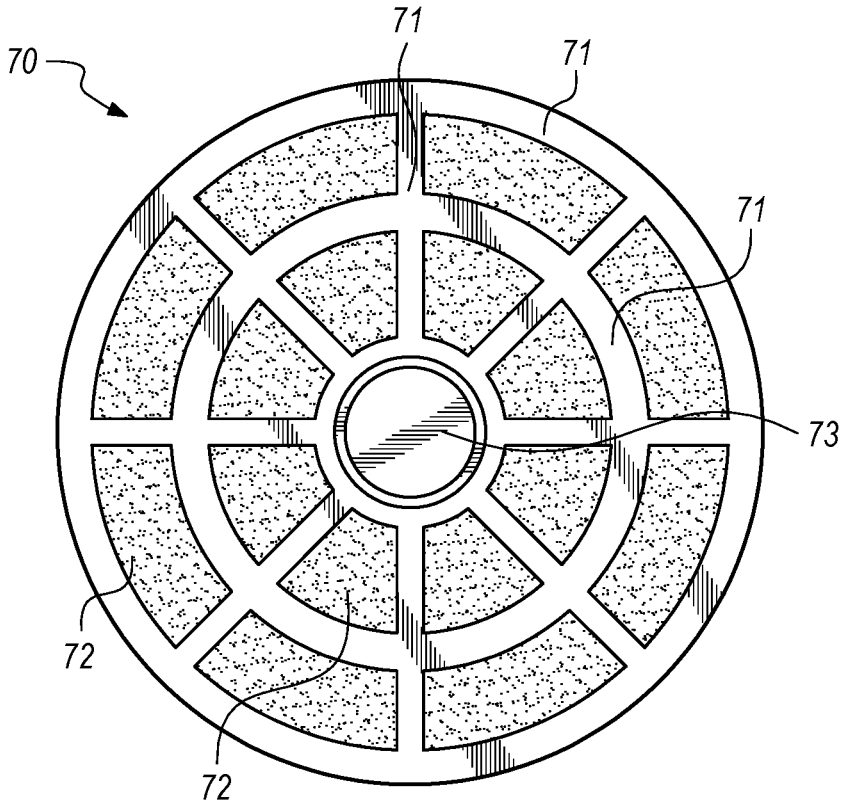
FIG. 29 is a bottom plan view of filter disc.
Figure 30:
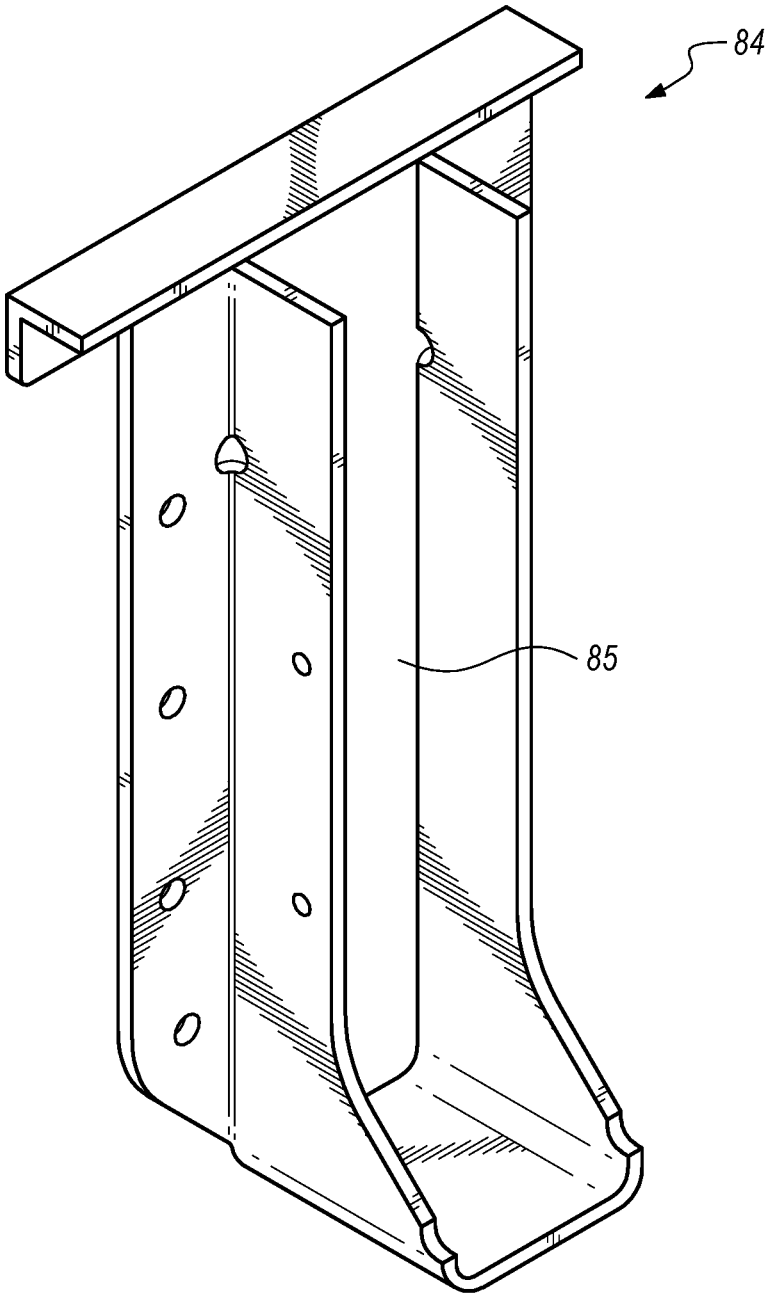
FIG. 30 is a front perspective view of rafter hanger.
Figure 31:
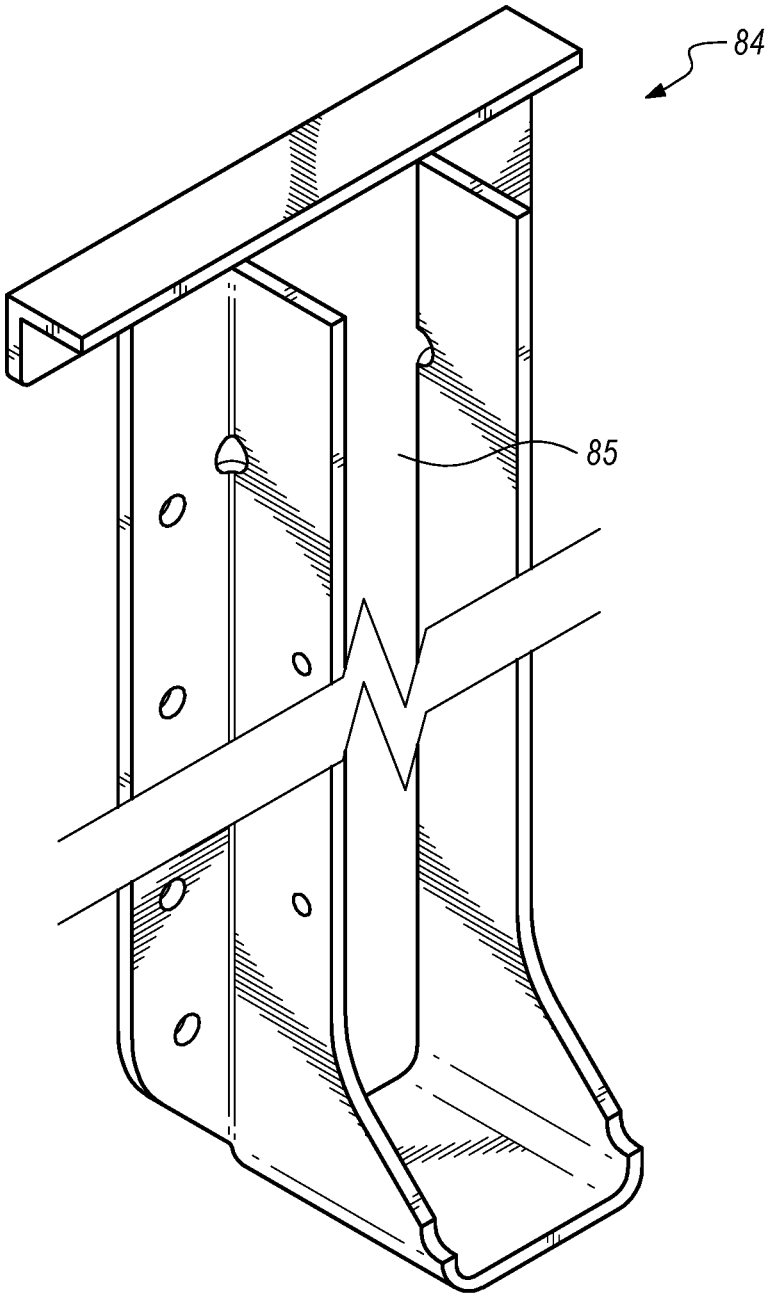
FIG. 31 is another front perspective view of rafter hanger.
Figure 32:
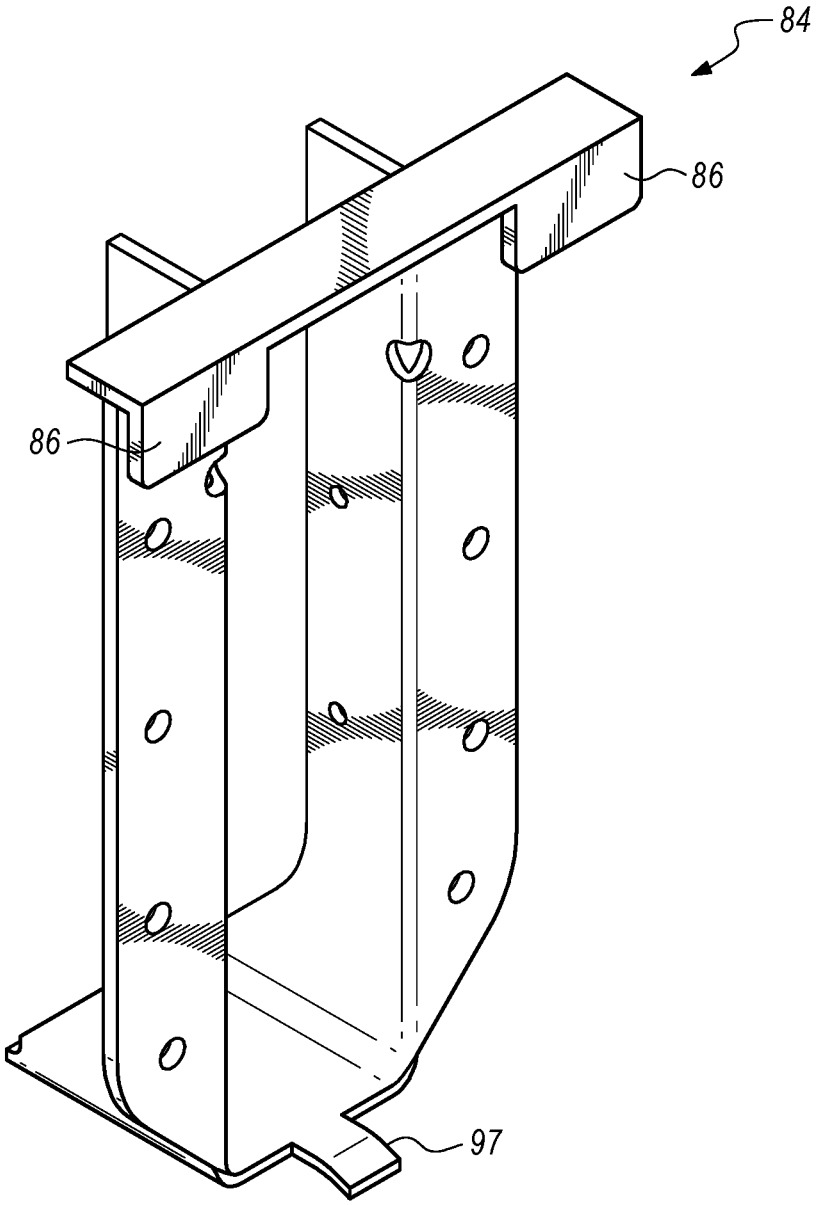
FIG. 32 is a rear perspective view of rafter hanger.
Figure 33:
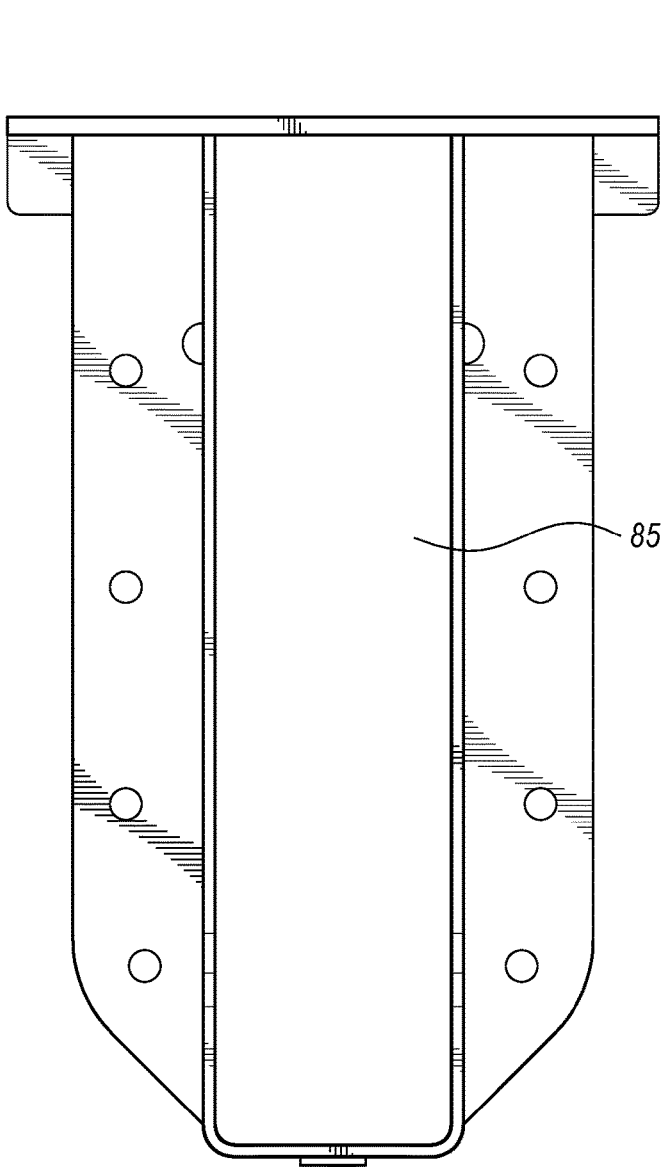
FIG. 33 is a front elevation view of rafter hanger.
Figure 34:
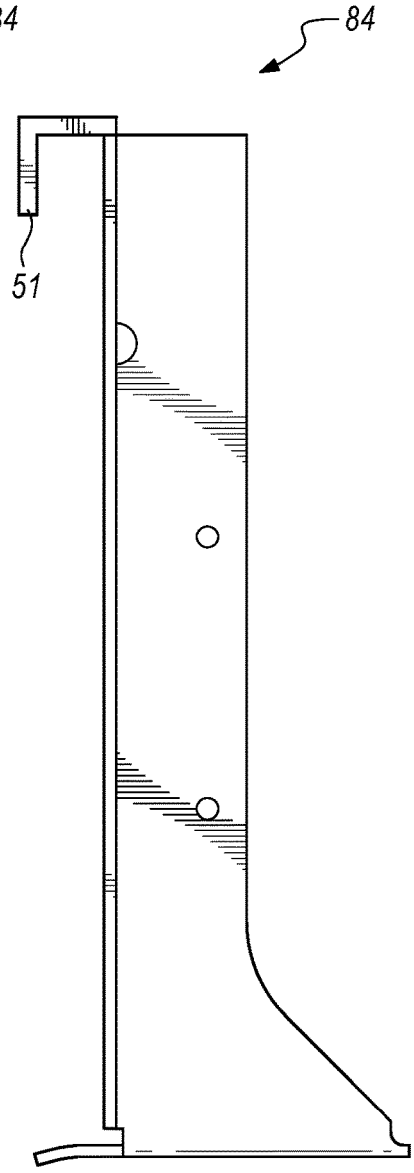
FIG. 34 is a right side elevation view of rafter hanger, the left side elevation view being a mirror image thereof.
Figure 35:
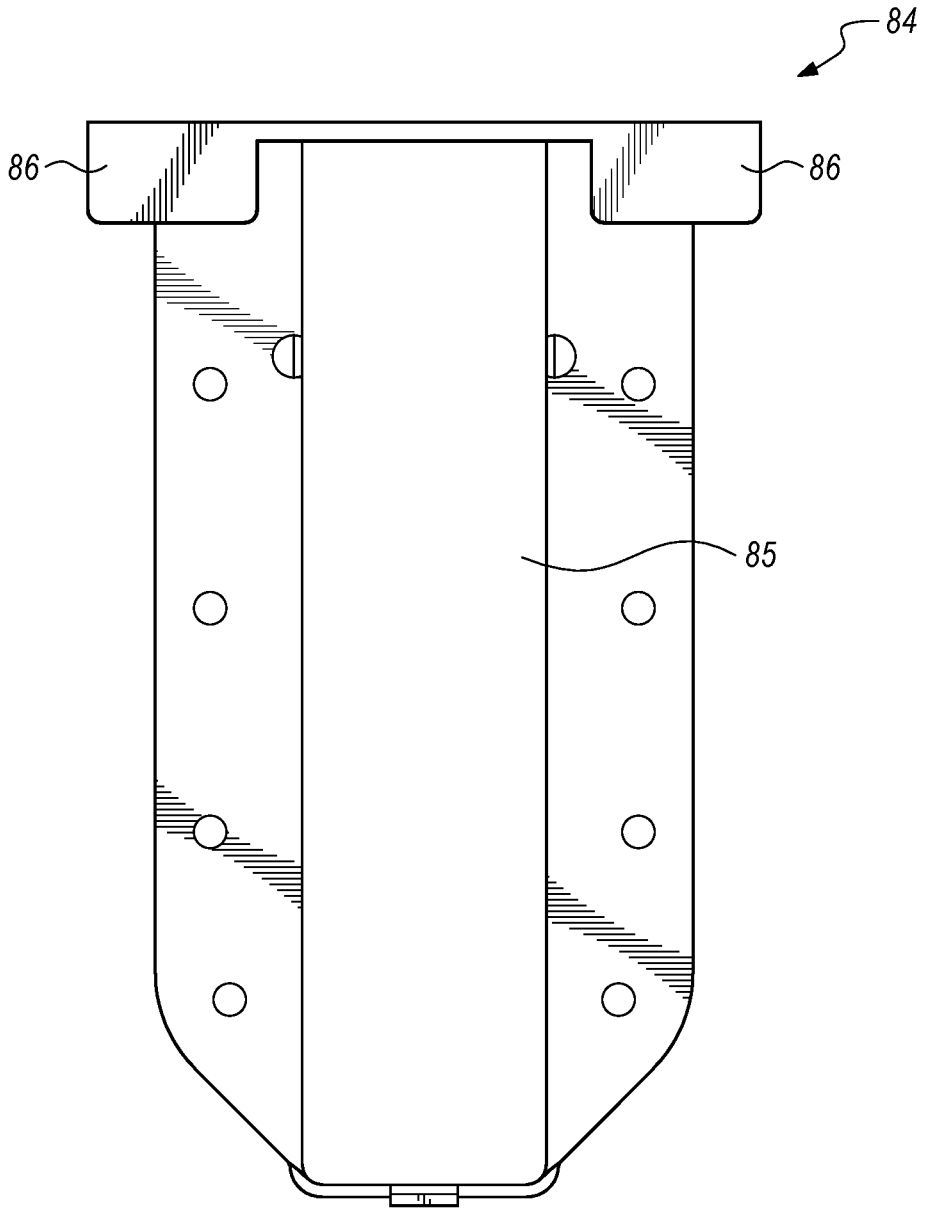
FIG. 35 is a rear elevation view of rafter hanger.
Figure 36:
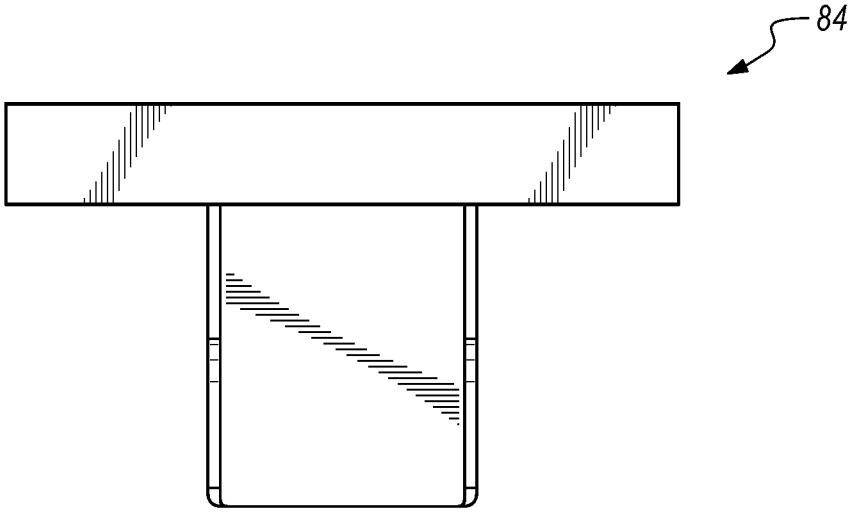
FIG. 36 is a top plan view of rafter hanger.
Figure 37:
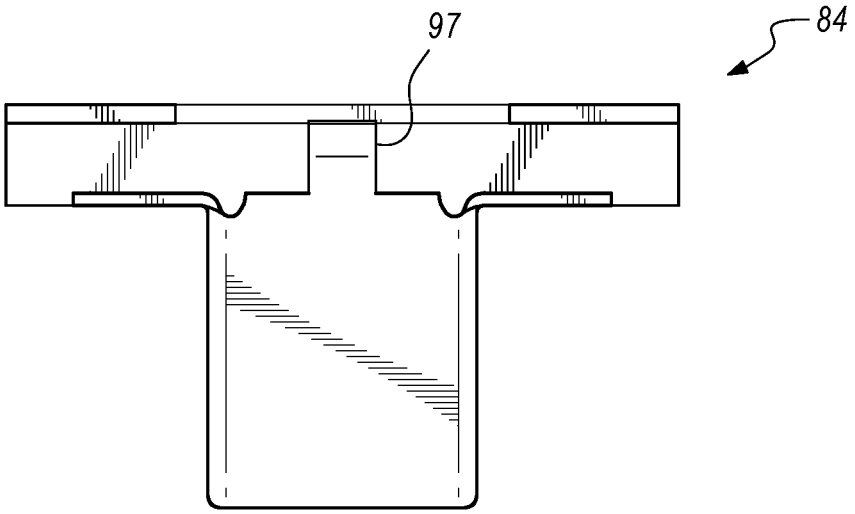
FIG. 37 is a bottom plan view of rafter hanger.
Figure 38:
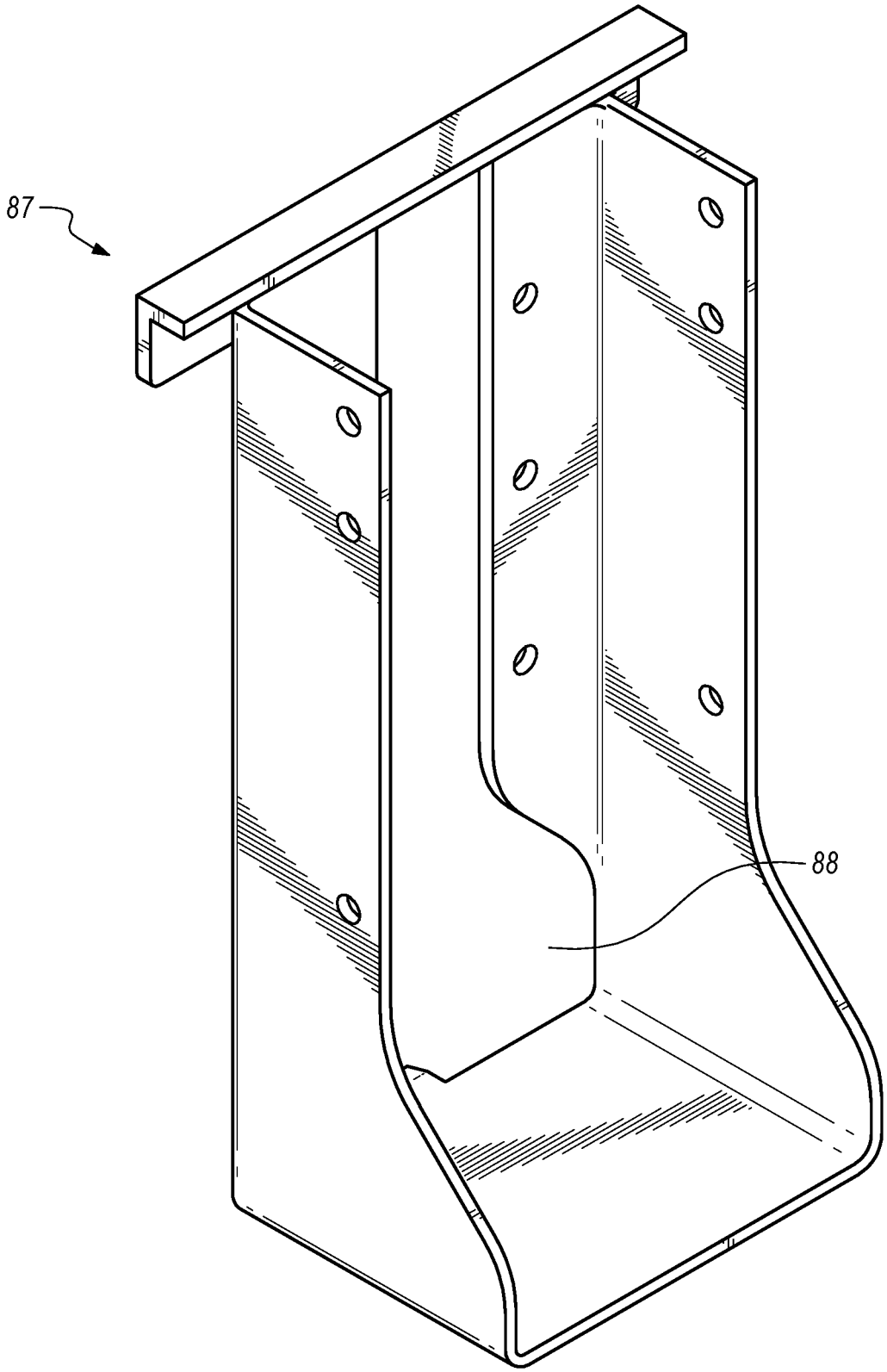
FIG. 38 is a front perspective view of large rafter hanger.
Figure 39:
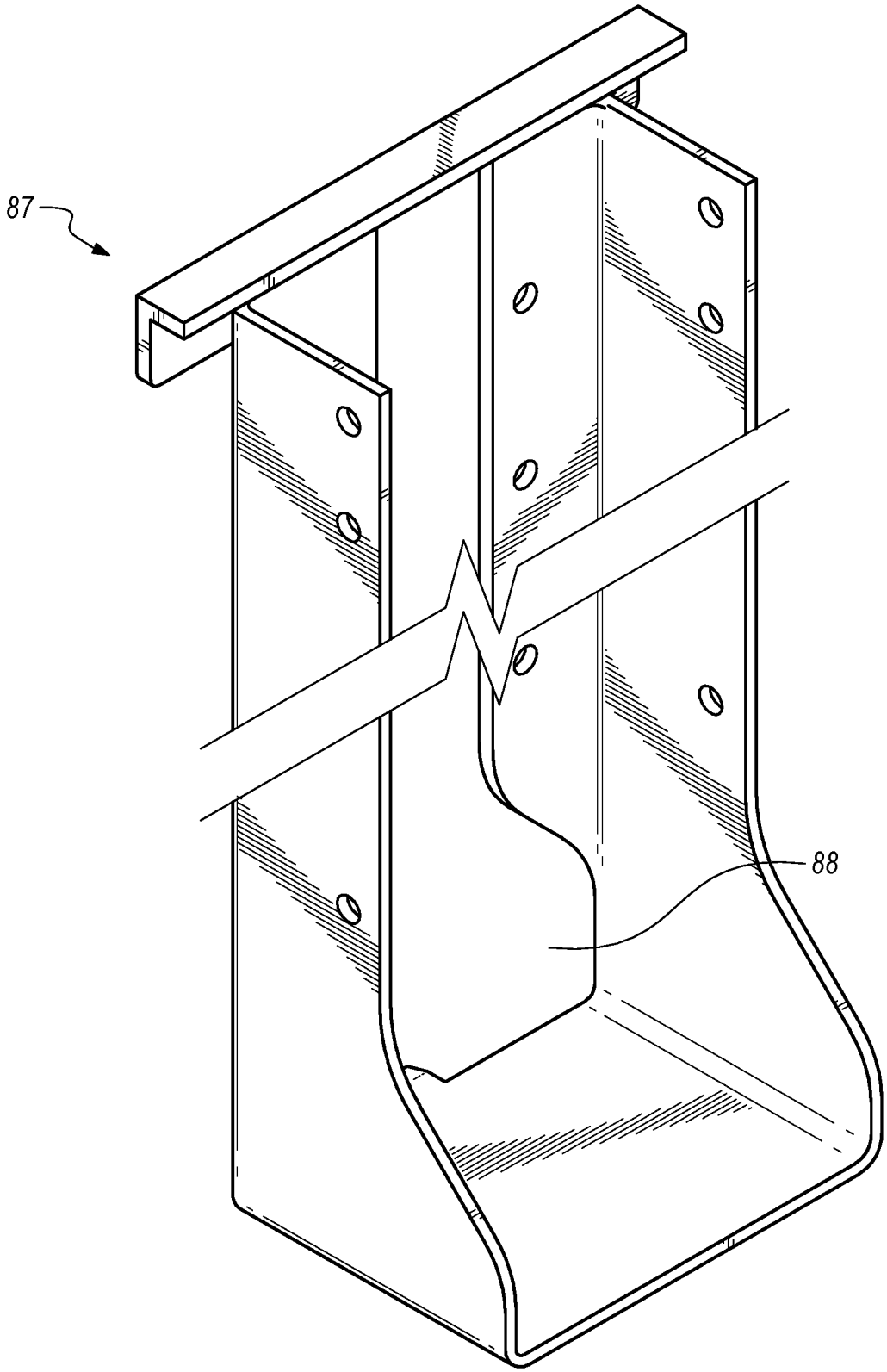
FIG. 39 is another front perspective view of large rafter hanger.
Figure 40:
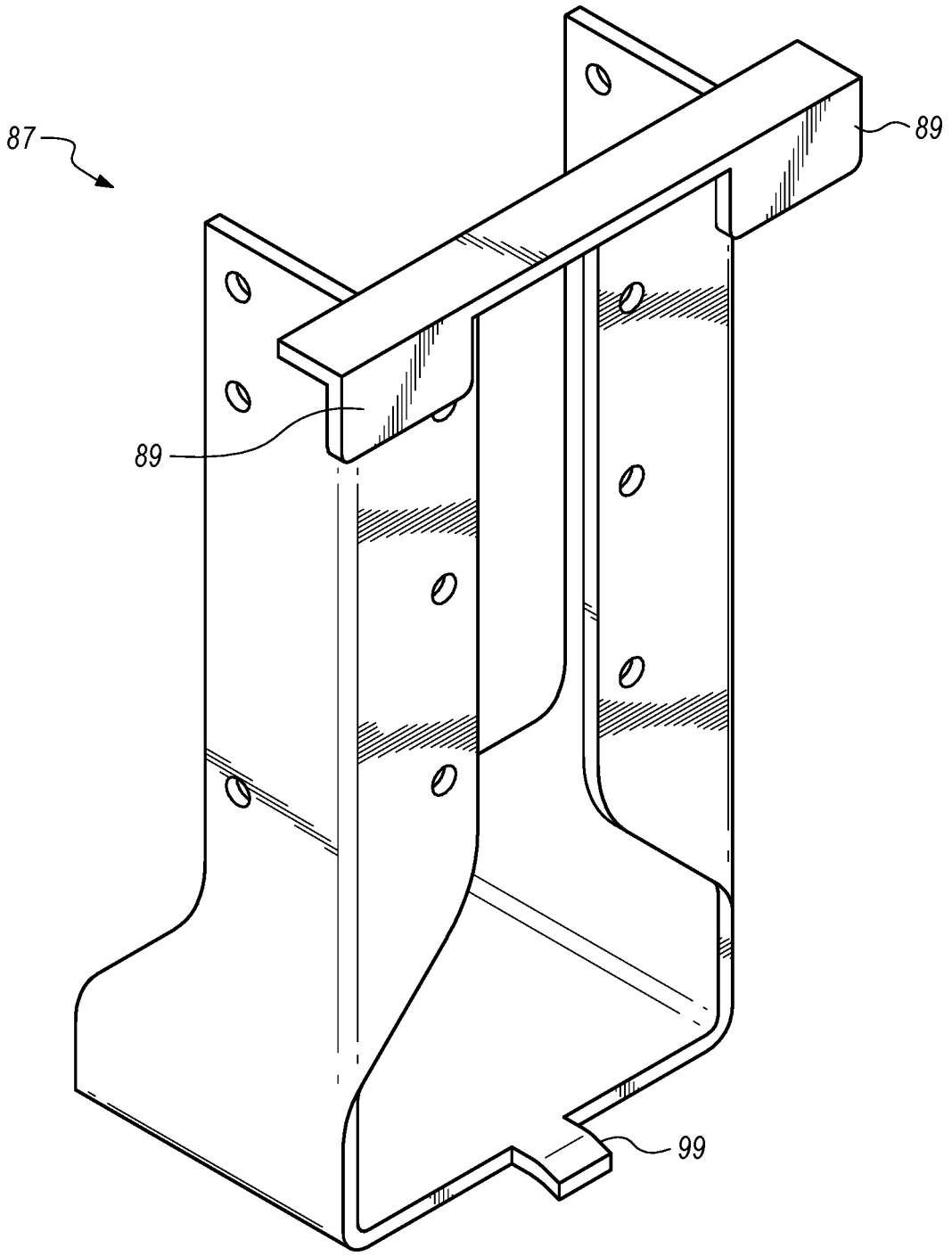
FIG. 40 is a rear perspective view of large rafter hanger.
Figure 41:
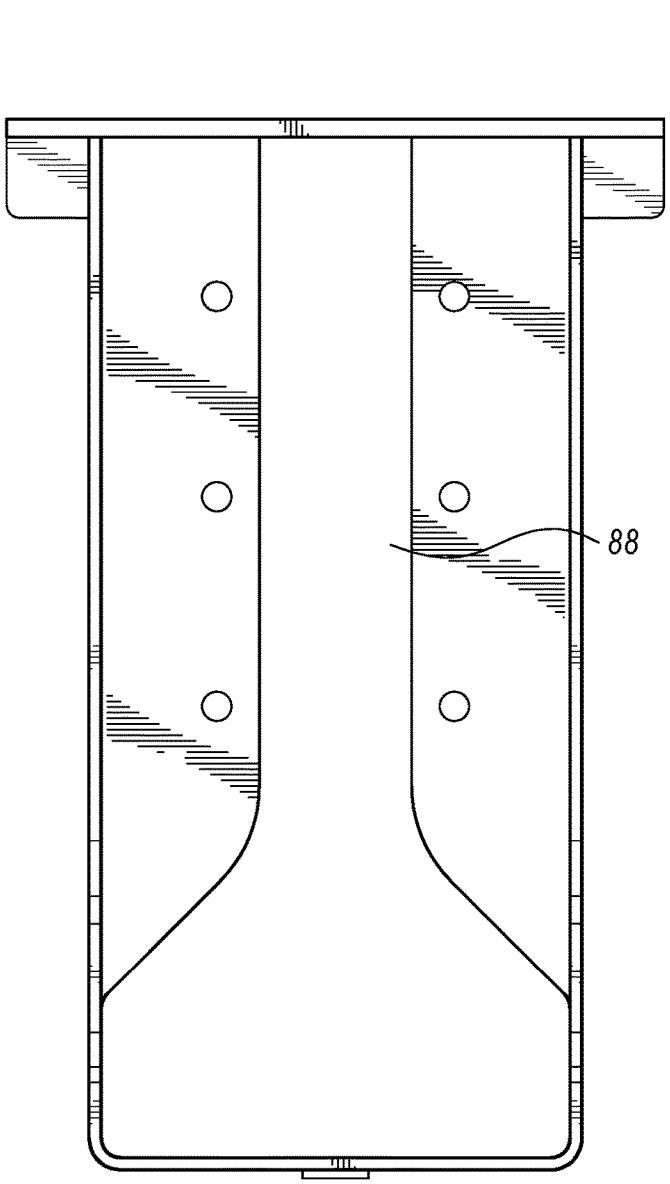
FIG. 41 is a front elevation view of large rafter hanger.
Figure 42:
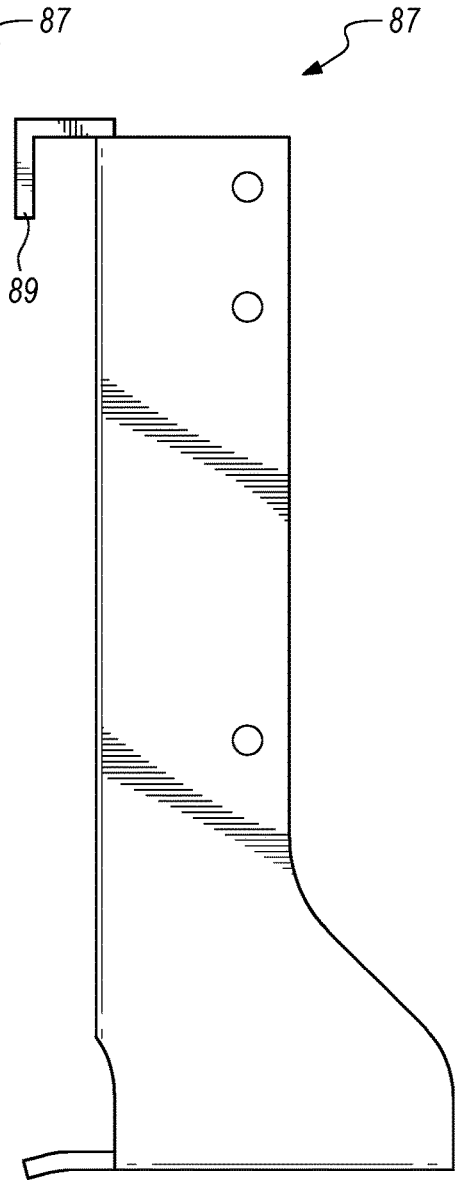
FIG. 42 is a right side elevation view of large rafter hanger, the left side elevation view being a mirror image thereof.
Figure 43:
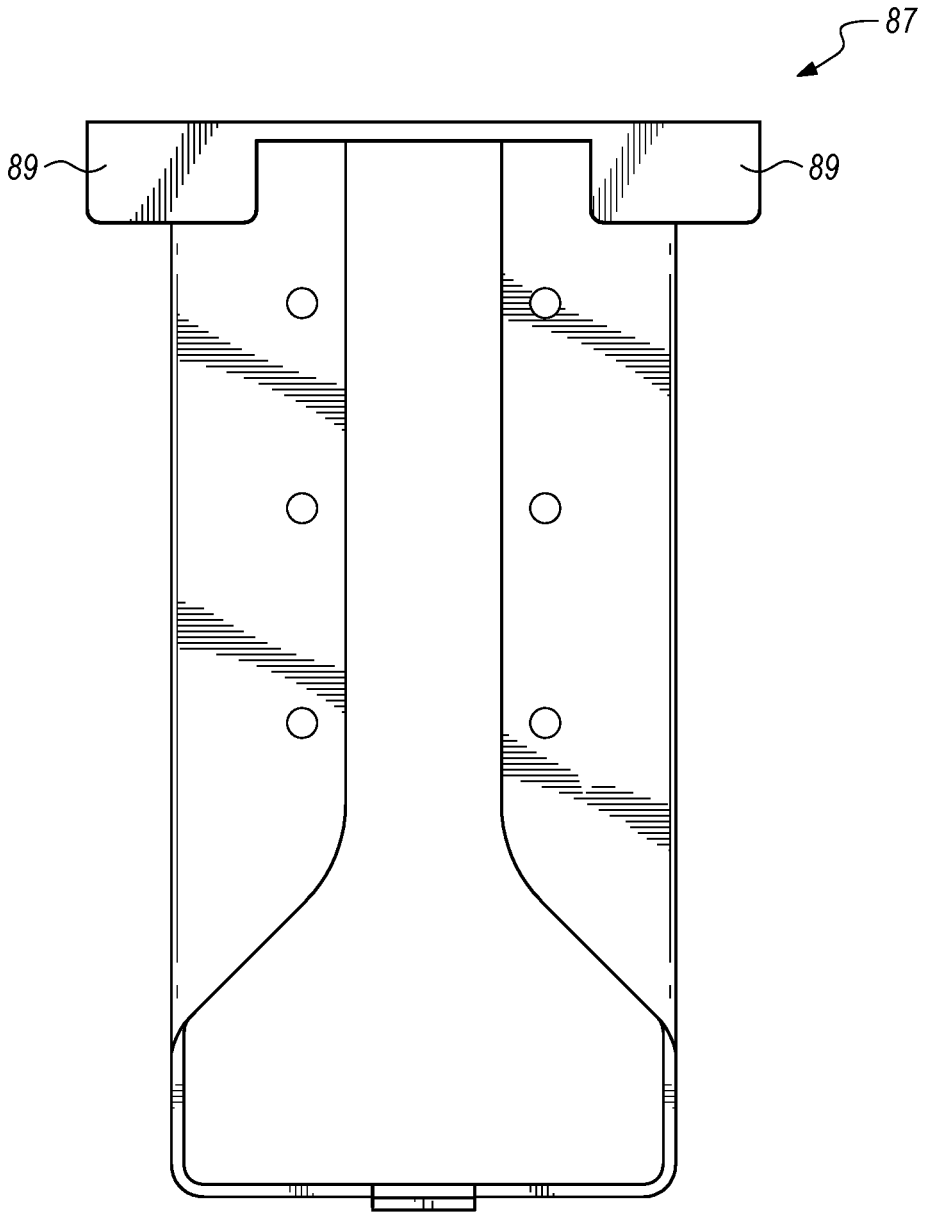
FIG. 43 is a rear elevation view of large rafter hanger.
Figure 44:
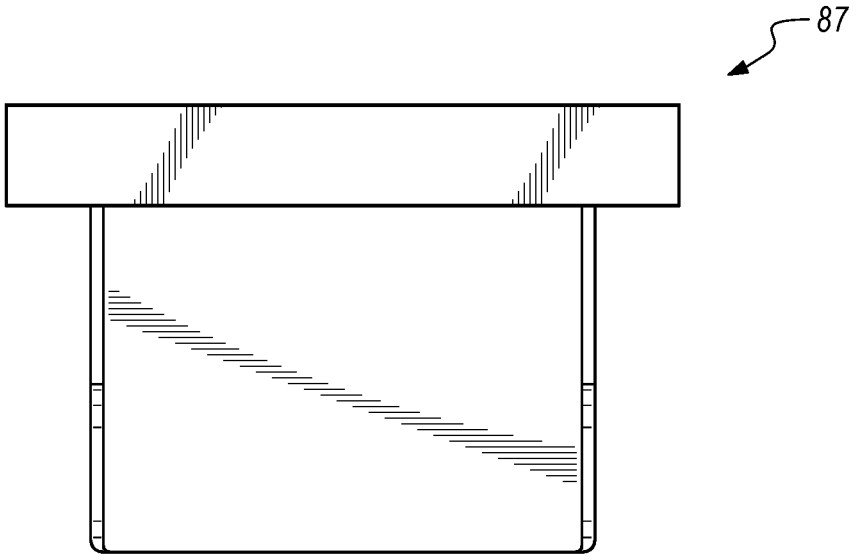
FIG. 44 is a top plan view of large rafter hanger.
Figure 45:
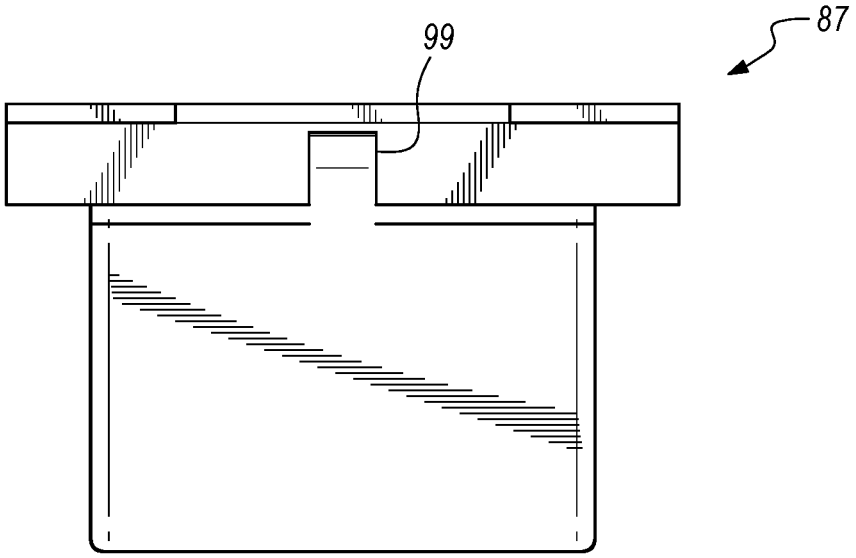
FIG. 45 is a bottom plan view of large rafter hanger.
Figure 46:
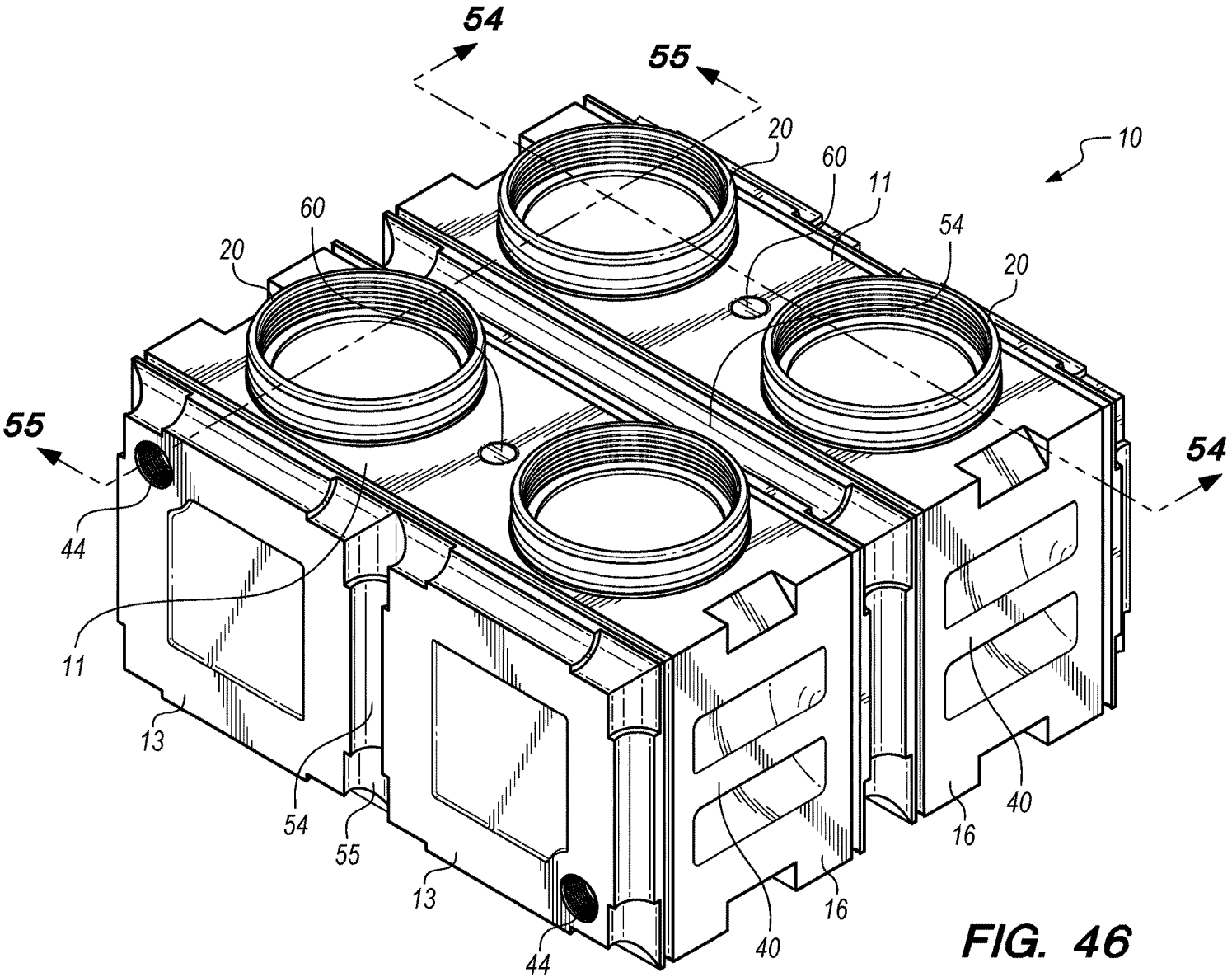
FIG. 46 is a top perspective view of a third embodiment of building block container.
Figure 47:
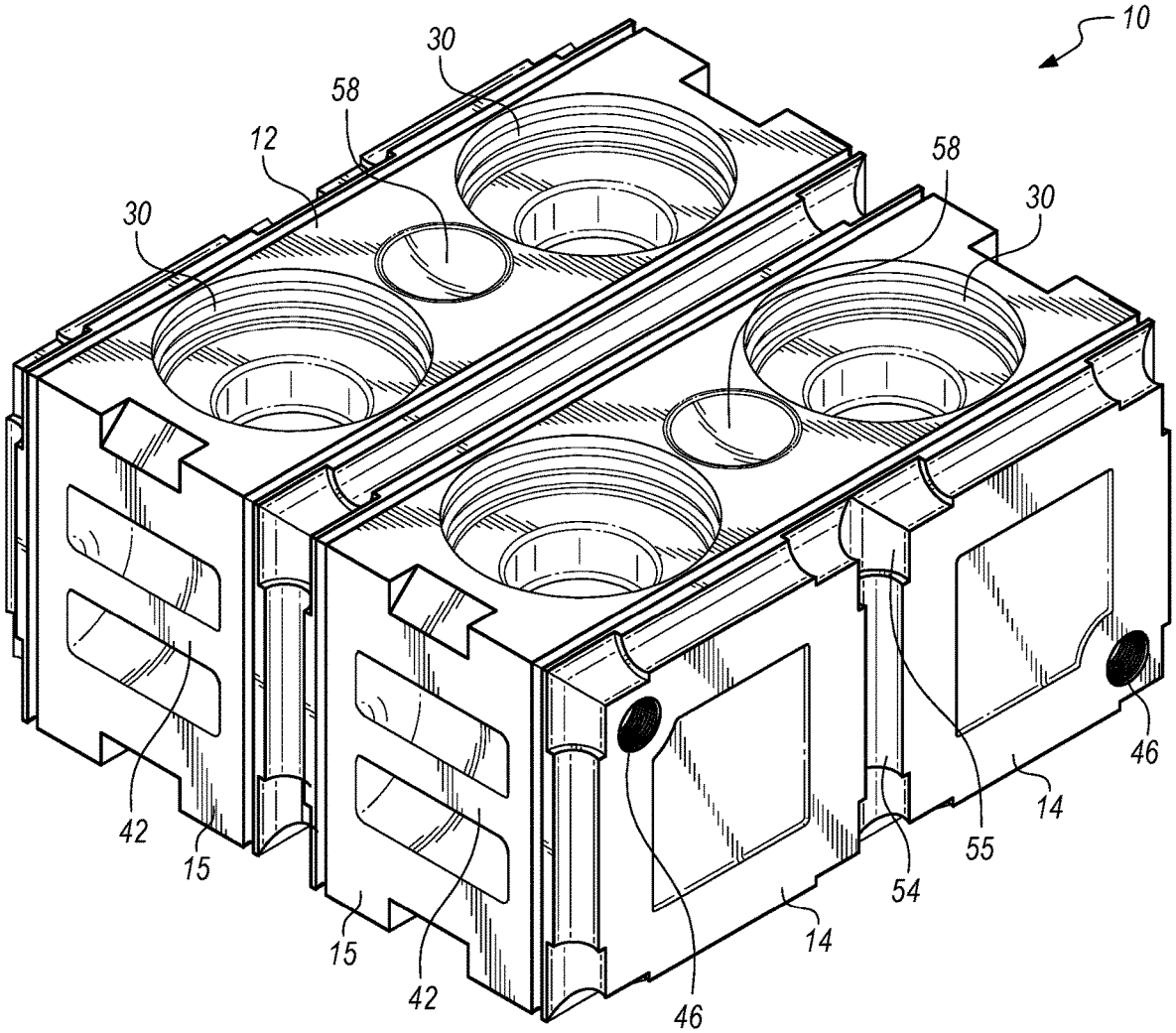
FIG. 47 is a bottom perspective view of a third embodiment of building block container.
Figure 48:
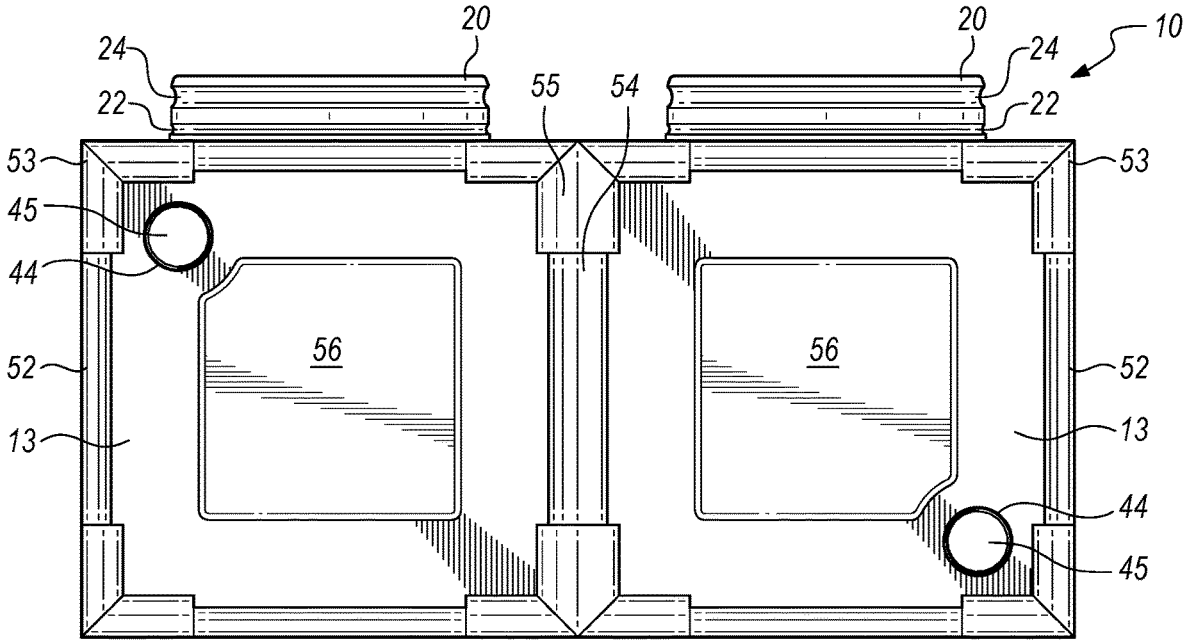
FIG. 48 is a front elevation view of a third embodiment of building block container.
Figure 49:
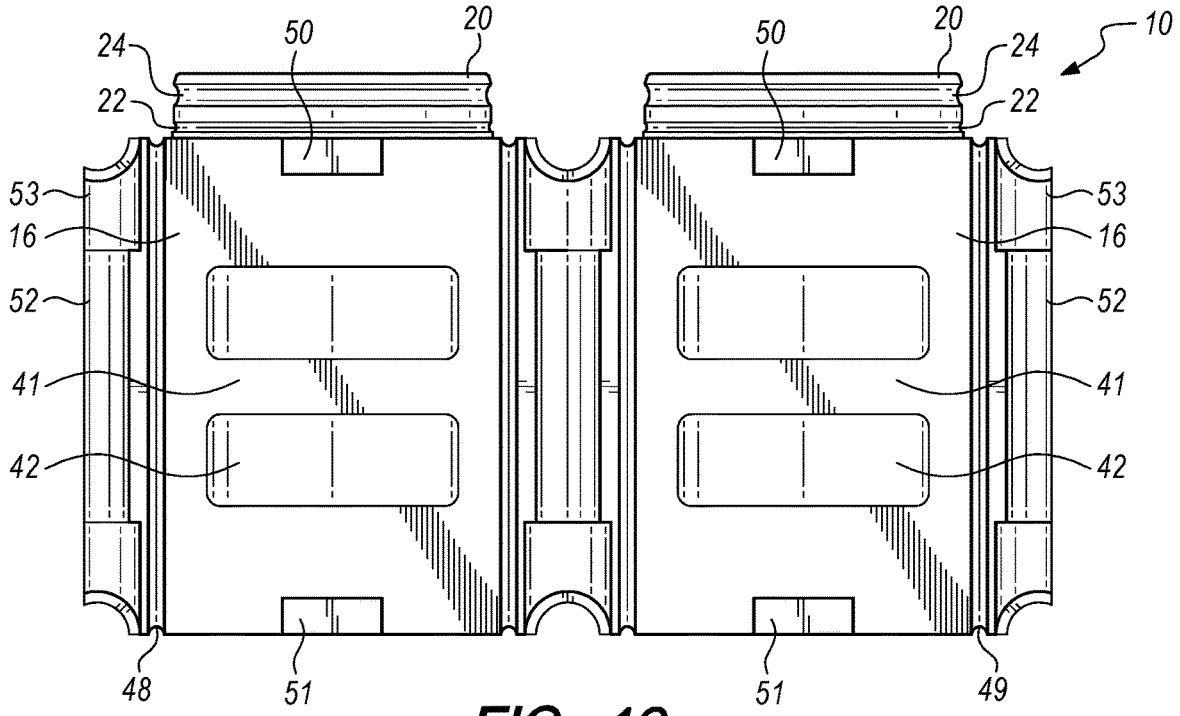
FIG. 49 is a right side elevation view of a third embodiment of building block container.
Figure 50:
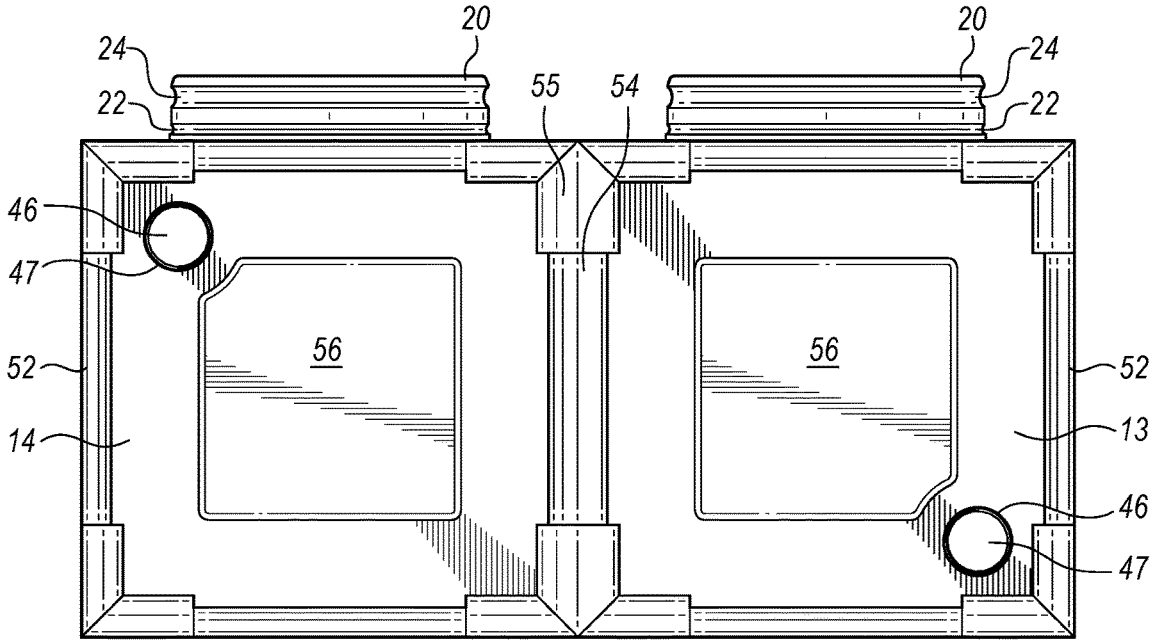
FIG. 50 is a rear elevation view of a third embodiment of building block container.
Figure 51:
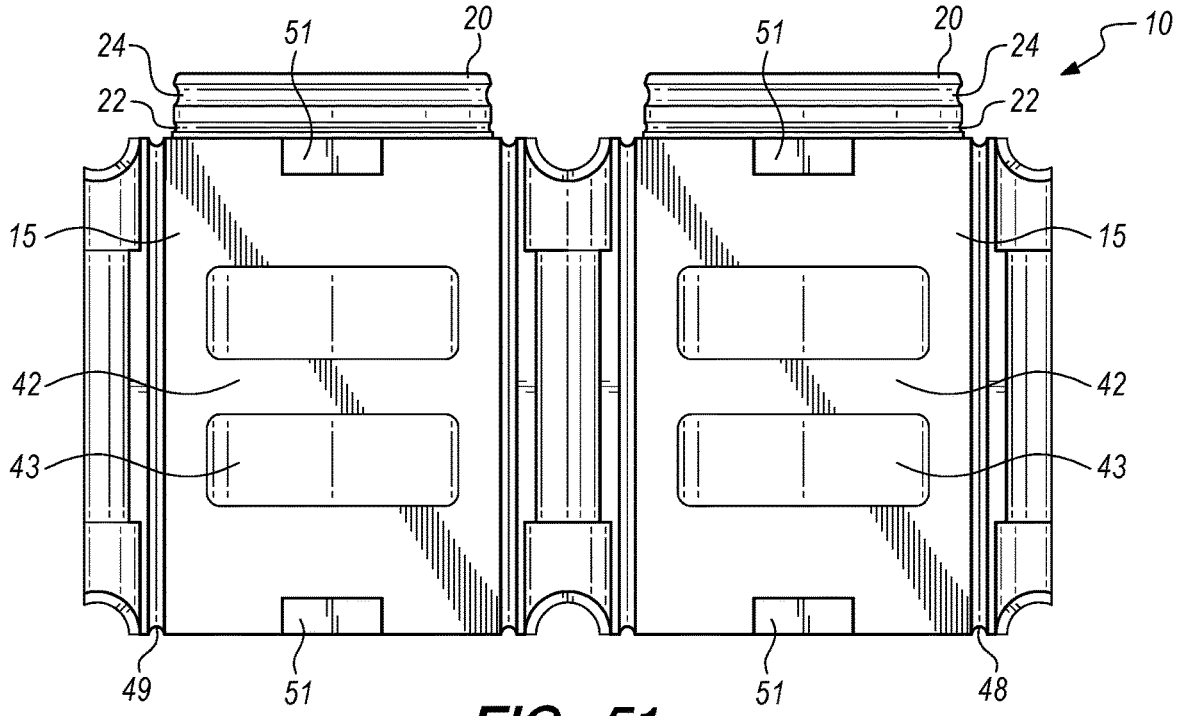
FIG. 51 is a left side elevation view of a third embodiment of building block container.
Figure 52:
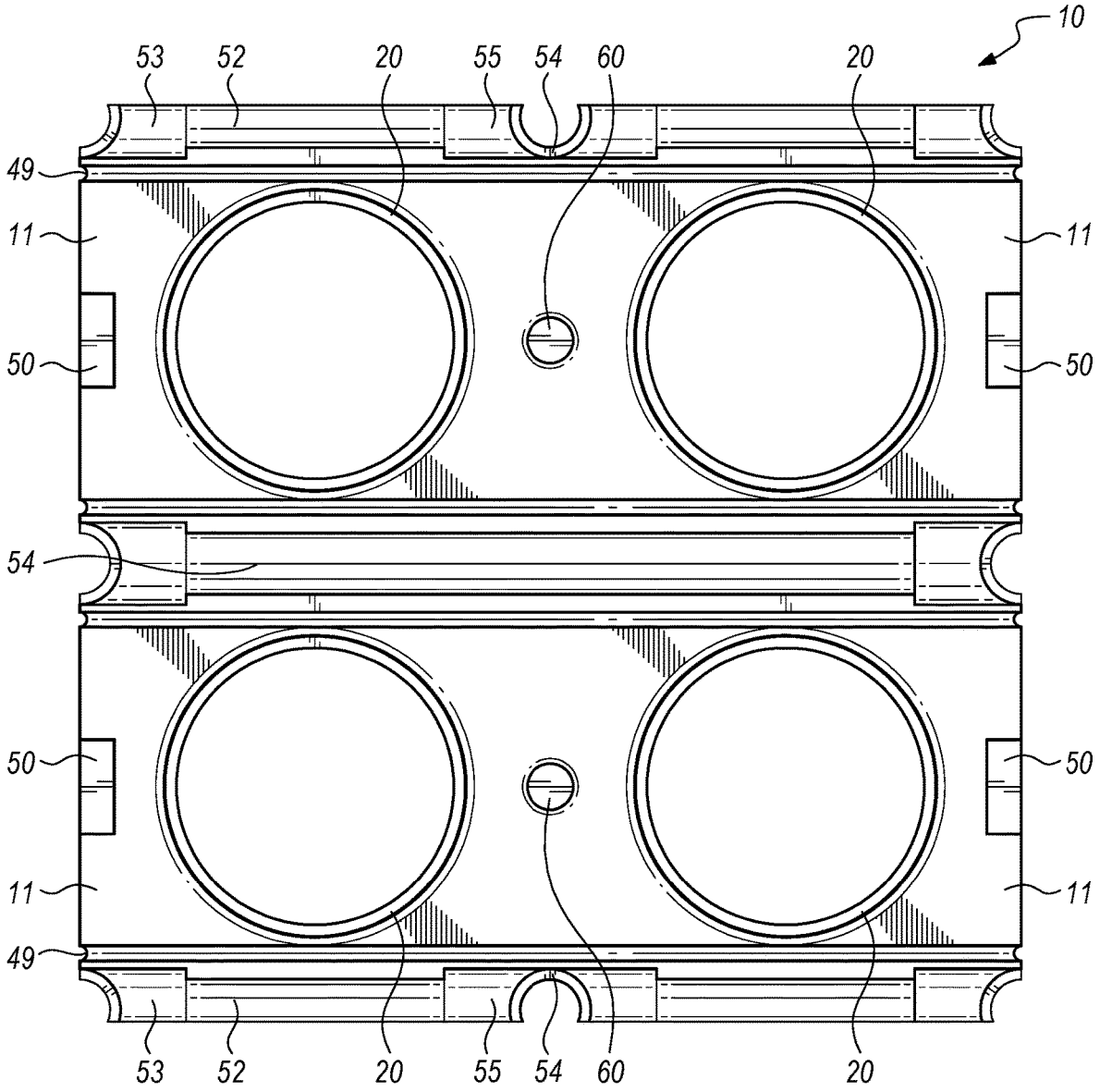
FIG. 52 is a top plan view of a third embodiment of building block container.
Figure 53:
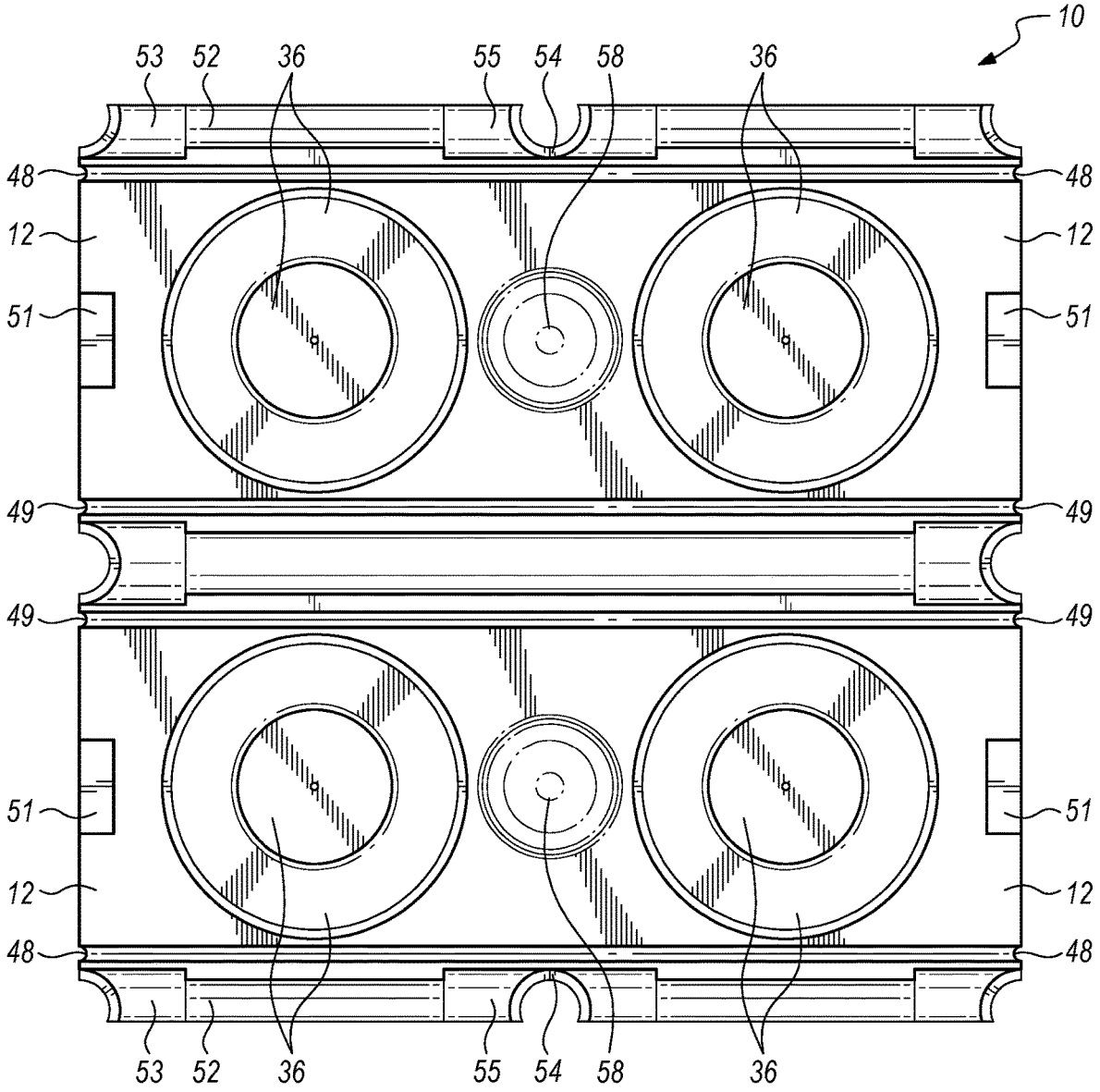
FIG. 53 is a bottom plan view of a third embodiment of building block container.
Figure 54:
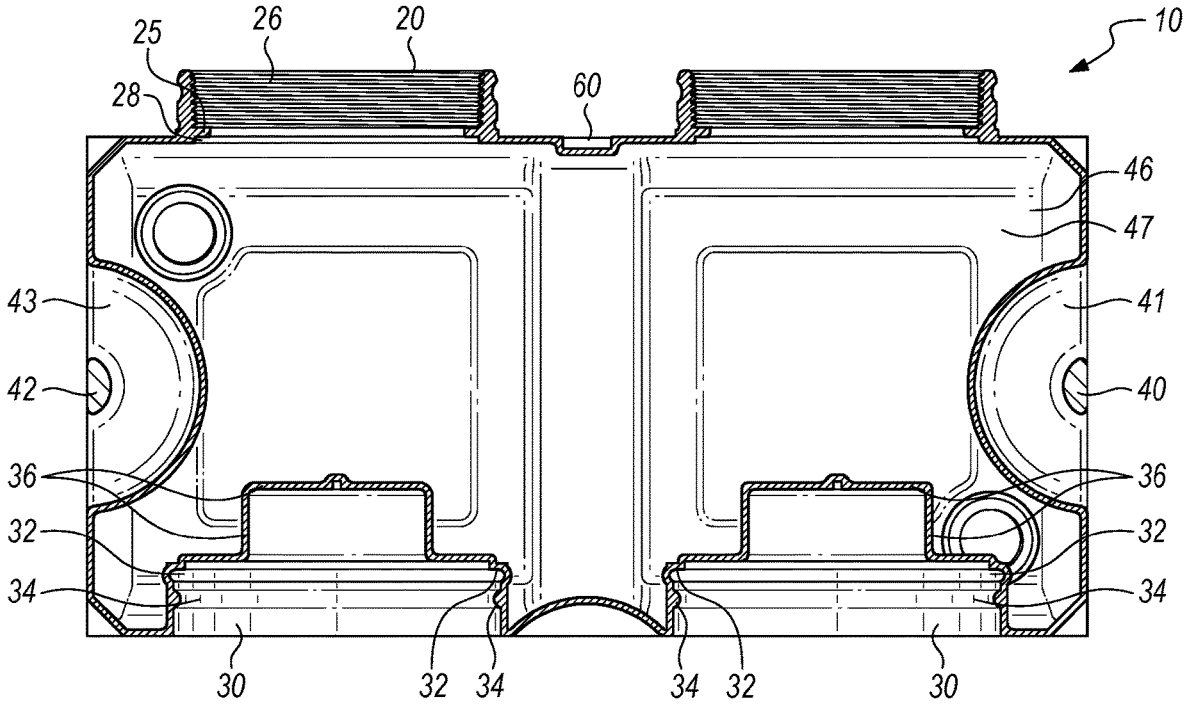
FIG. 54 is a cross sectional view taken from section 54-54 of FIG. 46.
Figure 55:
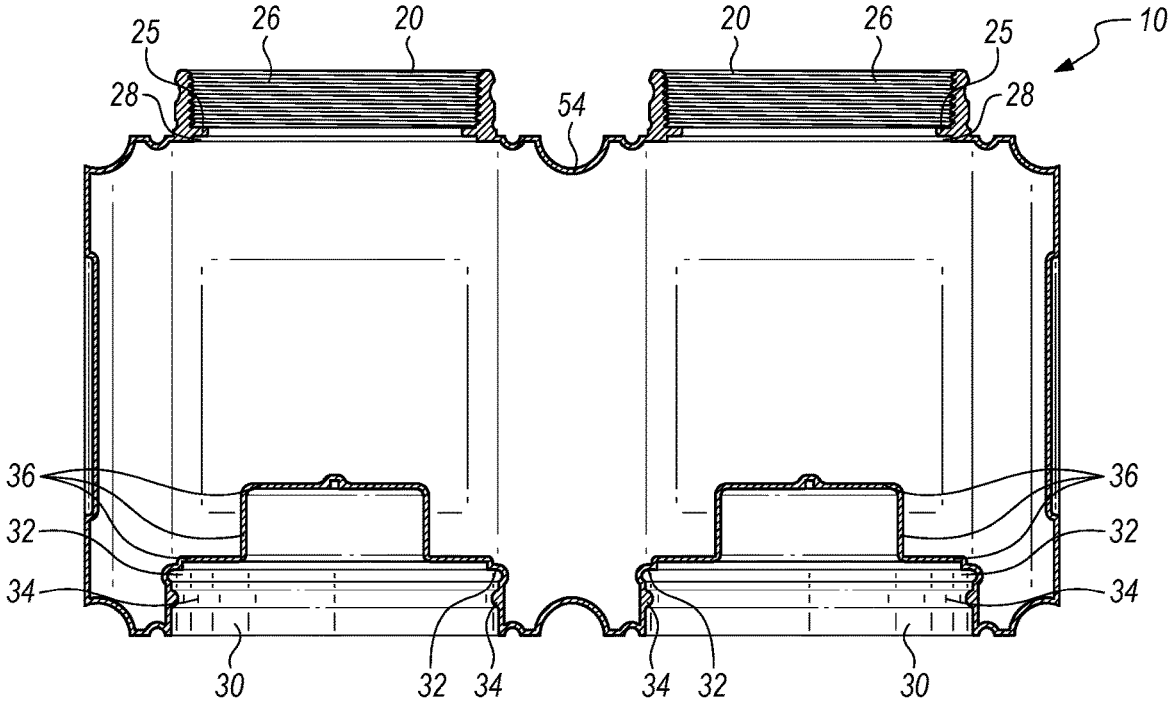
FIG. 55 is a cross sectional view taken from section 55-55 of FIG. 46.

| Term | Definition |
|---|---|
| 10 | Building Block Container |
| 11 | Upper Surface of Building Block Container |
| 12 | Lower Surface Building Block Container |
| 13 | Front Surface Building Block Container |
| 14 | Rear Surface of Building Block Container |
| 15 | Left Surface Building Block Container |
| 16 | Right Surface Building Block Container |
| 20 | Male Cylindrical Protrusion |
| 22 | Male Cylindrical Protrusion O-Ring Groove |
| 24 | Locking Ridge Groove |
| 25 | Seal Lip |
| 26 | Female Thread on Male Cylindrical Protrusion |
| 28 | Filter Disc Seat |

-continued

| DEFINITION LIST | |
|---|---|
| Term | Definition |
| 30 | Female Cylindrical Cavity |
| 32 | Female Cylindrical Cavity O-Ring Groove |
| 34 | Locking Ridge |
| 36 | Female Cylindrical Cavity Knockout Section |
| 38 | Large Diameter Female Cylindrical Cavity Score Line |
| 39 | Small Diameter Female Cylindrical Cavity Score Line |
| 40 | Right Handle |
| 41 | Right Handle Well |
| 42 | Left Handle |
| 43 | Left Handle Well |
| 44 | Front Threaded Port |
| 45 | Front Threaded Port Knockout Section |
| 46 | Rear Threaded Port |
| 47 | Rear Threaded Port Knockout Section |
| 48 | Front Perimeter O-Ring Groove |
| 49 | Rear Perimeter O-Ring Groove |
| 50 | Upper Hanger Bracket Retaining Slot |
| 51 | Lower Hanger Bracket Retaining Slot |
| 52 | Straight Conduit Quarter Round |
| 53 | L-Shaped Conduit Quarter Round |
| 54 | Straight Conduit Half Round |
| 55 | T-Shaped Conduit Half Round |
| 56 | Square or Rectangular Label Recess |
| 58 | Head Carrying Dimple |
| 60 | RFID Chip |
| 70 | Filter Disc |
| 71 | Filter Disc Frame |
| 72 | At Least One Layer of Filter Media |
| 73 | Filter Center |
| 74 | Male Cylindrical Protrusion O-Ring |
| 75 | Female Cylindrical Cavity O-Ring |
| 76 | Threaded Plug |
| 78 | Threaded Tap or Faucet |
| 80 | Hanger Bracket |
| 82 | Hanger Bracket Tab |
| 83 | Hanger Bracket Slot |
| 84 | Rafter Hanger |
| 85 | Rafter Hanger Vertical Slot |
| 86 | Rafter Hanger Vertical Tine |
| 87 | Large Rafter Hanger |
| 88 | Large Rafter Hanger Vertical Slot |
| 89 | Large Rafter Hanger Vertical Tine |
| 90 | Block Tie |
| 92 | Block Tie Strap |
| 94 | Block Tie Toggle |
| 96 | Block Tie Ratchet Stop |
| 97 | Rafter Hanger Foot Tab |
| 99 | Large Rafter Hanger Foot Tab |
| 100 | Pallet Floor |
| 102 | Pallet Floor Male Cylindrical Protrusion |
| 104 | Fork Lift Notch |
| 106 | Dowel Hole |
| 108 | Dowel |
| 110 | Rebar Toggle |
| 112 | Left Half |
| 114 | Right Half |
| 116 | Front Pin |
| 118 | Rear Pin |
| 119 | Rebar |
| 120 | Clean Water |
| 125 | Dirty Water |

DETAILED DESCRIPTION OF THE INVENTION

Building block container 10 is a building block. A plurality of building block containers 10 can be used to build or erect a temporary or permanent a wall, shelter, structure, or building. Building block container 10 functions similarly to a cinder block, brick, or other masonry block that is used to build or erect a wall, shelter, structure, or building. Building block container 10 may have a length of about 5 inches to 10 yards. Building block container 10 may have a width of about 5 inches to 10 yards. Building block container 10 may have a height of about 5 inches to 10 yards. Building block containers 10 are stackable and reversibly attachable to each other without fasteners. Building block containers 10 do not require any fasteners such as screws, bolts, nails, spikes, ties, clips, etc. in order to stack onto each other or to rigidly attach to each other. Optionally, fasteners, boding agent, adhesive, or glue may be used. Building block container 10 can be made of any known material such as plastic, fiberglass, resin, metal, carbon fiber, wood, foam, concrete, cement, masonry, glass, polyethylene, HDPE, LDPE, PLA, ABS, or similar. Building block container 10 may include an anti-bacterial or antimicrobial agent to make the block mold resistant. Building block container 10 may be transparent, translucent, or opaque. Building block container 10 may be a one-piece molded product or may be assembled from multiple component pieces. Building block container 10 is a hollow structure with an open interior that can be used to store or hold any type of liquid such as: drinking water, milk, baby formula, liquid eggs, protein drinks, vitamin drinks, vegetable juice, fruit juice, soup, cooking oil, any type of canned food, fuel, diesel, gasoline, kerosene, or any type of liquid. Building block container 10 is a hollow structure with an open interior that can be used to store or hold any type of solid or granular solid such as: grain, rice, corn, powdered milk, powdered baby formula, sugar, salt, dehydrated food, freeze dried food, any type of dried food, potatoes, vegetables, fruit, filtration media, concrete, cement, dog food, kitty litter, or any type of solid.

The design of base mode building block container 10 is depicted in FIGS. 1-10. Building block container 10 is a rigid hollow rectangular cuboid member or an essentially rectangular cuboid member. Building block container 10 has an upper surface 11, a lower surface 12, a front surface 13, a rear surface 14, a left surface 15, a right surface 16, and a hollow interior. Upper surface 11 is a rigid member with a front edge, a rear edge, a right edge, a left edge, an inner surface, and an outer surface. Lower surface 12 is a rigid member with a front edge, a rear edge, a right edge, a left edge, an inner surface, and an outer surface. Front surface 13 is a rigid member with an upper edge, a lower edge, a right edge, a left edge, an inner surface, and an outer surface. Rear surface 14 is a rigid member with an upper edge, a lower edge, a right edge, a left edge, an inner surface, and an outer surface. Left surface 15 is a rigid member with an upper edge, a lower edge, a front edge, a rear edge, an inner surface, and an outer surface. Right surface 16 is a rigid member with an upper edge, a lower edge, a front edge, a rear edge, an inner surface, and an outer surface. Upper surface 11 and lower surface 12 are parallel with each other and perpendicular to front surface 13, rear surface 14, left surface 15, and right surface 16. Front surface 13 and rear surface 14 are parallel with each other and perpendicular to upper surface 11, lower surface 12, left surface 15, and right surface 16. Left surface 15 and right surface 16 are parallel with each other and perpendicular to upper surface 11, lower surface 12, front surface 13, and rear surface 14. Each of the four edges of upper surface 11, lower surface 12, front surface 13, rear surface 14, left surface 15, and right surface 16 is connected to or continuous with all four adjacent surfaces and at all four adjacent corners in a liquid-tight or watertight fashion. Except one or more male cylindrical protrusions 20, the hollow interior of building block container 10 is a liquid-tight or watertight container.

The upper surface 11 of building block container 10 comprises a male cylindrical protrusion 20. Male cylindrical protrusion 20 is a rigid cylindrical shaped protrusion with open ends. Male cylindrical protrusion 20 has a diameter that is less than the length of building block container 10 or about 1 to 25 inches. Male cylindrical protrusion 20 has an outer surface, an outer diameter, an inner surface, an inner diameter, a first end, a second end, and a longitudinal axis. The first end of male cylindrical protrusion 20 is contiguous with the upper surface 11 of building block container 10. The first end of male cylindrical protrusion 20 is rigidly attached to the upper surface 11 of building block container 10 in a liquid-tight or watertight fashion. The first end of male cylindrical protrusion 20 is open to provide access to the hollow interior of building block container 10. The longitudinal axis of male cylindrical protrusion 20 is perpendicular to the upper surface 11 of building block container 10. The second end of male cylindrical protrusion 20 protrudes outward from the upper surface 11 of building block container 10. The second end of male cylindrical protrusion 20 is open to provide access to the hollow interior of building block container 10. Male cylindrical protrusion 20 has an O-ring groove 22 around the entire the outer surface of male cylindrical protrusion 20. O-ring groove 22 is half torus-shaped groove, channel, or cavity that encircles the entire outer surface of male cylindrical protrusion 20.

O-ring groove 22 is located at the contiguous connection point or seam between the upper surface 11 of building block container 10 at the first end of male cylindrical protrusion 20. O-ring groove 22 functions to provide an O-ring seat or nest location for a male cylindrical protrusion O-ring 74. Male cylindrical protrusion O-ring 74 is a mechanical torus-shaped gasket or loop of elastomer with a round cross-section. Male cylindrical protrusion O-ring 74 is designed to be seated in O-ring groove 22 and compressed during assembly between two building block containers 10, creating a seal at the interface of the parts. Male cylindrical protrusion O-ring 74 functions to provide a seal between the male cylindrical protrusion 20 of one building block container 10 and the female cylindrical cavity 30 of another building block container 10 stacked or reversibly attached thereto. Male cylindrical protrusion 20 has a locking ridge groove 24 on the outer surface of male cylindrical protrusion 20. Locking ridge groove 24 is a half torus-shaped groove, channel, or cavity that encircles the entire outer surface of male cylindrical protrusion 20. Locking ridge groove 24 is sized and shaped to make a press fit or snap fit with a locking ridge 34 on female cylindrical cavity 30. A press fit is defined as an interference fit or friction fit that is a fastening between two parts achieved by friction after the parts are pushed together. A snap fit is a press fit using a snap member. Locking ridge groove 24 is located in between the O-ring groove 22 and the second end of male cylindrical protrusion 20. Locking ridge groove 24 works in tandem with locking ridge 34 on female cylindrical cavity 30 to mount, lock, or snap onto locking ridge 34 when two building block containers 10 are stacked together or reversibly attached. Male cylindrical protrusion 20 has a seal lip 25 on the inner surface of male cylindrical protrusion 20. Seal lip 25 is a rigid annulus shaped member protruding from the inner surface of male cylindrical protrusion 20. Seal lip 25 is located at the contiguous connection point or seam between the upper surface 11 of building block container 10 at the first end of male cylindrical protrusion 20. Seal lip 25 functions to provide washer seat or sealing surface for any type pipe fitting (not depicted) that may be attached to male cylindrical protrusion 20. Male cylindrical protrusion 20 has a female thread 26 on the inner surface of male cylindrical protrusion 20. Female thread 26 runs from the seal lip 25 to the second end of male cylindrical protrusion 20. Female thread 26 functions to provide a threaded attachment point for a male threaded member such as a threaded plug 76 or other male threaded pipe fitting (not depicted). When block container 10 is shipped with liquid or solid inside, a threaded plug 76 is typically used to seal off male cylindrical protrusion 20.

The upper surface of 11 of building block container 10 may further comprise a filter disc seat 28. Filter disc seat 28 is an annulus shaped cavity in the inner surface of the upper surface 11 of building block container 10. Filter disc seat 28 is centered around the male cylindrical protrusion 20 and concentric with the male cylindrical protrusion 20. Filter disc seat 28 is an annulus shaped cavity around the male cylindrical protrusion 20 on the inner surface of the upper surface 11 of building block container 10. Filter disc seat 28 functions to receive and hold a filter disc 70. Filter disc 70 is a disc shaped filter that may be placed in filter disc seat 28 or snapped into filter disc seat 28 as described below. Filter disc 70 is sized and shaped to form a press fit or snap fit within filter disc seat 28 and vice versa. The diameter and depth of filter disc seat 28 is sized to form a press fit or snap fit with those of filter disc 70.

The lower surface 12 of building block container 10 comprises a female cylindrical cavity 30. Female cylindrical cavity 30 is a rigid cylindrical shaped cavity with open ends. Female cylindrical cavity 30 has a diameter that is less than the length of building block container 10 and a length that is about 1 to 25 inches. Female cylindrical cavity 30 has an outer surface, an outer diameter, an inner surface, an inner diameter, a first end, a second end, and a longitudinal axis. The first end of female cylindrical cavity 30 is contiguous with the lower surface 12 of building block container 10. The first end of female cylindrical cavity 30 is rigidly attached to the lower surface 12 of building block container 10 in a liquid-tight or watertight fashion. The first end of female cylindrical cavity 30 is open to provide access to female cylindrical cavity knockout section 36. The longitudinal axis of female cylindrical cavity 30 is perpendicular to the lower surface 12 of building block container 10. The second end of female cylindrical cavity 30 protrudes inward from the lower surface 12 of building block container 10. The second end of female cylindrical cavity 30 is located in the interior of building block container 10. Male cylindrical protrusion 20 is sized and shaped to nest within female cylindrical cavity 30 and vice versa. Male cylindrical protrusion 20 is sized and shaped to form a slip fit or press fit with female cylindrical cavity 30 and vice versa. The outer diameter of male cylindrical protrusion 20 is sized to form a slip fit or press fit with the inner diameter of female cylindrical cavity 30 and vice versa. Female cylindrical cavity 30 has a locking ridge 34 on the inner surface of female cylindrical cavity 30. Locking ridge 34 is a half torus-shaped ridge, protrusion, or projection that encircles the entire inner surface of female cylindrical cavity 30. Locking ridge 34 is sized and shaped to make a press fit or snap fit with the locking ridge groove 24 on male cylindrical protrusion 20. Locking ridge 34 is located just above the contiguous connection point or seam between the lower surface 12 of building block container 10 and the first end of female cylindrical cavity 30. Locking ridge 34 works in tandem with locking ridge groove 24 on male cylindrical protrusion 20 to mount, lock, or snap into locking ridge groove 24 when two building block containers 10 are stacked or reversibly attached together. Female cylindrical cavity 30 has an O-ring groove 32 around the entire inner surface of female cylindrical cavity 30. O-ring groove 32 is half torus-shaped groove, channel, or cavity that encircles the entire inner surface of female cylindrical cavity 30. O-ring groove 32 is located just above locking ridge 34 or between the locking ridge 34 and the second end of female cylindrical cavity 30. O-ring groove 32 is adjacent to a large diameter female cylindrical cavity score line 38. O-ring groove 32 functions to provide an O-ring seat or nest location for a female cylindrical cavity O-ring 75. Female cylindrical cavity O-ring 75 is a mechanical torus-shaped gasket or loop of elastomer with a round cross-section. Female cylindrical cavity O-ring 75 is designed to be seated in O-ring groove 32 and compressed during assembly between two building block containers 10, creating a seal at the interface. Female cylindrical cavity O-ring 75 functions to provide a seal between the male cylindrical protrusion 20 of one building block container 10 and the female cylindrical cavity 30 of another building block container 10 stacked or reversibly attached thereto. The second end of female cylindrical cavity 30 is sealed or sealed off with a female cylindrical cavity knockout section 36. Female cylindrical cavity knockout section 36 is a rigid liquid tight or watertight barrier member. Female cylindrical cavity knockout section 36 is rigidly attached to the second end of female cylindrical cavity 30 to form a liquid tight or watertight connection therewith. Female cylindrical cavity knockout section 36 is a barrier that may be "knocked out" to yield an opening or port into the interior of building block container 10. In best mode, female cylindrical cavity knockout section 36 is a stepped disc shaped member as depicted with an annulus shaped member on one end, connected to cylindrical member in the middle, that is connected to a disc member on the other end, to form the stepped disc member as depicted. Female cylindrical cavity knockout section 36 has one or more female cylindrical cavity score lines. Each female cylindrical cavity score line is a score line or line with reduced thickness that is may be more easily torn, cracked, or broken than other areas of female cylindrical cavity knockout section 36. Each female cylindrical cavity score line functions to provide a clean break line that allows the female cylindrical cavity knockout section 36 to be knocked out or removed by hitting the female cylindrical cavity knockout section 36 with a hammer or tool. Each female cylindrical cavity score line is a circular score line that is centered around the female cylindrical cavity 30 and concentric with the female cylindrical cavity 30. Each female cylindrical cavity score line is located between the female cylindrical cavity O-ring groove 32 and the second end of female cylindrical cavity 30. In best mode, there are two female cylindrical cavity score lines as depicted. There is a large diameter female cylindrical cavity score line 38 and a small diameter female cylindrical cavity score line 39. Large diameter female cylindrical cavity score line 38 is located on the annulus shaped member of female cylindrical cavity knockout section 36 and adjacent to female cylindrical cavity O-ring groove 32 with a diameter less than that of female cylindrical cavity O-ring groove 32. Small diameter female cylindrical cavity score line 39 is located at the intersection or seam between the cylindrical member and the disc member of female cylindrical cavity knockout section 36. Small diameter female cylindrical cavity score line 39 has a diameter less than that of large diameter female cylindrical cavity score line 38. Building block containers 10 may be ported together to make a pipeline or aqua duct to transfer any type of liquid or slurry. Building block containers may be placed on the side and connected together to form pipeline or aqua duct.

The right surface 16 of building block container 10 may further comprise a right handle 40 and a right handle well 41. Right handle well 41 is a rigid concave depression in the right surface 16 of building block container 10. In best mode, right handle well 41 is half cylinder shaped as depicted. Right handle well 41 has a first end and a second end. The full perimeter of right handle well 41 is contiguous with the right surface 16 of building block container 10 to form a liquid-tight or watertight connection therewith. Right handle 40 is a rigid horizontal oblong member with a first end, a second end, an outside surface, and an inside surface. The first end of right handle 40 is rigidly attached to first end of right handle well 41, which is adjacent to the front surface 13 of building block container 10. The second end of right handle 40 is rigidly attached to the second end of right handle well 41, which is adjacent to the rear surface 14 of building block container 10. The outside surface of right handle 40 is flush with the outer surface of the right surface 16 of building block container 10.

The left surface 15 of building block container 10 may further comprise a left handle 42 and a left handle well 43. Left handle well 43 is a rigid concave depression in the left surface 15 of building block container 10. In best mode, left handle well 43 is half cylinder shaped as depicted. Left handle well 43 has a first end and a second end. The full perimeter of left handle well 43 is contiguous with the left surface 15 of building block container 10 to form a liquid-tight or watertight connection therewith. Left handle 42 is a rigid horizontal oblong member with a first end, a second end, an outside surface, and an inside surface. The first end of left handle 42 is rigidly attached to first end of left handle well 43, which is adjacent to the front surface 13 of building block container 10. The second end of left handle 42 is rigidly attached to the second end of left handle well 43, which is adjacent to the rear surface 14 of building block container 10. The outside surface of left handle 42 is flush with the outer surface of the left surface 15 of building block container 10.

The front surface 13 of building block container 10 may further comprise a front threaded port 44. Front threaded port 44 is a threaded female cylindrical hole or threaded female pipe fitting connection. Front threaded port 44 is a cylindrical threaded cavity with a first end, a second end, and a longitudinal axis. The first end of front threaded port 44 is flush with the outer surface of the front surface 13 of building block container 10. The second end of front threaded port 44 is located in the interior of building block container 10. The longitudinal axis of front threaded port 44 is perpendicular to the front surface 13 of building block container 10. The second end of front threaded port 44 is sealed off with a front threaded port knockout section 45 to yield a liquid tight or watertight barrier in the front threaded port 44. Front threaded port knockout section 45 may be knocked out or removed by hitting it with a hammer or similar in order to open the front threaded port 44.

The rear surface 14 of building block container 10 may further comprise a rear threaded port 46. Rear threaded port 46 is a threaded female cylindrical hole or threaded female pipe fitting connection. Rear threaded port 46 is a cylindrical threaded cavity with a first end, a second end, and a longitudinal axis. The first end of rear threaded port 46 is flush with the outer surface of the front surface 13 of building block container 10. The second end of rear threaded port 46 is located in the interior of building block container 10. The longitudinal axis of rear threaded port 46 is perpendicular to the front surface 13 of building block container 10. The second end of rear threaded port 46 is sealed off with a rear threaded port knockout section 47 to yield a liquid tight or watertight barrier in the rear threaded port 46. Rear threaded port knockout section 47 may be knocked out or removed by hitting it with a hammer or similar in order to open the rear threaded port 46.

The front surface 13 of building block container 10 may further comprise a front perimeter O-ring groove 48. Front perimeter O-ring groove 48 is half torus-shaped groove or cavity around the perimeter of front surface 13 of building block container 10. Front perimeter O-ring groove 48 is located at the contiguous connection point or seam between the front surface 13 and its four adjacent surfaces of building block container 10. Front perimeter O-ring groove 48 functions to provide an O-ring seat or nest location for an O-ring (not depicted) that functions to provide a seal between block container 10 and all adjacent block containers 10 stacked or reversibly attached thereto. This 0-ring functions to make the wall weather tight and watertight and to also prevent animals and insects from ingress into the structure.

The rear surface 14 of building block container 10 may further comprise a rear perimeter O-ring groove 49. Rear perimeter O-ring groove 49 is half torus-shaped groove or cavity around the perimeter of rear surface 14 of building block container 10. Rear perimeter O-ring groove 49 is located at the contiguous connection point or seam between the rear surface 14 and its four adjacent surfaces of building block container 10. Rear perimeter O-ring groove 49 functions to provide an O-ring seat or nest location for an O-ring (not depicted) that function to provide a seal between block container 10 and all adjacent block containers 10 stacked or reversibly attached thereto. This 0-ring functions to make the wall weather tight and watertight and to also prevent animals and insects from ingress into the structure.

Building block container 10 may further comprise two upper hanger bracket retaining slots 50. An upper hanger bracket retaining slot 50 is an angled slot at the intersection of the upper surface 11 of building block container 10 and the left surface 15 of building block container. There is another upper hanger bracket retaining slot 50 at the intersection of the upper surface 11 of building block container 10 and the right surface 16 of building block container 10. Each upper hanger bracket retaining slot 50 is a shaved or angled portion of the seam between upper surface 11 and left and right surfaces 15,16 as depicted. The width of each upper hanger bracket retaining slot 50 is less than the width of building block container 10. Each upper hanger bracket retaining slot 50 is located at the center of the seam between upper surface 11 and left and right surfaces 15,16 as depicted. Each of these upper hanger bracket retaining slots 50 functions to located and retain a hanger bracket tab 82 of a hanger bracket 80.

Building block container 10 may further comprise two lower hanger bracket retaining slots 51. A lower hanger bracket retaining slot 51 is an angled slot at the intersection of the lower surface 12 of building block container 10 and the left surface 15 of building block container. There is another lower hanger bracket retaining slot 51 at the intersection of the lower surface 12 of building block container 10 and the right surface 16 of building block container 10. Each lower hanger bracket retaining slot 51 is a shaved or angled portion of the seam between lower surface 12 and left and right surfaces 15,16 as depicted. The width of each lower bracket retaining slot 51 is less than the width of building block container 10. Each lower hanger bracket retaining slot 51 is located at the center of the seam between lower surface 12 and left and right surfaces 15,16 as depicted. Each of these lower hanger bracket retaining slots 51 functions to located and retain a hanger bracket tab 82 of a hanger bracket 80 when building block container is turned upside down.

The front surface 13 and/or the rear surface 14 of building block container 10 may further comprise conduit quarter round. Conduit quarter round is a one-quarter cylindrical shaped cavity or depression around all four edges of front surface 13 or rear surface 14. Conduit quarter round is a one-quarter cylindrical shaped cavity or depression at the contiguous connection point or seam between the front surface 13 and all four adjacent surfaces 11,12,15,16 or between the rear surface 14 and all four adjacent surfaces 11,12,15,16. One-quarter cylindrical shaped cavity or depression can be described as the shape of the inside surface of an open-ended cylindrical member that has been quartered longitudinally. The addition of conduit quarter round causes the front surface 13 to appear extended or protruded from the contiguous connection point or seam between the front surface 13 and all four adjacent surfaces 11,12,15,16. Conduit quarter round includes straight conduit quarter round 52 and L-shaped conduit quarter round 53. L-shaped conduit quarter round 53 is a L-shaped section of conduit quarter round. L-shaped conduit quarter round 53 is a section of conduit quarter round along each corner of front surface 13 or rear surface 14. L-shaped conduit quarter round 53 must be L-shaped or a 90 degree elbow in order to follow each corner of front surface 13 or rear surface 14. Straight conduit quarter round 52 is a straight section of conduit quarter round. Straight conduit quarter round 52 is a straight section of conduit quarter round in between each section of L-shaped conduit quarter round 53 that links each section of L-shaped conduit quarter round 53. Thus, there is a straight conduit quarter round 52 section in between each L-shaped conduit quarter round 53 section as depicted.

When two building block containers 10 are stacked or reversibly attached together, one conduit quarter round section from one building block container 10 is adjacent to another conduit quarter round section from the other building block container 10 to yield a "half round" section. This half round section functions to receive and hold a section of round conduit (not depicted) or round pipe (not depicted). Round conduit or round pipe may be snapped into or installed into the half round without any brackets or fasteners. The diameter of L-shaped conduit quarter round 53 is larger than that of straight conduit quarter round 52 in order to allow clearance for elbow or 90 degree conduit or pipe fittings and T-shaped conduit or pipe fittings to be installed therein. Elbow conduit or pipe fittings and T conduit or pipe fittings have larger diameters than straight sections of conduit or pipe. L-shaped conduit quarter round 53 and straight conduit quarter round 52 are sized to receive and attached a particular size of conduit or pipe. The diameter of L-shaped conduit quarter round 53 is slightly larger than that of an elbow fitting or T-fitting of a particular size of conduit or pipe. The diameter of straight conduit quarter round 52 is sized slight larger slightly larger than that of a particular size of conduit or pipe. Thus, conduit quarter round functions to receive and hold fittings and sections of pipe or conduit. After a building or structure is erected from building block containers 10, conduit and pipe systems may be simply snapped into place with requiring any brackets or fasteners.

The front surface 13 and/or rear surface 14 of building block container 10 may further comprise a square or rectangular label recess 56. Square or rectangular label recess 56 is a square-shaped or rectangle-shaped recess or depression in the outer surface of the front surface 13 or rear surface 14 of building block container 10. Square or rectangular label recess 56 functions to receive a label that is affixed or adhered in the recess.

The upper surface 11 of building block container 10 may further comprise a second male cylindrical protrusion 20 and the lower surface 12 of building block container 10 may further comprise a second female cylindrical cavity 30 as depicted in FIGS. 11-20. The design of this mode building block container 10 is depicted in FIGS. 11-20. In this mode, building block container 10 is typically longer than the base mode building block container 10 with one male cylindrical protrusion 20 and one female cylindrical cavity 30, as depicted in FIGS. 1-10. This mode building block container 10 is typically the same size as a standard concrete cinder block. In this mode, building block containers 10 may be staggered as they are stacked together or reversibly attached to each other. In a staggered configuration, vertical seams between building block containers 10 are alternated or staggered and do not run straight down in a continuous line. Cinder block walls or structures are typically built with a staggered block configuration as well. In a staggered configuration, the male cylindrical protrusion 20 on the right side of one building block container 10 is mated with or attached to a female cylindrical cavity 30 on the left side of another building block containers 10. This pattern is repeated to build or erect a wall or corner of a shelter, structure, or building.

In the double male cylindrical protrusion 20 and double female cylindrical cavity 30 mode, the front surface 13 and/or the rear surface 14 of building block container 10 may further comprise conduit half round. Conduit half round is a one-half cylindrical shaped cavity or depression in the front surface 13 or rear surface 14. Conduit half round is a one-half cylindrical shaped cavity or depression along the center of front surface 13 or rear surface 14. Conduit half round includes straight conduit half round 54 and T-shaped conduit half round 55. T-shaped conduit half round 55 is a T-shaped section of conduit half round. T-shaped conduit half round 55 is a section of conduit half round on front surface 13 or rear surface 14. Straight conduit half round 54 is a straight section of conduit half round that runs vertically in between each section of T-shaped conduit half round 55. Conduit half round functions to receive and hold a section of round conduit or round pipe. Round conduit or round pipe may be snapped into or installed into the half round without any brackets or fasteners. The diameter of T-shaped conduit half round 55 is larger than that of straight conduit half round 54 in order to allow clearance for elbow or 90 degree conduit or pipe fittings and T-shaped conduit or pipe fittings to be installed therein. Elbow conduit or pipe fittings and T conduit or pipe fittings have larger diameters than straight sections of conduit or pipe. T-shaped conduit half round 55 and straight conduit half round 54 are sized to receive and attached a particular size of conduit or pipe. The diameter of T-shaped conduit half round 55 is slightly larger than that of an elbow fitting or T-fitting of a particular size of conduit or pipe. The diameter of straight conduit half round 54 is sized slight larger slightly larger than that of a particular size of conduit or pipe. Thus, conduit half round functions to receive and hold fittings and sections of pipe or conduit. After a building or structure is erected from building block containers 10, conduit and pipe systems may be simply snapped into place with requiring any brackets or fasteners.

The lower surface 12 of building block container 10 may further comprise a head carrying dimple 58. Head carrying dimple 58 is a semispherical shaped recess or depression in the lower surface 12. Head carrying dimple 58 functions as recess or depression that conforms to the shape of the top of a human's head in order to provide a recess or depression that can more comfortably rest on top of a human's head to allow for easier balancing and holding of a building block container 10 on a person's head. If the building block container 10 were filled with water or other heavy material, the full building block container 10 may be more easily transported by a person by resting or placing the head carrying dimple 58 on your head.

Building block container 10 may further comprise an RFID chip 60. An RFID chip 60 is radio-frequency identification chip that uses electromagnetic fields to automatically identify and track the object connected to the RFID chip 60. A chip is an integrated circuit or monolithic integrated circuit that is a set of electronic circuits on one small flat piece of semiconductor material. RFID chip 60 contains electronically stored information that passively collects energy from a nearby RFID chip reader emitting interrogating radio waves. RFID chip 60 functions to track a building block container 10 and/or its contents as it is logistically moved or transferred from one location to another.

The upper surface 11 of building block container 10 may further comprise a third and fourth male cylindrical protrusion 20 and the lower surface 12 of building block container 10 may further comprise a third and fourth female cylindrical cavity 30 as depicted in FIGS. 46-55. The design of this mode building block container 10 is depicted in FIGS. 46-55. In this mode, building block container 10 is typically longer or wider than the mode building block container 10 with two male cylindrical protrusions 20 and two female cylindrical cavities 30 depicted in FIGS. 11-20. This mode is essentially two building block depicted in FIGS. 11-20 connected together in parallel by length or in series by width to form one large building block container 10. Typically, there are no interior walls to yield one large storage tank inside the building block container 10. This mode building block container 10 is typically twice the size of a standard concrete cinder block. In this mode, building block containers 10 are much larger so that they can hold much more liquid or solid inside and also provide a thicker barrier with more insulation value in a wall, shelter, structure, or building.

Figure 56:
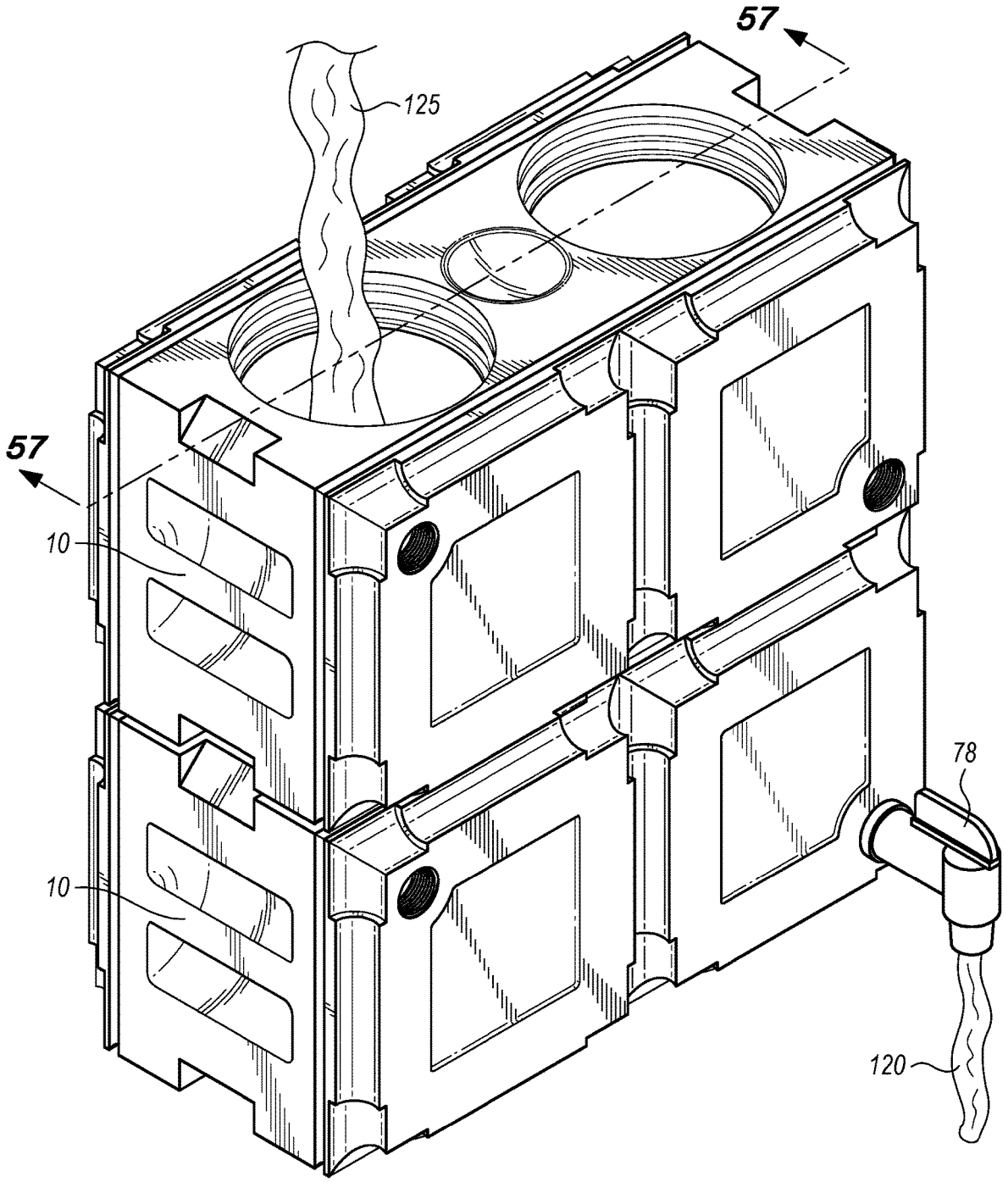
FIG. 56 is a perspective view of a liquid filtration device or water filtration device consisting of two stacked building block containers with two filter discs, four O-rings, two threaded plugs, and a threaded tap or faucet installed therein.
Figure 57:
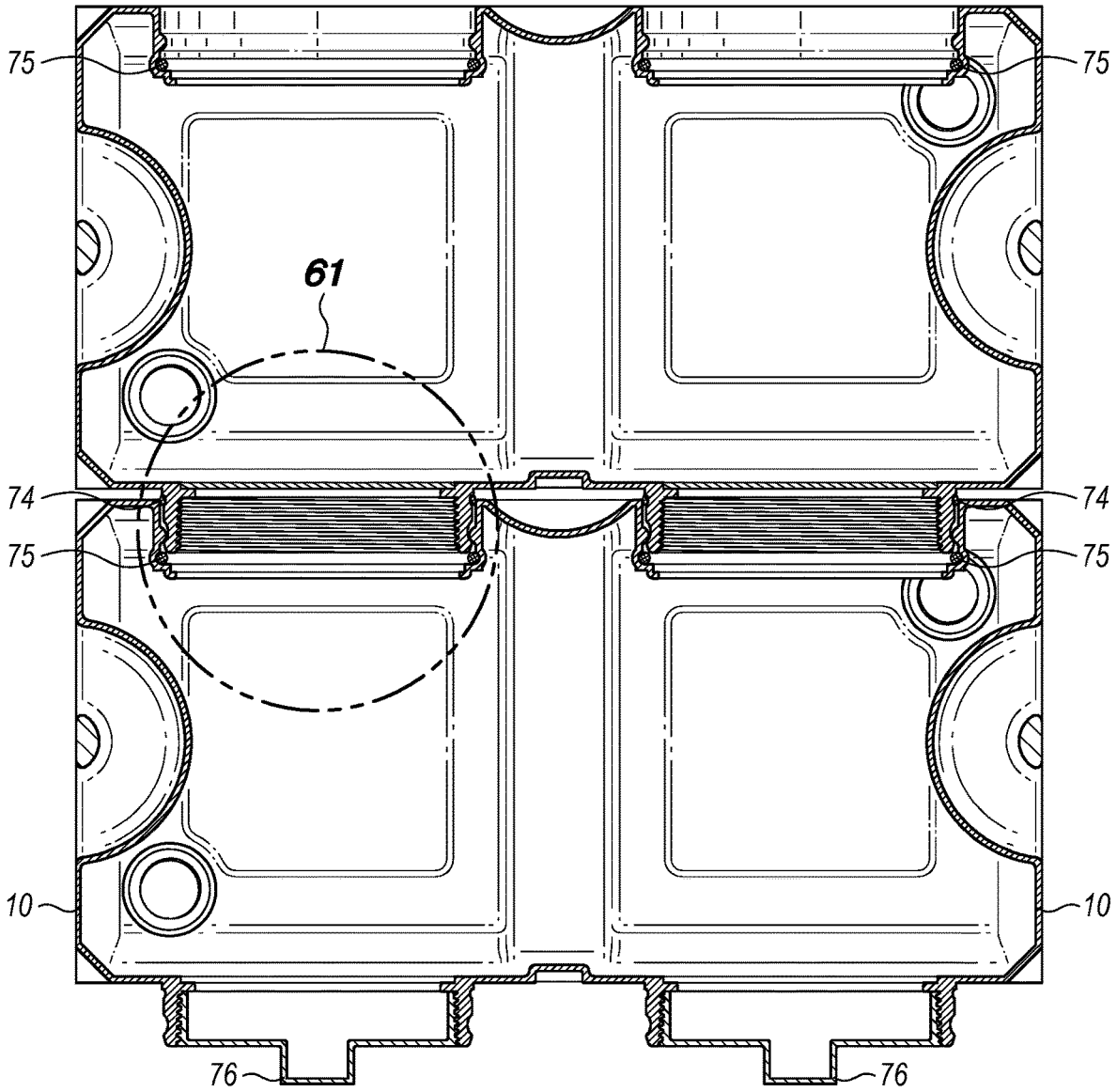
FIG. 57 is a cross sectional view taken from section 57-57 of FIG. 56.
Figure 61:
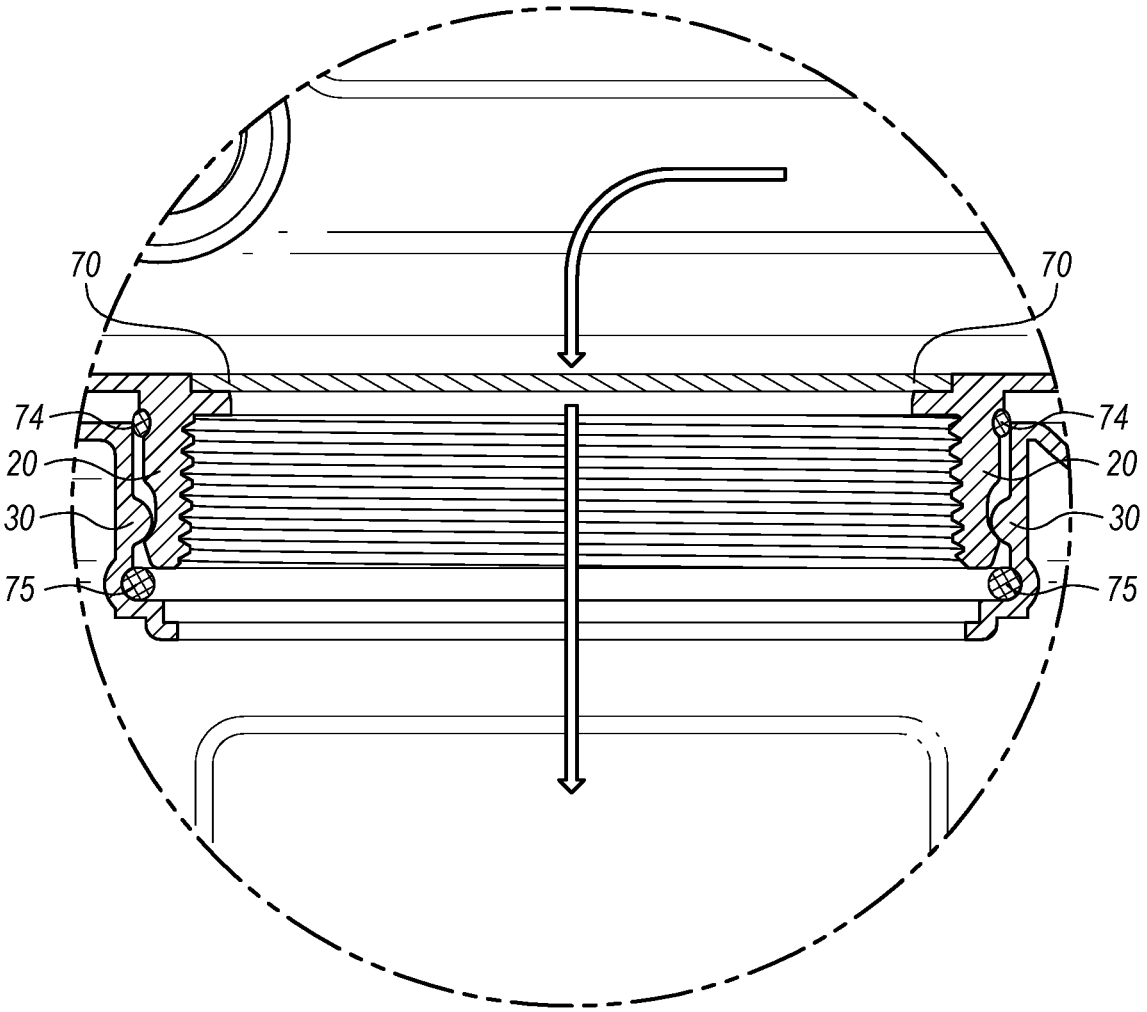
FIG. 61 is an enlarged cross sectional view taken from section 61 of FIG. 57 depicting a press fit or snap fit between two attached building block containers.
Figure 62:
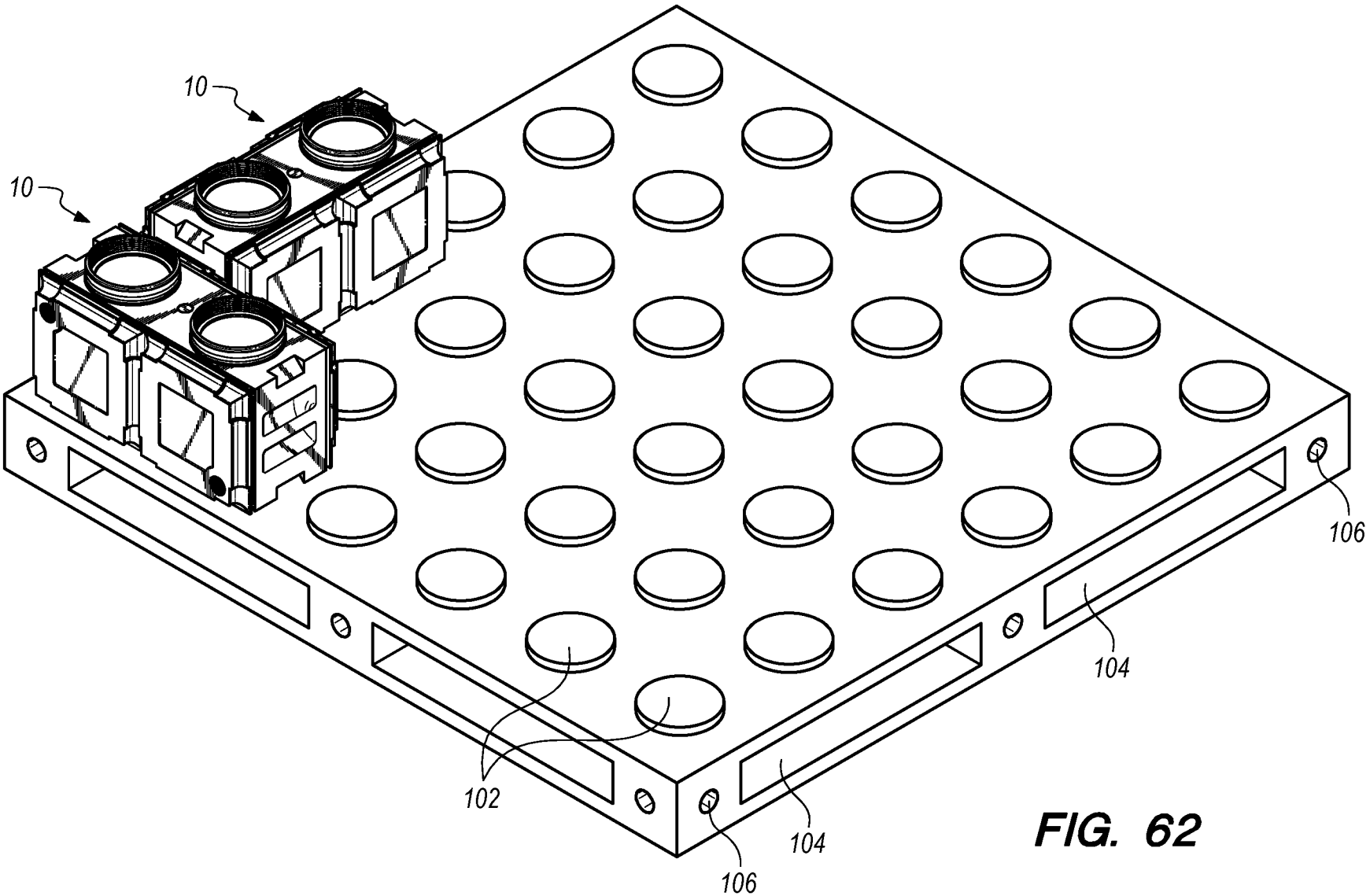
FIG. 62 is a perspective view of a floor pallet with two building block containers stacked thereon.
Figure 62A:
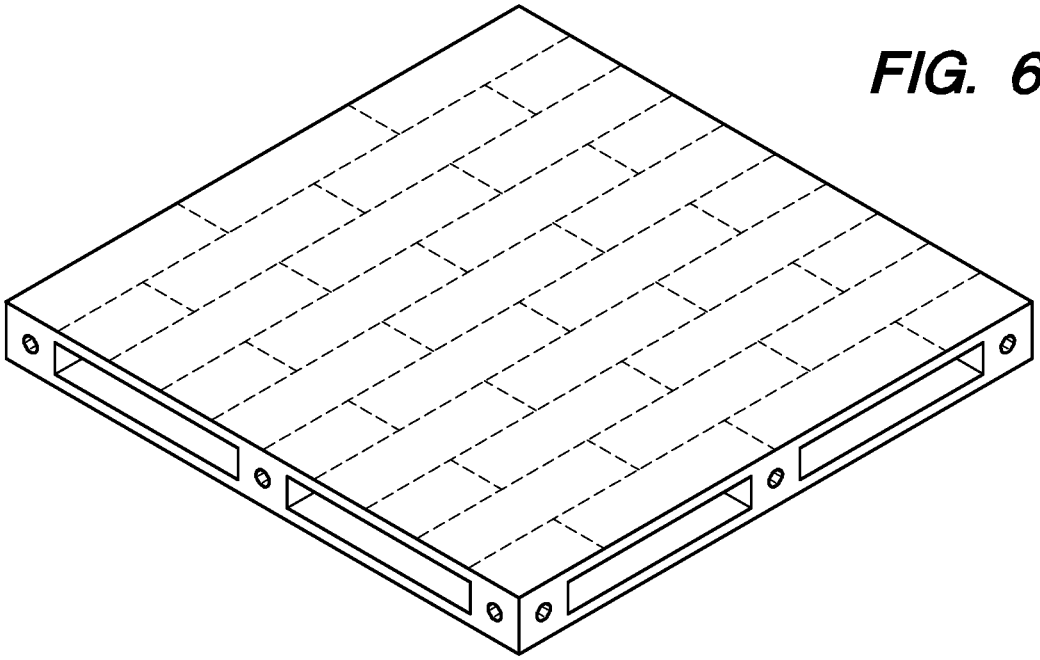
FIG. 62A is a bottom perspective view of floor pallet.
Figure 62B:
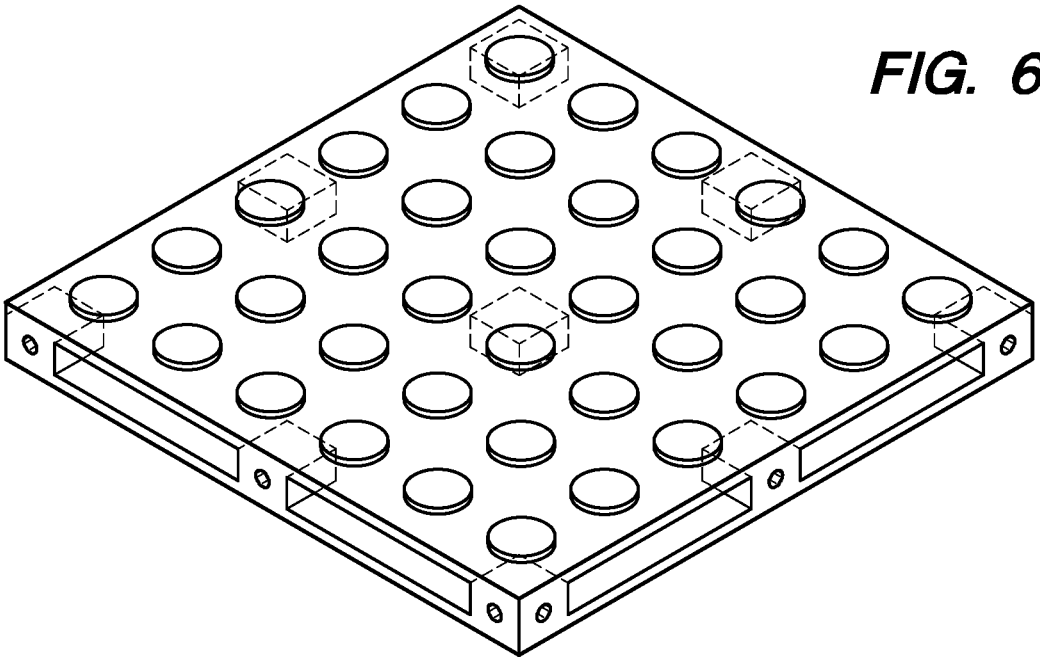
FIG. 62B is a top perspective view of floor pallet.
Figure 62C:
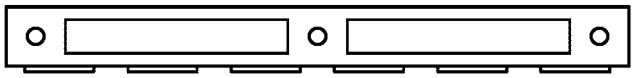
FIG. 62C is a front elevation view of floor pallet, the rear elevation view, right side elevation, and left side elevation being a mirror image thereof.
Figure 62D:
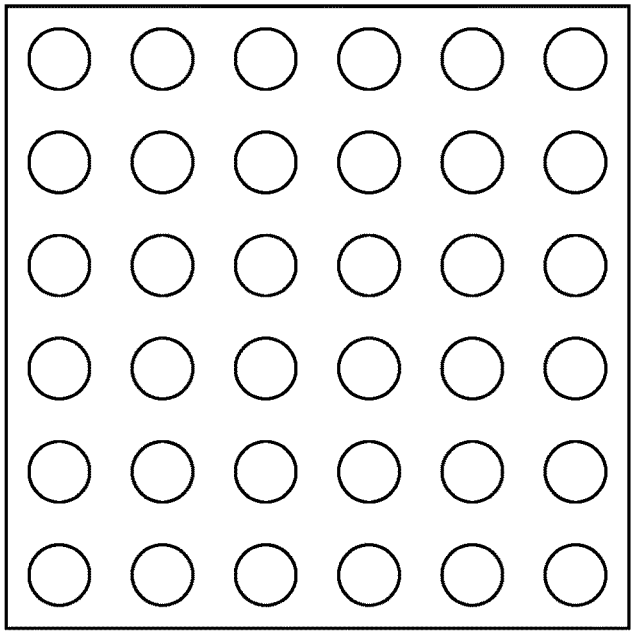
FIG. 62D is a top plan view of floor pallet.
Figure 62E:
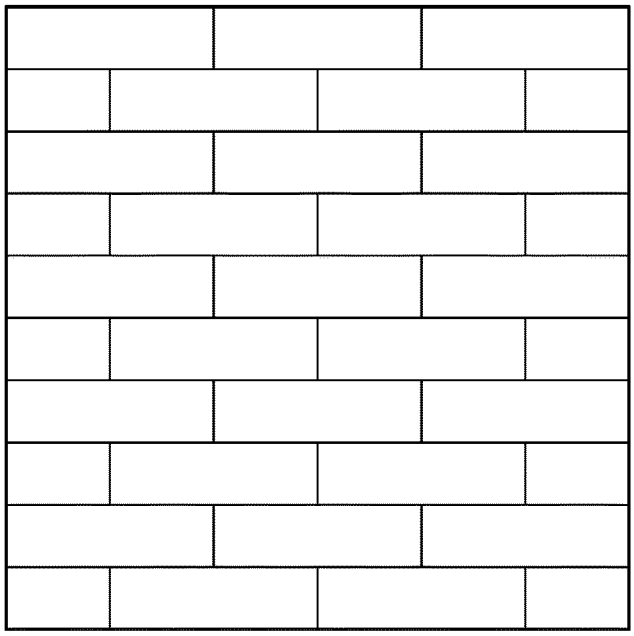
FIG. 62E is a bottom plan view of floor pallet.

Building block container 10 may further comprise a filter disc 70. The design of filter disc 70 is depicted in FIGS. 25-29. Filter disc 70 is a disc shaped filter that is used to filter liquid such as water. Filter disc 70 comprises: a frame 71, at least one layer of filter media 72, and a center 73. Frame 71 is a rigid structural member with a thickness and an outer diameter. At least one layer of filter media 72 is rigidly attached to frame 71. At least one layer of filter media 72 is supported by frame 71. At least one layer of filter media 72 may be a layer of any known material such as: plastic, polymer, fluoropolymer, ceramic, fabric, husk, mesh, cartridge paper, carbon, cartridge membrane, pad, or any other material. Filter disc 70 may be reusable or single use. Filter disc frame 71 has a diameter that is slightly greater than the inner diameter of male cylindrical protrusion 20 but slightly less than the inner diameter of female cylindrical cavity 30. Filter disc 70 is reversibly attachable within filter disc seat 28 on the inner surface of the lower surface 12 of building block container 10 as depicted in FIGS. 57 and 61. To install or attach filter disc 70 within filter disc seat 28, the female cylindrical cavity knockout section 36 must be removed, and the filter disc 70 must be curled, squeezed, or bent slightly, so that it may pass through the opening of female cylindrical cavity 30 in order to be placed within filter disc seat 28 of the upside down building block container 10. Filter disc 70 is also reversibly attachable to the inner diameter of female cylindrical cavity 30. To install or attach filter disc 70 within female cylindrical cavity 30, part of the female cylindrical cavity knockout section 36 must first be knocked out by breaking the small diameter female cylindrical cavity score line 39 but leaving the large diameter female cylindrical cavity score line 38 in tact. This opens a port through female cylindrical cavity 30 but leaves an annulus shaped portion of female cylindrical cavity knockout section 36 for the filter disc 70 to rest on. One or more filter discs 70 may be installed into a building block containers 10 in order to create a water filtration device that may be used to filter non-potable water into drinkable water as depicted in FIG. 56. A multicellular filtration device using multiple layers of filter media may be created by stacking two or more upside down building block containers 10 together. This is done by installing a threaded plug 76 into the male cylindrical protrusions 20, facing the male cylindrical protrusion 20 downward, knocking out the female cylindrical cavity knockout section 36, and installing a filter disc 70 within the filter disc seat 28 of the male cylindrical protrusions 20 and another filter disc within the female cylindrical cavities 30 as depicted in FIGS. 57 and 61. Each filter disc 70 may be made of different filter media. Additionally, each building block container 10 could contain different types of filter media such as: large gravel, medium gravel, small gravel, sand, activated carbon, anthracite, garnet, VOC filter, filter fabric, filter paper, or other material. Filter center 73 is a removable center or plug member. Filter center 73 would need to be removed in order install a block tie 90 between two attached building block containers 10 with a filter disc 70 in between. Block tie 90 would pass through the open center of filter disc 70 after filter center 73 is removed. To install a block tie 90 between two building block containers 10, the toggle 94 is passed through the center of filter disc 70 to the female cylindrical cavity 30 of the adjacent building block container 10, while keeping the ratchet stop 96 on the other side of filter disc 70, and pulling the strap 92 to press ratchet stop 96 onto the open filter center to form a watertight seal thereto.

Building block container 10 may further comprise a hanger bracket 80. The design of hanger bracket 80 is depicted in FIGS. 21-24. Hanger bracket 80 is a bracket that is reversibly attachable to the upper surface 11 of building block container 10 as depicted in FIGS. 56-57. Hanger bracket 80 is a rigid planar member with two or more tabs 82 and a plurality of slots 83. Each tab 82 rests or nests within a hanger bracket retaining slot 50,51. Hanger bracket 80 functions to receive and hold a plurality of other brackets within its plurality of slots 83.

Building block container 10 may further comprise a rafter hanger 84. The design of rafter hanger 84 is depicted in FIGS. 30-37. Rafter hanger 84 is a bracket that is reversibly attachable to hanger bracket 80 as depicted in FIGS. 56-67. Rafter hanger 84 is a rigid bracket member with a vertical slot 85 to receive and hold a rafter. Rafter hanger 84 has a plurality of vertical tines 86 or protrusions that are reversibly attachable within the plurality of slots 83 on hanger bracket 80. Rafter hanger 84 also has foot tab 97 that is also reversibly attachable within a slot 83 on hanger bracket 80.

Building block container 10 may further comprise a large rafter hanger 87. The design of large rafter hanger 87 is depicted in FIGS. 38-45. Large rafter hanger 87 is a bracket that is reversibly attachable to hanger bracket 80 as depicted in FIGS. 56-67. Large rafter hanger 87 is a rigid bracket member with a vertical slot 88 to receive and hold a large rafter. Large rafter hanger 87 has a plurality of vertical tines 89 or protrusions that are reversibly attachable within the plurality of slots 83 on hanger bracket 80. Large rafter hanger 87 also has foot tab 99 that is also reversibly attachable within a slot 83 on hanger bracket 80.

Hanger bracket 80, rafter hanger 84, and large rafter hanger 87 can be used to quickly add rafters to a wall, shelter, structure, or building erected from building block containers 10 as described above. Rafters may be hung or rigidly attached to a wall, shelter, structure, or building erected from building block containers 10 without any fasteners.

Figure 58:
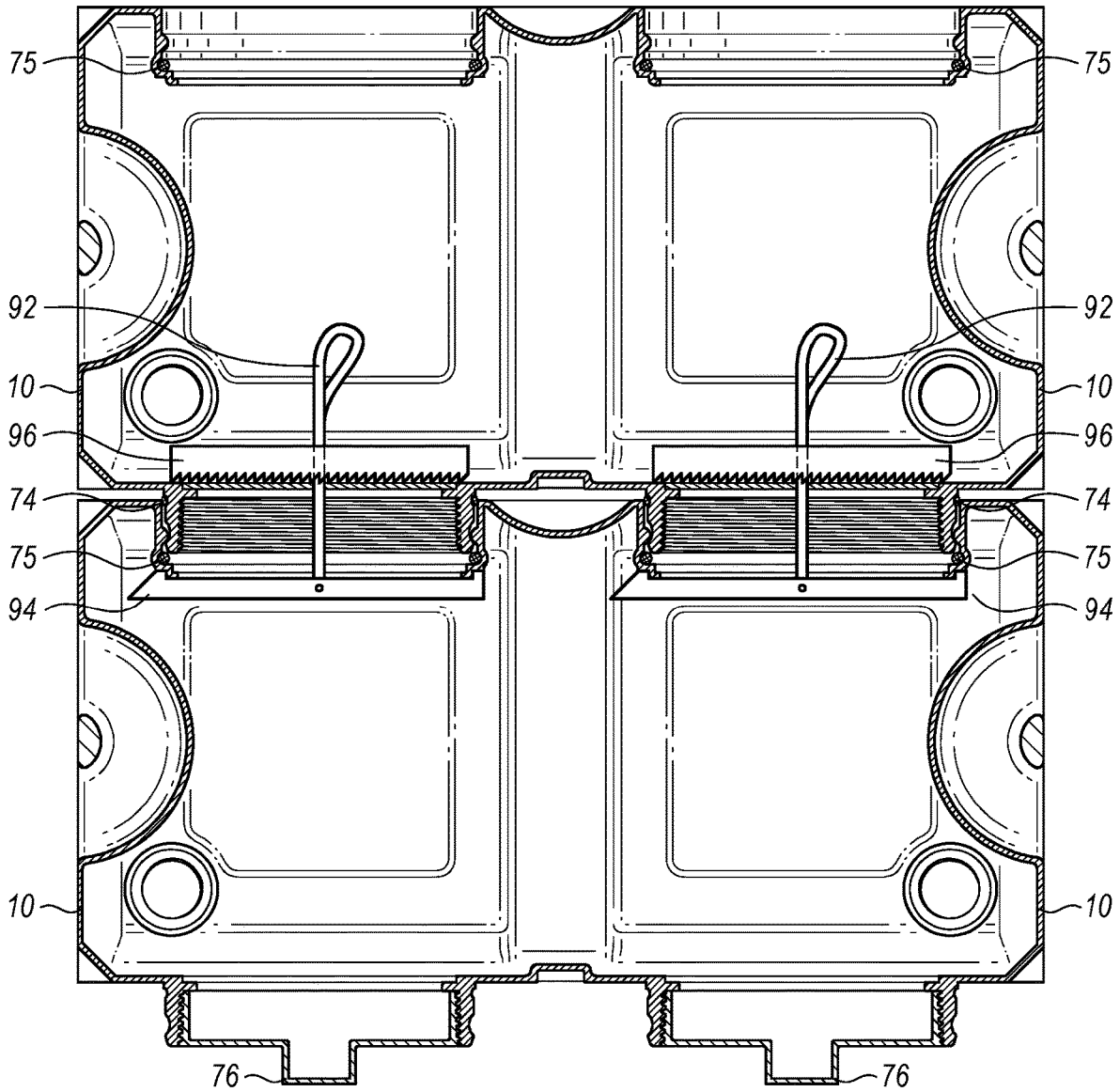
FIG. 58 is a cross sectional view taken from section 57-57 of FIG. 56 with the addition of two block ties holding the two stacked building block containers together.
Figure 59:
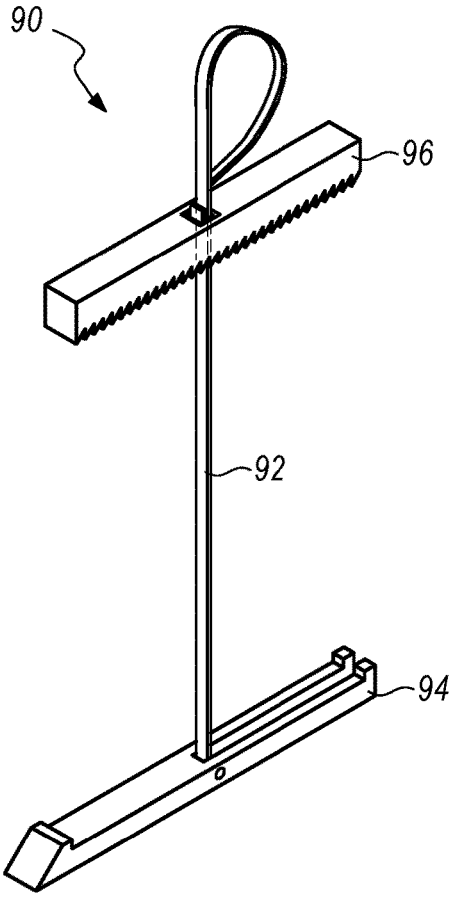
FIG. 59 is a perspective view of block tie.
Figure 59A:
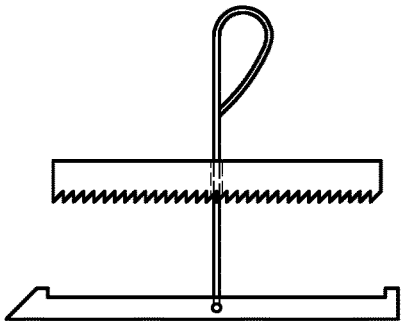
FIG. 59A is a front elevation view of block tie, the rear elevation view being a mirror image thereof.
Figure 59B:
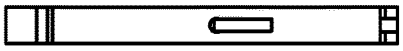
FIG. 59B is a top plan view of block tie.
Figure 59C:
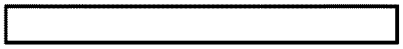
FIG. 59C is a bottom plan view of block tie.
Figure 59D:
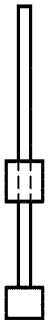
FIG. 59D is left side elevation of block tie.
Figure 59E:
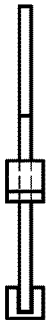
FIG. 59E is a right side elevation of block tie.
Figure 60:
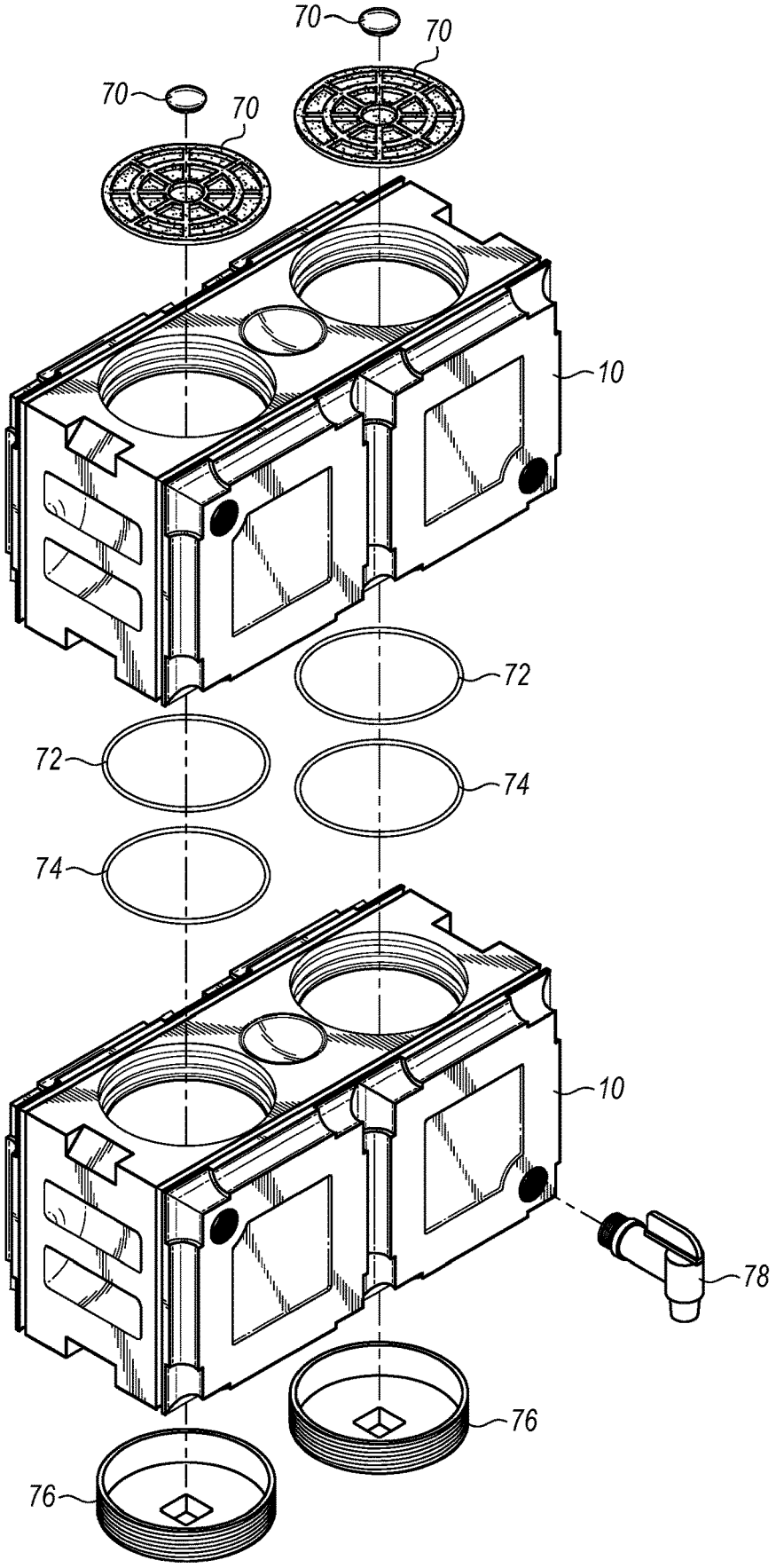
FIG. 60 is an assembly view of the liquid filtration device or water filtration device depicted in FIG. 56.

Building block container 10 may further comprise a block tie 90. The design of block tie 90 is depicted in FIGS. 59-59E. Block tie 90 is a toggle member that functions to hold two stacked building block containers 10 together under tension. Block tie 90 is a toggle member that functions to compress the two O-rings 74,75 to create a strong seal and to add rigidity to the stacked building block containers 10. Block tie 90 comprises: a strap 92, a toggle 94, and a ratchet stop 96. Toggle 94 is a rigid oblong member that is a toggle member with a first end, a middle section, and a second end. Tie is a flexible linear cordage or strap member with a first end and a second end. Ratchet stop 96 is a rigid oblong member that is a toggle member with a first end, a middle section, and a second end. Ratchet stop 96 has a ratchet member in the middle section. A ratchet member is a mechanical device that allows continuous linear motion in only one direction while preventing motion in the opposite direction. Ratchet member functions to allow strap 92 to be tightened or pulled tight but does not allow strap 92 to loosen or travel in the other direction without first releasing a latch. The first end of strap 92 is slideably attached to the ratchet member on ratchet stop 96. The second of strap 92 is rotationally attached to the middle section of toggle 94. To install block tie 90 between two building block containers 10, the female cylindrical cavity knockout sections 36 must be removed from each building block container 10, then the two building block containers are stacked together by connecting the male cylindrical protrusion 20 of one block container 10 with the female cylindrical cavity 30 of another building block container 10, then toggle 94 is passed through the connection while keeping ratchet stop 96 on the other side of the connection, and pulling the strap 92 to press ratchet stop 96 onto the connection to squeeze the connection and hold it together under tension as depicted in FIG. 58.

Figure 66:
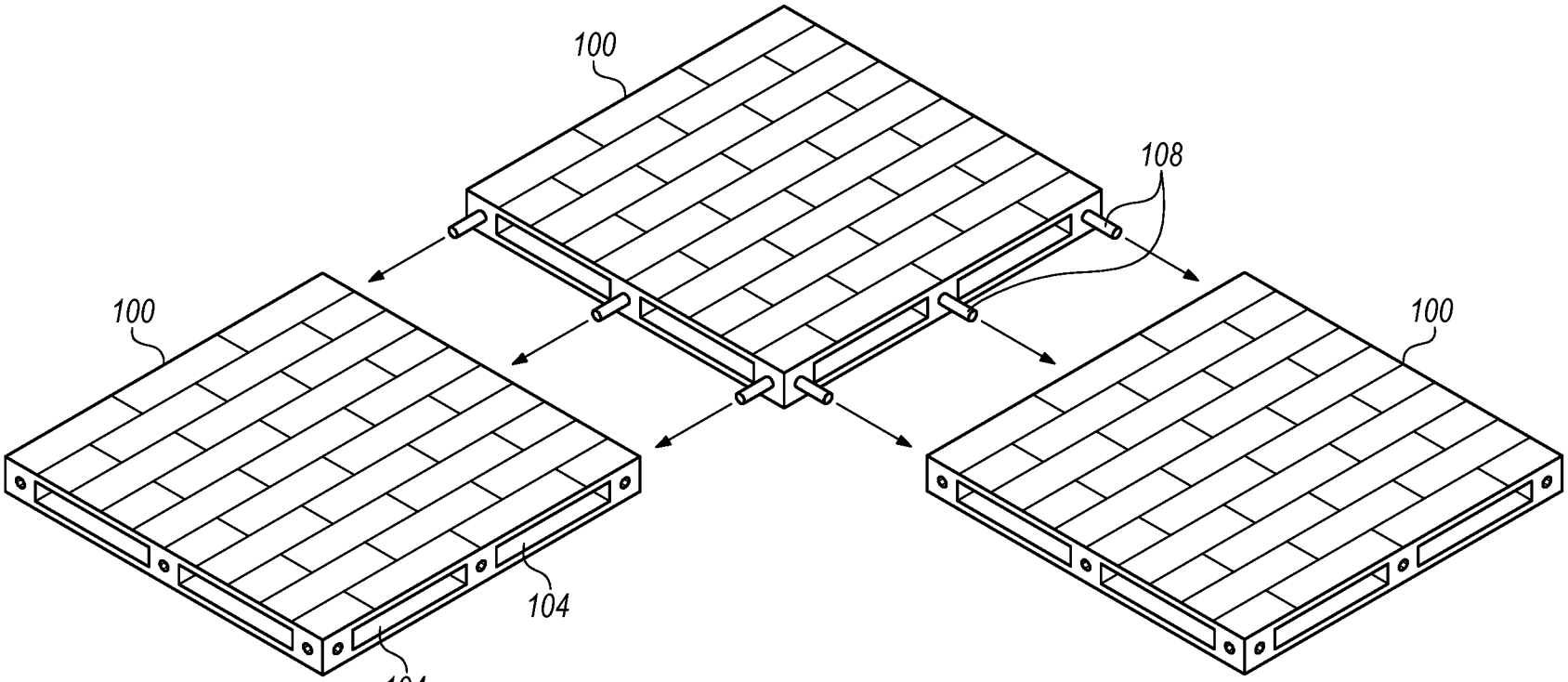
FIG. 66 is an assembly view of three pallet floors attached together with six dowels.
Figure 67:
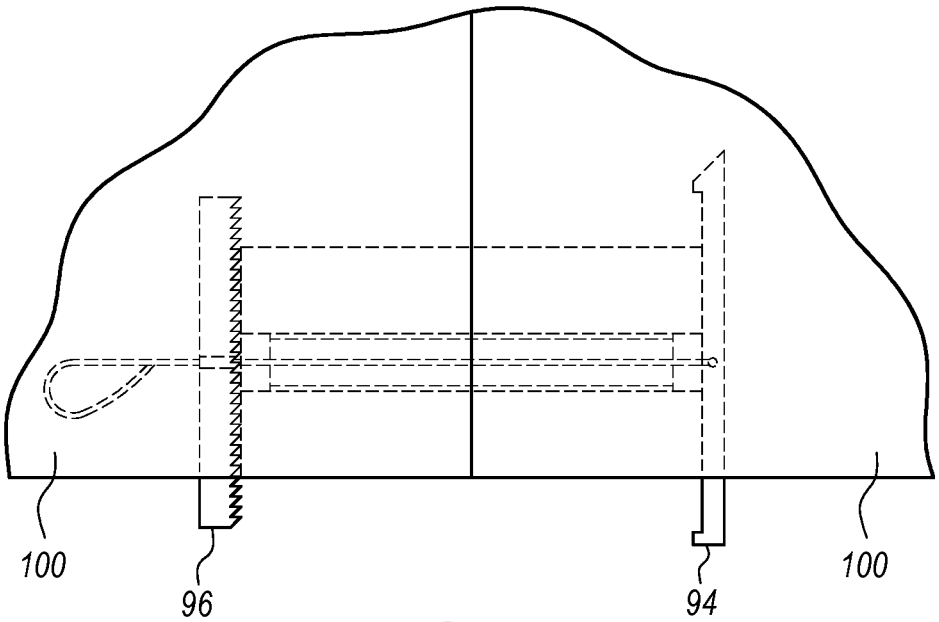
FIG. 67 is a cross sectional view of two pallet floors attached together with a block tie, wherein the block tie squeezes a fork lift notch from one floor pallet against an adjacent fork lift notch from the second floor pallet.
Figure 68:
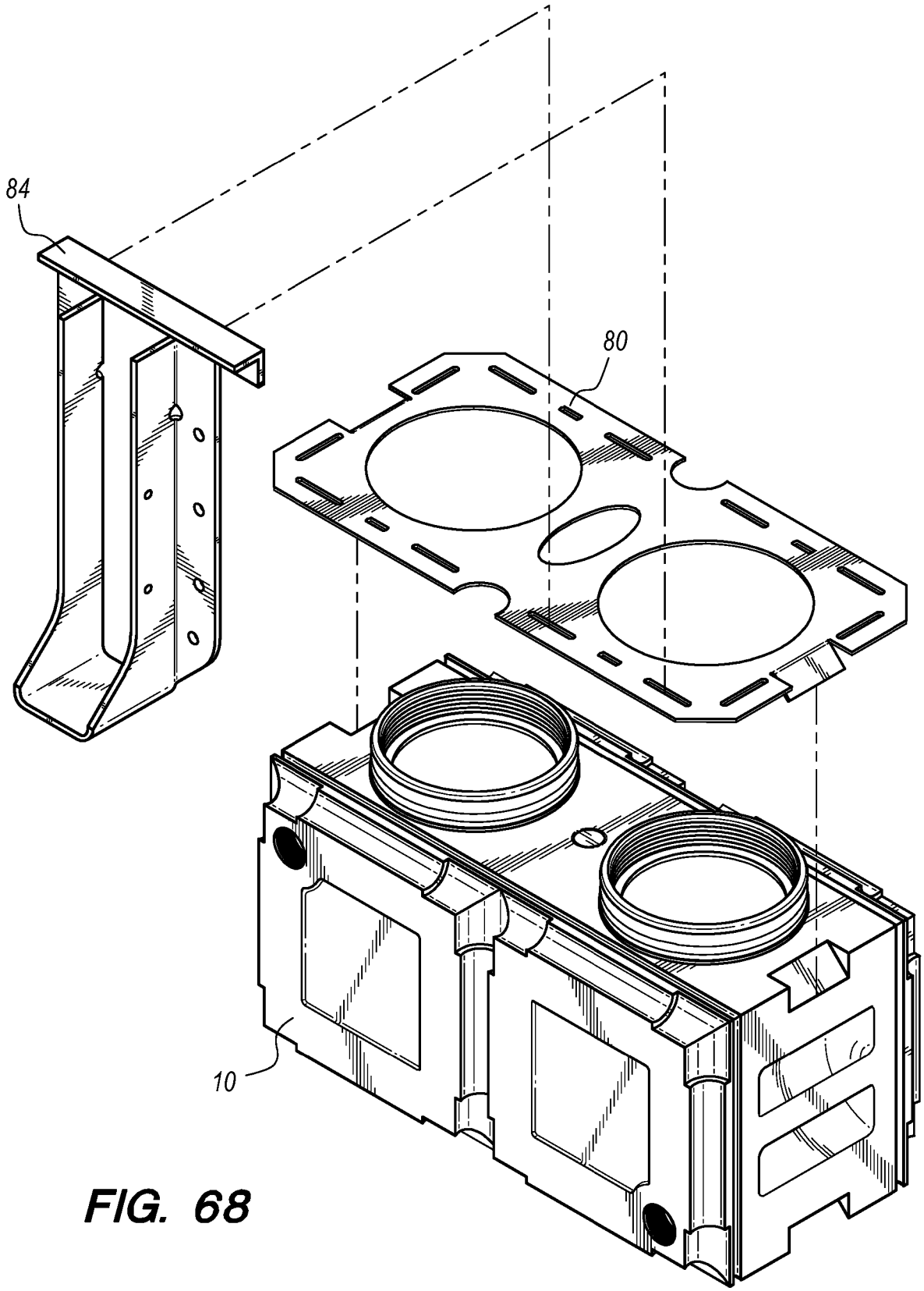
FIG. 68 is an assembly view of a building block container with a hanger bracket and a rafter hanger attached thereto.
Figure 69:
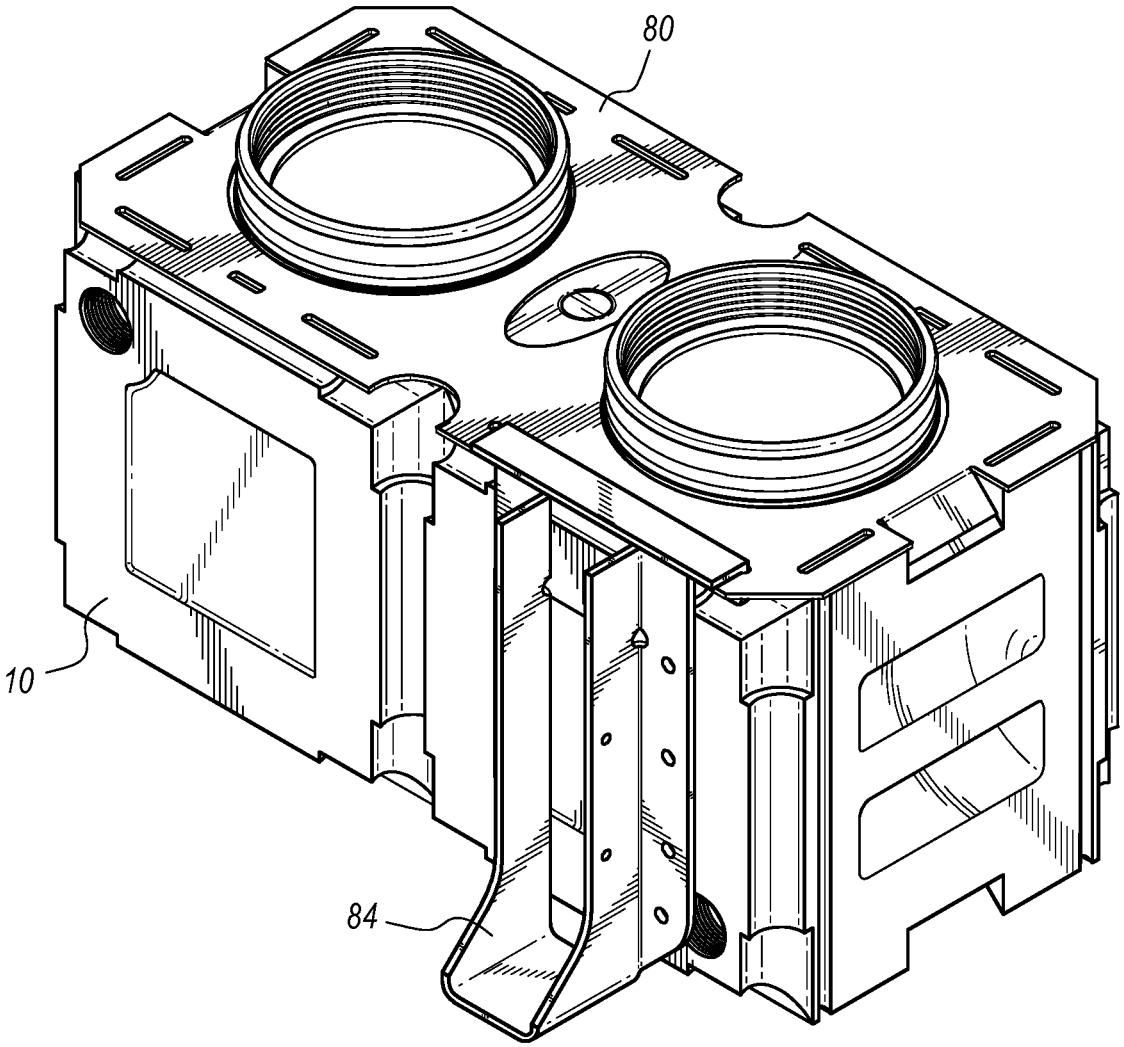
FIG. 69 is a perspective view of a building block container with a hanger bracket and a rafter hanger attached thereto.

A plurality of building block containers 10 may be stacked and shipped on a pallet floor 100. The design of pallet floor 100 is depicted in FIGS. 62A-62E. Pallet floor 100 is a pallet. A pallet is a flat transport structure that supports goods in a stable fashion while being lifted by a forklift, a pallet jack, a front loader, crane, or other machinery. Pallet floor 100 is a specially shaped to include a plurality of male cylindrical protrusions 102 on its upper surface. Male cylindrical protrusions 102 are reversibly attachable to female cylindrical cavities 30 on building block containers 10. Male cylindrical protrusion 102 is similar in size and shape to the male cylindrical protrusion 20 on a building block container 10. Building block containers 10 may be attached to pallet floor 100 and shipped without straps and without shrink wrap. Pallet floor 100 has two fork lift notches 104 in its front side, rear side, left side, and right side, making a total of eight fork lift notches 104 per pallet floor 100. A fork lift notch 104 is a cavity where a fork from a fork lift may be inserted in order to lift the pallet floor 100. Pallet floor 100 has three dowel holes 106 in its front side, rear side, left side, and right side, making a total of 12 dowel holes 106 per pallet floor 100. Pallet floor 100 is also a floor. Pallet floor 100 may be used as a floor in the wall, shelter, structure, building, greenhouse, water filtration device, emergency shelter, pipeline, flood blockade, flood wall, dock, or raft erected from building block containers 10. The bottom surface of pallet floor 100 becomes the floor surface in the wall, shelter, structure, building, greenhouse, water filtration device, emergency shelter, pipeline, flood blockade, flood wall, dock, or raft erected from building block containers 10. A plurality of upside-down pallet floors 100 may be connected together with a plurality of dowels 108 as depicted in FIG. 66. A dowel 108 is a rigid cylindrical member. Dowel 108 is sized to form a slip fit or press fit with dowel hole 106 and vice versa. Pallet floors 100 may be held together under tension with one or more a block ties 90. A block tie 90 squeezes a fork lift notch 104 from one floor pallet against an adjacent fork lift notch 104 from the second floor pallet as depicted by cross sectional view in FIG. 67. One end of the block tie 90 is passed through each fork lift notch 104, then the block tie ratchet stop 96 is pressed inward to hold the two pallet floors 100 together.

Figure 63:
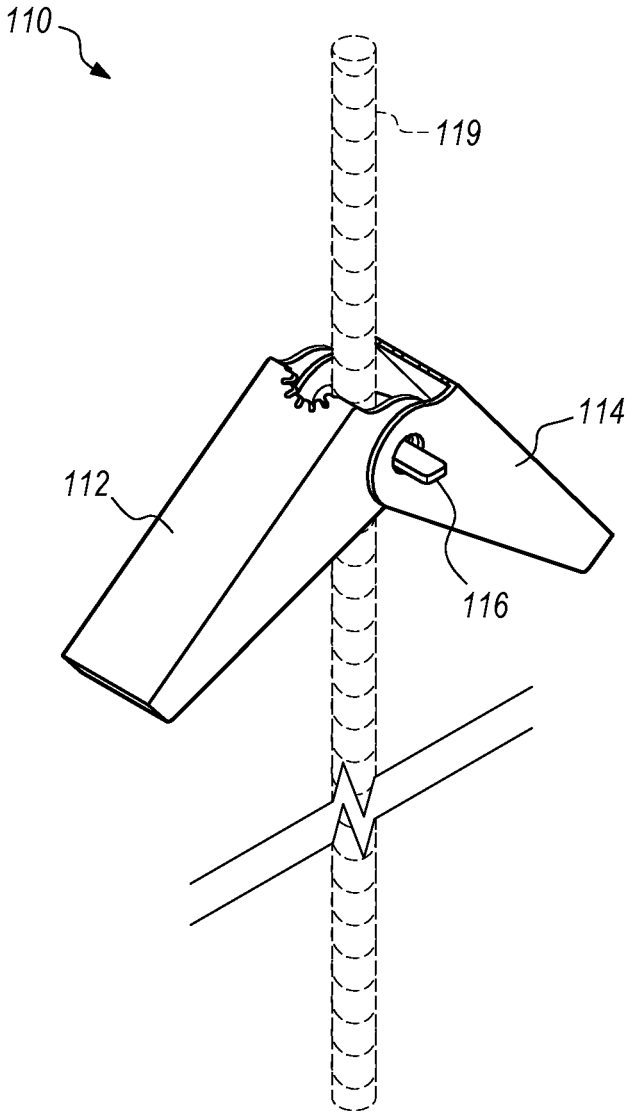
FIG. 63 is a perspective view of a rebar toggle.
Figure 63A:
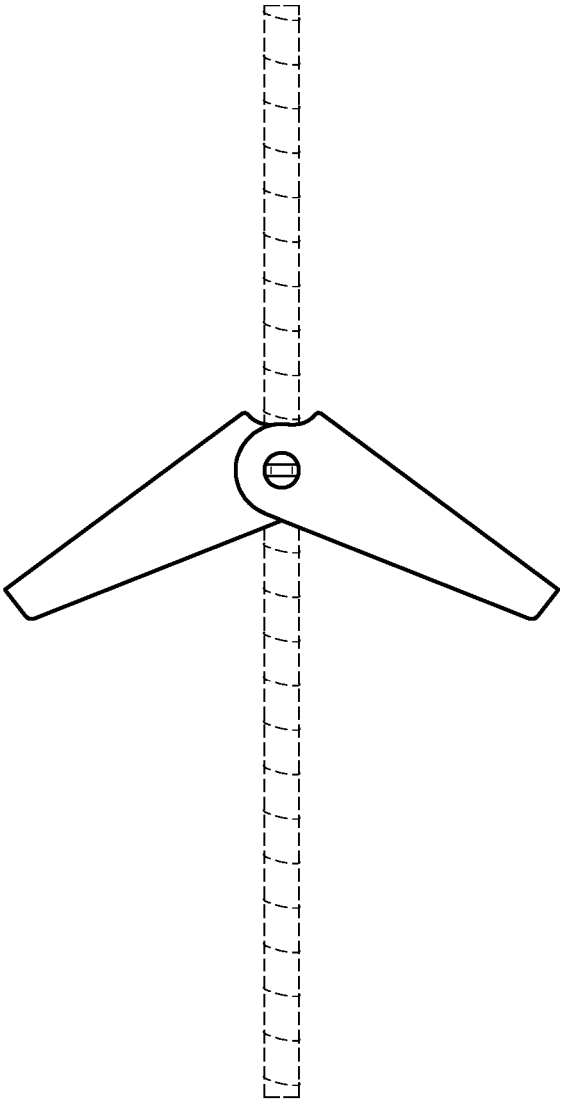
FIG. 63A is a front elevation view of rebar toggle, the rear elevation view being a mirror image thereof.
Figure 63B:
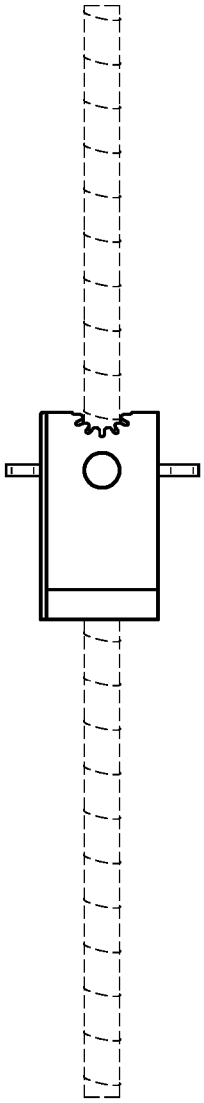
FIG. 63B is left side elevation of rebar toggle, the right side elevation being a mirror image thereof.
Figure 63C:
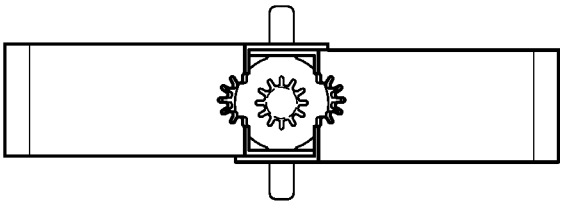
FIG. 63C is a top plan view of rebar toggle.
Figure 63D:
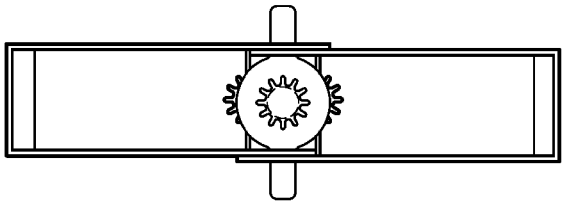
FIG. 63D is a bottom plan view of rebar toggle.
Figure 64:
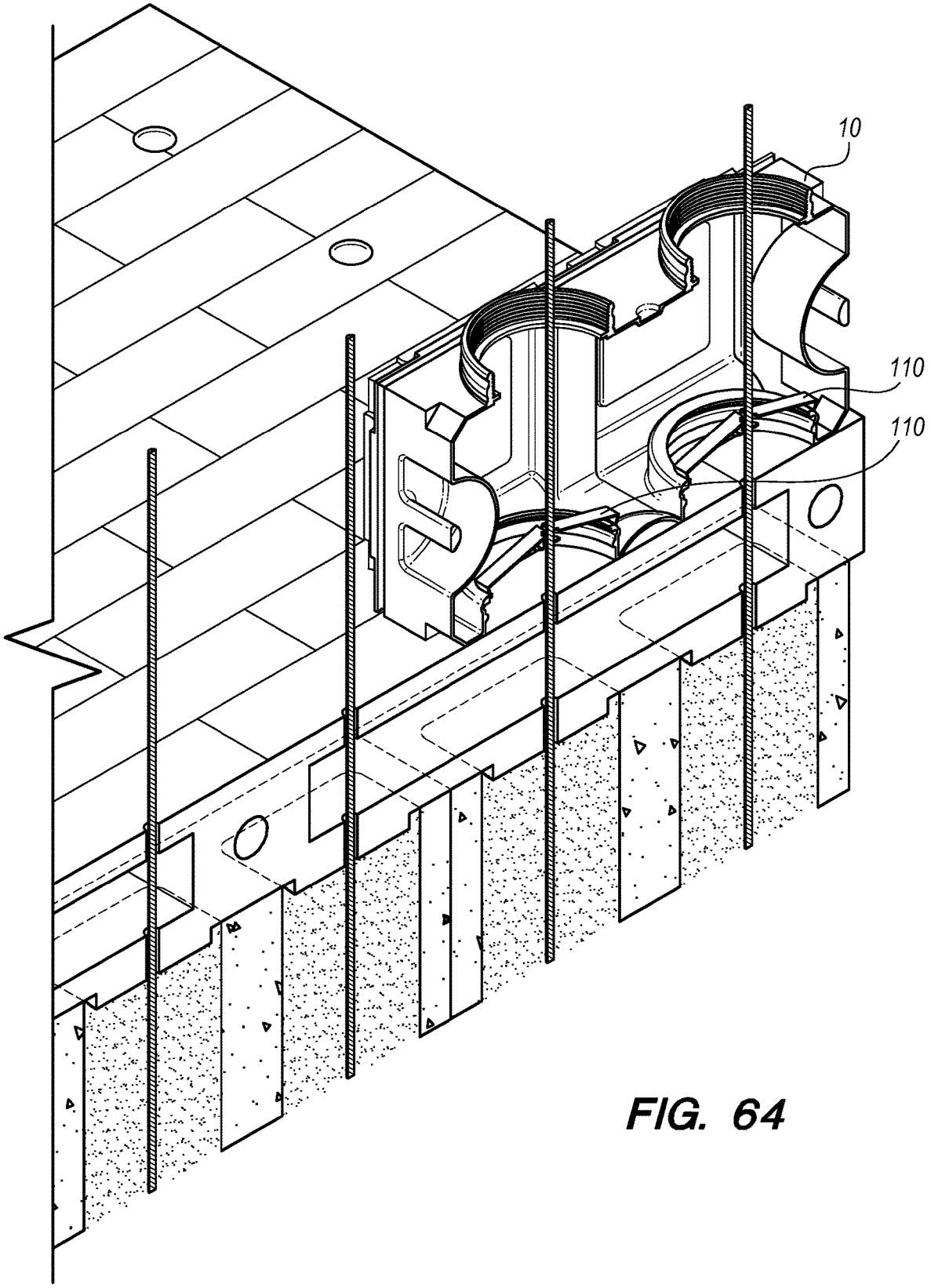
FIG. 64 is a cross sectional view of a building block container attached to a floor pallet using two rebar toggles.
Figure 65:
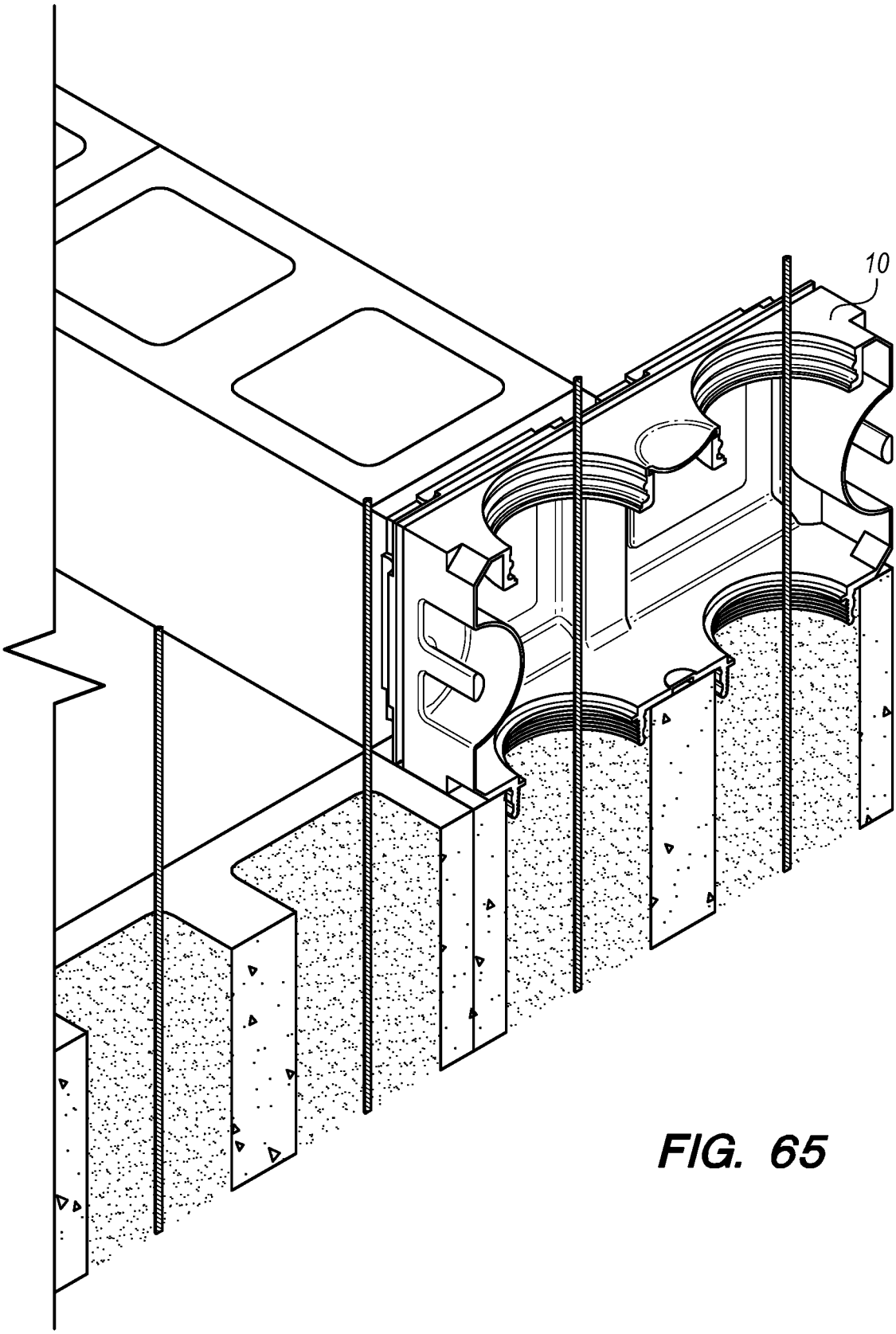
FIG. 65 is another cross sectional view of a building block container attached to a floor pallet without rebar toggles.

Building block containers 10 may be attached to a pallet floor 100 using rebar 119 and one of more rebar toggles 110. The design of rebar toggle 110 is depicted in FIGS. 63-63D. A rebar toggle 110 is a toggle. Rebar toggle 110 is rigidly attachable to rebar 119. Rebar 119 is standard concrete or cement reinforcement metal that is solidified inside the liquid concrete or cement to add strength to the concrete or cement. Rebar toggle 110 comprises a left half 112, a right half 114, a front pin 116, and a rear pin 117. Left half 112 and right half 114 are pivotally attached to each other by front pin 116 and rear pin 117. Front pin 116 and rear pin 117 are each attached to left half 112. Front pin 116 and rear pin 117 each extend through a hole in right half 114 to pivot therein. When left half 112 and a right half 114 are squeezed together, rebar toggle 110 is slideable along rebar 119. When left half 112 and a right half 114 are pulled out to flatten these members, rebar toggle 110 becomes rigidly attached to rebar 119. When left half 112 and a right half 114 are pulled out to flatten these members, teeth on the rebar toggle 110 grab or bite onto the rebar 119 to rigidly attach thereto. Building block containers 10 are placed onto a pallet floor 100, the female cylindrical cavity knockout sections 36 are removed, and a rebar 119 is inserted through each male cylindrical protrusion 20 and driven into the ground as depicted in FIG. 64. A rebar toggle 110 is inserted over the end of each rebar 119 and slid downward to push against the inner surface of the lower surface 12 of building block container 10 as depicted in FIG. 64. A rebar toggle 110 is locked onto rebar 119 by pushing it flat. Then cement or concrete may be poured into the open building block containers 10 and solidified to for a permanent and solid foundation. This solid foundation is similar to an insulated concrete form structure because there is cement or concrete inside the building block containers 10 which themselves act as insulation against the cement or concrete.

What is claimed is:

1. A building block container comprising: a rigid hollow member with an upper surface, a lower surface, a front surface, a rear surface, a left surface, a right surface, and a hollow interior, wherein, said upper surface comprises a male cylindrical protrusion and said lower surface comprises a female cylindrical cavity, wherein, said male cylindrical protrusion is a rigid cylindrical shaped protrusion with an outer surface, an outer diameter, an inner surface, an inner diameter, a first end, a second end, a longitudinal axis, an O-ring groove, a locking ridge groove, and a female thread, wherein, said first end of said male cylindrical protrusion is contiguous with said upper surface of said rigid hollow member, said first end of said male cylindrical protrusion is rigidly attached to said upper surface of said rigid hollow member, said first end of said male cylindrical protrusion is open to provide access to said hollow interior of said rigid hollow member, said longitudinal axis of said male cylindrical protrusion is perpendicular to said upper surface of said rigid hollow member, said second end of said male cylindrical protrusion protrudes outward from said upper surface of said rigid hollow member, said second end of said male cylindrical protrusion is open to provide access to said hollow interior of said rigid hollow member, said male cylindrical protrusion O-ring groove is a groove, channel, or cavity around said outer surface of said male cylindrical protrusion adjacent to said first end of said male cylindrical protrusion, said locking ridge groove is a groove, channel, or cavity around said outer surface of said male cylindrical protrusion located between said male cylindrical protrusion O-ring groove and said second end of said male cylindrical protrusion, said locking ridge groove on said male cylindrical protrusion is sized and shaped to make a press fit or snap fit with a locking ridge on said female cylindrical cavity, said female thread is a plurality of female pipe thread on said inner surface of said male cylindrical protrusion, said female cylindrical cavity is a rigid cylindrical shaped cavity with an outer surface, an outer diameter, an inner surface, an inner diameter, a first end, a second end, a longitudinal axis, an O-ring groove, a locking ridge, and a knockout section, wherein, said first end of said female cylindrical cavity is contiguous with said lower surface of said rigid hollow member, said first end of said female cylindrical cavity is rigidly attached to said lower surface of said rigid hollow member, said first end of said female cylindrical cavity is open to provide access to said knockout section, said longitudinal axis of said female cylindrical cavity is perpendicular to said lower surface of said rigid hollow member, said second end of said female cylindrical cavity protrudes inward from said lower surface of said rigid hollow member, said second end of said female cylindrical cavity is located in said hollow interior of said rigid hollow member, said female cylindrical cavity O-ring groove is a groove, channel, or cavity around said inner surface of said female cylindrical cavity adjacent to said second end of said female cylindrical cavity, said locking ridge is a ridge, protrusion, or projection on said inner surface of said female cylindrical cavity located between female cylindrical cavity O-ring groove and said first end of said female cylindrical cavity, said locking ridge on said female cylindrical cavity is sized and shaped to make a press fit or snap fit with said locking ridge groove on said male cylindrical protrusion, said knockout section is a rigid liquid tight or watertight barrier member, and said knockout section is rigidly attached to said second end of said female cylindrical cavity to form a liquid tight or watertight connection therewith.

2. A building block container as recited in claim 1 further comprising: a threaded port, wherein said thread port is threaded female cylindrical hole or threaded female pipe fitting connection on said upper surface, said lower surface, said front surface, said rear surface, said left surface, or said right surface of said building block container.

3. A building block container as recited in claim 1 wherein said upper surface further comprises a second male cylindrical protrusion and said lower surface further comprises a second female cylindrical cavity as described in claim 1.

4. A building block container as recited in claim 3 further comprising: a threaded port, wherein said thread port is threaded female cylindrical hole or threaded female pipe fitting connection on said upper surface, said lower surface, said front surface, said rear surface, said left surface, or said right surface of said building block container.

5. A building block container as recited in claim 3 wherein said upper surface further comprises a third male cylindrical protrusion and said lower surface further comprises a third female cylindrical cavity as described in claim 1.

6. A building block container as recited in claim 5 further comprising: a threaded port, wherein said thread port is threaded female cylindrical hole or threaded female pipe fitting connection on said upper surface, said lower surface, said front surface, said rear surface, said left surface, or said right surface of said building block container.

7. A building block container as recited in claim 5 wherein said upper surface further comprises a fourth male cylindrical protrusion and said lower surface further comprises a fourth female cylindrical cavity as described in claim 1.

8. A building block container as recited in claim 7 further comprising: a threaded port, wherein said thread port is threaded female cylindrical hole or threaded female pipe fitting connection on said upper surface, said lower surface, said front surface, said rear surface, said left surface, or said right surface of said building block container.

* * * * *